US009129491B2

(12) United States Patent
Fujisawa et al.

(10) Patent No.: US 9,129,491 B2
(45) Date of Patent: Sep. 8, 2015

(54) GAMING MACHINE AND CONTROL METHOD THEREOF

(71) Applicants: UNIVERSAL ENTERTAINMENT CORPORATION, Koto-ku, Tokyo (JP); ARUZE GAMING AMERICA, INC., Las Vegas, NV (US)

(72) Inventors: Masumi Fujisawa, Tokyo (JP); Kenta Kitamura, Tokyo (JP); Takehisa Itagaki, Tokyo (JP); Masafumi Uchida, Tokyo (JP); Makoto Miyawaki, Tokyo (JP)

(73) Assignees: UNIVERSAL ENTERTAINMENT CORPORATION, Tokyo (JP); ARUZE GAMING AMERICA, INC., Las Vegas, NV (US)

( * ) Notice: Subject to any disclaimer, the term of this patent is extended or adjusted under 35 U.S.C. 154(b) by 0 days.

(21) Appl. No.: 14/109,872

(22) Filed: Dec. 17, 2013

(65) Prior Publication Data

US 2014/0141858 A1 May 22, 2014

Related U.S. Application Data

(63) Continuation of application No. 13/244,569, filed on Sep. 25, 2011, now Pat. No. 8,622,818.

(30) Foreign Application Priority Data

| | | |
|---|---|---|
| Nov. 8, 2010 | (JP) | 2010-250192 |
| Jun. 15, 2011 | (JP) | 2011-133005 |
| Jun. 15, 2011 | (JP) | 2011-133006 |

(51) Int. Cl.

| | |
|---|---|
| ***A63F 9/24*** | (2006.01) |
| ***G07F 17/34*** | (2006.01) |
| ***G07F 17/32*** | (2006.01) |

(52) U.S. Cl.
CPC ..... *G07F 17/34* (2013.01); *G07F 17/3202* (2013.01)

(58) Field of Classification Search
CPC ..... G07F 17/32
See application file for complete search history.

(56) References Cited

U.S. PATENT DOCUMENTS

| | | | | |
|---|---|---|---|---|
| 2003/0013517 | A1 * | 1/2003 | Bennett et al. | 463/25 |
| 2008/0139294 | A1 | 6/2008 | Inamura | |
| 2008/0146314 | A1 | 6/2008 | Yoshizawa | |

FOREIGN PATENT DOCUMENTS

| | | |
|---|---|---|
| EP | 1 376 498 | 1/2004 |

OTHER PUBLICATIONS

May 7, 2013 Non-Final Office Action in connection with parent U.S. Appl. No. 13/244,569.

*Primary Examiner* — Omkar Deodhar
(74) *Attorney, Agent, or Firm* — KMF Patent Services, PLLC; Kenneth M. Fagin, Esq.; S. Peter Konzel, Esq.

(57) ABSTRACT

The controller of the gaming machine executing processing operations of: (a) determining a magnification of a respective one of plural kinds of colors which are produced in a color displayable manner by means of the multiple color light emitting backlight and then displaying on the display; (b) determining a light emitting color by means of the multiple color light emitting backlight and then controlling light emission in the determined color; and (c) executing a payout of a number which is obtained by multiplying the magnification that corresponds to the color determined in the processing (b), from among the magnifications of the respective colors, the magnifications being determined in the processing (a), for a payment that corresponds to the pattern of the specific symbols.

5 Claims, 37 Drawing Sheets

FIG. 9

| SYMBOL | GAME STATE | IDENTIFICATION NUMBER | LIGHT EMITTING COLOR |
|---|---|---|---|
| 囍 | BASIC GAME | 0010 | WHITE |
| | SECOND GAME | 0011 | RED |
| | | 0012 | BLUE |
| | | 0013 | GREEN |

FIG. 10

| IDENTIFICATION NUMBER | LIGHT EMITTING COLOR | MAGNIFICATION |
|---|---|---|
| 0011 | RED | 5 TIMES |
| 0012 | BLUE | 3 TIMES |
| 0013 | GREEN | 2 TIMES |

FIG. 11

| MOVIE DATA | PANDA 152a | PANDA 152b | PANDA 152c |
|---|---|---|---|
| A | 1 PLACE | 2 PLACE | 3 PLACE |
| B | 1 PLACE | 3 PLACE | 2 PLACE |
| C | 2 PLACE | 1 PLACE | 3 PLACE |
| D | 2 PLACE | 3 PLACE | 1 PLACE |
| E | 3 PLACE | 1 PLACE | 2 PLACE |
| F | 3 PLACE | 2 PLACE | 1 PLACE |

FIG. 29

| SYMBOL | IDENTIFICATION NUMBER | LIGHT EMITTING COLOR | NUMBER OF TIMES OF GAME PLAYED |
|---|---|---|---|
| WILD | 0021 | YELLOW | 2 TIMES |
| | 0022 | BLUE | 3 TIMES |
| | 0023 | RED | 5 TIMES |

FIG. 37

SYMBOL TABLE FOR BASE GAME

*W=WEIGHT

| | FIRST REEL | | | SECOND REEL | | | THIRD REEL | | | FOURTH REEL | | | FIFTH REEL | | |
|---|---|---|---|---|---|---|---|---|---|---|---|---|---|---|---|
| CODE NO. | SYMBOL | W | SPECIFIC RANGE | SYMBOL | W | SPECIFIC RANGE | SYMBOL | W | SPECIFIC RANGE | SYMBOL | W | SPECIFIC RANGE | SYMBOL | W | SPECIFIC RANGE |
| 00 | 2Bar | 3 | 0-2 | Wild | 2 | 0-1 | Wild | 2 | 0-1 | Wild | 2 | 0-1 | Wild | 2 | 0-1 |
| 01 | Pic_A | 3 | 3-5 | Wild | 1 | 2 | Wild | 1 | 2 | Wild | 1 | 2 | Wild | 1 | 2 |
| 02 | 3Bar | 3 | 6-8 | Wild | 2 | 3-4 | Wild | 2 | 3-4 | Wild | 2 | 3-4 | Wild | 2 | 3-4 |
| 03 | Blank | 3 | 9-11 | Blank | 2 | 5-6 | Blank | 2 | 5-6 | Blank | 2 | 5-6 | Blank | 2 | 5-6 |
| 04 | 2Bar | 3 | 12-14 | 1Bar | 2 | 7-8 | Pic_A | 2 | 7-8 | 2Bar | 2 | 7-8 | Pic_A | 2 | 7-8 |
| 05 | Blank | 0 | — | Blank | 6 | 9-14 | Blank | 0 | — | Blank | 6 | 9-14 | Blank | 0 | — |
| 06 | Trigger_A | 0 | — | 2Bar | 6 | 15-20 | Trigger_A | 0 | — | 1Bar | 6 | 15-20 | Trigger_A | 0 | — |
| 07 | Blank | 0 | — | Blank | 0 | — | Blank | 0 | — | Blank | 0 | — | Blank | 0 | — |
| 08 | 2Bar | 0 | — | Trigger_A | 0 | — | Pic_A | 0 | — | Trigger_A | 0 | — | Pic_A | 0 | — |
| 09 | Blank | 3 | 15-17 | Blank | 0 | — | Blank | 7 | 9-15 | Blank | 0 | — | Blank | 6 | 9-14 |
| 10 | Pic_A | 8 | 18-25 | 2Bar | 0 | — | 1Bar | 7 | 16-22 | 1Bar | 0 | — | 2Bar | 6 | 15-20 |
| 11 | Blank | 8 | 26-33 | Blank | 6 | 21-26 | Blank | 7 | 23-29 | Blank | 6 | 21-26 | Blank | 6 | 21-26 |
| 12 | Pic_A | 3 | 34-36 | Pic_A | 6 | 27-32 | 3Bar | 7 | 30-36 | Pic_A | 6 | 27-32 | 1Bar | 6 | 27-32 |
| 13 | Blank | 3 | 37-39 | Blank | 0 | — | Blank | 0 | — | Blank | 0 | — | Blank | 0 | — |
| 14 | 3Bar | 3 | 40-42 | Trigger_B | 0 | — | Trigger_B | 0 | — | Trigger_B | 0 | — | Trigger_B | 0 | — |
| 15 | Blank | 3 | 43-45 | Blank | 0 | — | Blank | 0 | — | Blank | 0 | — | Blank | 0 | — |
| 16 | 1Bar | 3 | 46-48 | Pic_A | 0 | — | 3Bar | 0 | — | Pic_A | 0 | — | 1Bar | 0 | — |
| 17 | Blank | 0 | — | Blank | 6 | 33-38 | Blank | 7 | 37-43 | Blank | 6 | 33-38 | Blank | 6 | 33-38 |
| 18 | Trigger_B | 0 | — | 3Bar | 6 | 39-44 | 2Bar | 7 | 44-50 | 3Bar | 6 | 39-44 | 3Bar | 6 | 39-44 |
| 19 | Blank | 0 | — | Blank | 6 | 45-50 | Blank | 7 | 51-57 | Blank | 6 | 45-50 | Blank | 6 | 45-50 |
| 20 | 1Bar | 0 | — | 1Bar | 6 | 51-56 | Pic_A | 7 | 58-64 | 2Bar | 6 | 51-56 | Pic_A | 6 | 51-56 |
| 21 | Blank | 3 | 49-51 | Blank | 2 | 57-58 | Blank | 2 | 65-66 | Blank | 2 | 57-58 | Blank | 2 | 57-58 |

FIG. 39

TABLE OF CONDITIONS UNDER WHICH SECOND GAME STARTS

| | WEIGHT | RANDOM NUMBER RANGES |
|---|---|---|
| OCCURRENCE | 2 | 0–1 |
| LOSING | 75 | 2–74 |

RANDOM NUMBER EXTRACTION RANGE

FIG. 40

THREE CONTINUOUS WILD REEL DETERMINATION TABLE

| FIRST REEL | SECOND REEL | THIRD REEL | FOURTH REEL | FIFTH REEL | WEIGHT | RANDOM NUMBER RANGES |
|---|---|---|---|---|---|---|
| WILD | WILD | WILD | WILD | WILD | 0 | — |
| — | WILD | WILD | WILD | WILD | 1 | 0 |
| WILD | — | WILD | WILD | WILD | 0 | — |
| WILD | WILD | — | WILD | WILD | 0 | — |
| WILD | WILD | WILD | — | WILD | 0 | — |
| WILD | WILD | WILD | WILD | — | 0 | — |
| — | — | WILD | WILD | WILD | 3 | 1-3 |
| — | WILD | — | WILD | WILD | 3 | 4-6 |
| — | WILD | WILD | — | WILD | 4 | 7-10 |
| — | WILD | WILD | WILD | — | 4 | 11-14 |
| WILD | — | — | WILD | WILD | 0 | — |
| WILD | — | WILD | — | WILD | 0 | — |
| WILD | — | WILD | WILD | — | 0 | — |
| WILD | WILD | — | — | WILD | 0 | — |
| WILD | WILD | — | WILD | — | 0 | — |
| WILD | WILD | WILD | — | — | 0 | — |
| — | — | — | WILD | WILD | 4 | 15-18 |
| — | — | WILD | — | WILD | 11 | 19-29 |
| — | — | WILD | WILD | — | 10 | 30-39 |
| — | WILD | — | — | WILD | 10 | 40-49 |
| — | WILD | — | WILD | — | 11 | 50-60 |
| — | WILD | WILD | — | — | 9 | 61-69 |
| WILD | — | — | — | WILD | 0 | — |
| WILD | — | — | WILD | — | 0 | — |
| WILD | — | WILD | — | — | 0 | — |
| WILD | WILD | — | — | — | 0 | — |
| — | — | — | — | WILD | 0 | — |
| — | — | — | WILD | — | 0 | — |
| — | — | WILD | — | — | 12 | 70-81 |
| — | WILD | — | — | — | 18 | 82-99 |
| WILD | — | — | — | — | 0 | — |

RANDOM NUMBER EXTRACTION RANGE (0 - 99)

FIG. 41

SYMBOL TABLE FOR SECOND GAME

*W=WEIGHT

| | FIRST REEL | | | SECOND REEL | | | THIRD REEL | | | FOURTH REEL | | | FIFTH REEL | | |
|---|---|---|---|---|---|---|---|---|---|---|---|---|---|---|---|
| CODE NO. | SYMBOL | W | SPECIFIC RANGE | SYMBOL | W | SPECIFIC RANGE | SYMBOL | W | SPECIFIC RANGE | SYMBOL | W | SPECIFIC RANGE | SYMBOL | W | SPECIFIC RANGE |
| 00 | 2Bar | 0 | — | Wild | 0 | — | Wild | 0 | — | Wild | 0 | — | Wild | 0 | — |
| 01 | Pic_A | 0 | — | Wild | 0 | — | Wild | 0 | — | Wild | 0 | — | Wild | 0 | — |
| 02 | 3Bar | 0 | — | Wild | 0 | — | Wild | 0 | — | Wild | 0 | — | Wild | 0 | — |
| 03 | Blank | 0 | — | Blank | 0 | — | Blank | 0 | — | Blank | 0 | — | Blank | 0 | — |
| 04 | 2Bar | 10 | 0-9 | 1Bar | 0 | — | Pic_A | 16 | 0-15 | 2Bar | 7 | 0-6 | Pic_A | 16 | 0-15 |
| 05 | Blank | 8 | 10-17 | Blank | 0 | — | Blank | 8 | 16-23 | Blank | 6 | 7-12 | Blank | 8 | 16-23 |
| 06 | Trigger_A | 8 | 18-25 | 2Bar | 12 | 0-11 | Trigger_A | 8 | 24-31 | 1Bar | 7 | 13-19 | Trigger_A | 8 | 24-31 |
| 07 | Blank | 8 | 26-33 | Blank | 8 | 12-19 | Blank | 8 | 32-39 | Blank | 8 | 20-27 | Blank | 8 | 32-39 |
| 08 | 2Bar | 10 | 34-43 | Trigger_A | 8 | 20-27 | Pic_A | 16 | 40-55 | Trigger_A | 8 | 28-35 | Pic_A | 16 | 40-55 |
| 09 | Blank | 0 | — | Blank | 8 | 28-35 | Blank | 0 | — | Blank | 8 | 36-43 | Blank | 0 | — |
| 10 | Pic_A | 15 | 44-58 | 2Bar | 12 | 36-47 | 1Bar | 0 | — | 1Bar | 7 | 44-50 | 2Bar | 0 | — |
| 11 | Blank | 0 | — | Blank | 0 | — | Blank | 0 | — | Blank | 0 | — | Blank | 0 | — |
| 12 | Pic_A | 15 | 59-73 | Pic_A | 0 | — | 3Bar | 0 | — | Pic_A | 0 | — | 1Bar | 0 | — |
| 13 | Blank | 0 | — | Blank | 0 | — | Blank | 0 | — | Blank | 0 | — | Blank | 0 | — |
| 14 | 3Bar | 0 | — | Trigger_B | 0 | — | Trigger_B | 0 | — | Trigger_B | 0 | — | Trigger_B | 0 | — |
| 15 | Blank | 0 | — | Blank | 0 | — | Blank | 0 | — | Blank | 0 | — | Blank | 0 | — |
| 16 | 1Bar | 0 | — | Pic_A | 0 | — | 3Bar | 0 | — | Pic_A | 0 | — | 1Bar | 0 | — |
| 17 | Blank | 0 | — | Blank | 0 | — | Blank | 0 | — | Blank | 0 | — | Blank | 0 | — |
| 18 | Trigger_B | 0 | — | 3Bar | 6 | 48-55 | 2Bar | 0 | — | 3Bar | 7 | 51-57 | 3Bar | 0 | — |
| 19 | Blank | 0 | — | Blank | 6 | 56-63 | Blank | 0 | — | Blank | 7 | 58-64 | Blank | 0 | — |
| 20 | 1Bar | 0 | — | 1Bar | 6 | 64-71 | Pic_A | 18 | 56-73 | 2Bar | 7 | 65-71 | Pic_A | 18 | 56-73 |
| 21 | Blank | 0 | — | Blank | 0 | — | Blank | 0 | — | Blank | 0 | — | Blank | 0 | — |

GAMING MACHINE AND CONTROL METHOD THEREOF

CROSS-REFERENCE TO RELATED APPLICATIONS

This application is a continuation of U.S. application Ser. No. 13/244,569, filed Sep. 25, 2011 (issued as U.S. Pat. No. 8,622,818 on Jan. 7, 2014), the benefit and domestic priority benefit of which are claimed. This application claims foreign priority from Japanese Patent Applications No. 2010-250192, filed on Nov. 8, 2010; No. 2011-133005, filed on Jun. 15, 2011; and No. 2011-133006, filed on Jun. 15, 2011. The contents of these four U.S. and Japanese applications are incorporated herein by reference in their entirety.

BACKGROUND AND FIELD OF THE INVENTION

1. Field of the Invention

The present invention relates to a gaming machine and a control method of the gaming machine that displays symbols by stoppage of spinning reels.

2. Description of the Related Art

Conventionally, slot machines are disclosed in United State Patent Application Publication No. 2003/013517, United State Patent Application Publication No. 2008/146314, United State Patent Application No. 2008/139294, and European Patent Application Publication No. 1376498. Such slot machines are played in such a manner that, when a player inserts a gaming medium such as a coin or a bill into an insertion slot of a slot machine and operates a spin button, a plurality of symbols are scroll-displayed in a symbol display area which is provided on a front face of a cabinet, and then, the respective symbols automatically stop.

As such slot machines, there exist slot machines in which a payment is paid out in a case where a combination of symbols which are displayed on a winning line is a predetermined combination; in a case where the number of symbols which are displayed in a symbol display area is a predetermined number; or alternatively, in a case where divided symbol images constitute one complete image.

In gaming machines which are represented by such conventional slot machines, a payment is paid out based on the symbols that are displayed in the symbol display area or the routine migrates to another game. Thus, there is a need to increase a display mode of the symbol display area in order to clearly display the contents of payments or a game migration state for a player.

However, in a case where symbols are displayed in the symbol display area by controlling spinning of spinning reels, only the symbols that are arranged on peripheral faces of the spinning reels are allowed to be displayed, thus making it impossible to increase the symbol display mode.

Therefore, the present invention has been made in order to solve the conventional problem described above. It is an object of the present invention to provide a gaming machine and a control method of the gaming machine that is capable of diversifying the display mode of symbols by means of the spinning reels.

SUMMARY OF THE INVENTION

A gaming machine in a first aspect of the present invention, comprising:

a plurality of spinning reels having symbols arranged on peripheral faces thereof;

a symbol display window having a symbol display area in which symbols are scroll-displayed by spinning of the spinning reels and the spinning symbols are stop-displayed by stoppage of the spinning reels;

a display which is arranged at an upper part of the symbol display window, for displaying a video image;

a multiple color light emitting backlight which is configured to individually illuminate a respective one of the symbols that are displayed in the symbol display area from a back side; and a controller which is configured to start a second game in a case where a pattern of specific symbols serving as a trigger for migrating from a basic game to a second game is displayed in the symbol display area, the controller executing processing operations of:

(a) determining a magnification of a respective one of plural kinds of colors which are produced in a color displayable manner by means of the multiple color light emitting backlight and then displaying the magnification that is determined for the respective one of the colors on the display;

(b) while the magnification of the respective one of the plural kinds of colors that are reproduced in the color displayable manner is displayed on the display, determining a light emitting color by means of the multiple color light emitting backlight at a back side of a respective one of the specific symbols that are displayed in the symbol display area, from among the plural kinds of colors that are produced in the color displayable manner by means of the multiple color light emitting backlight, and when the second game started is completed, controlling light emission in the determined color; and (c) executing a payout of a number which is obtained by multiplying the magnification that corresponds to the color determined in the processing (b), from among the magnifications of the respective colors, the magnifications being determined in the processing (a), for a payment that corresponds to the pattern of the specific symbols.

According to the gaming machine in the first aspect of the present invention, a light emitting color exerted by a multiple color light emitting backlight at a back side of a specific symbol is determined from among a plural kinds of colors which are produced in a color displayable manner and then light emission of the multiple color light emitting backlight is controlled by means of the determined color. Therefore, the illumination color of the specific symbol can be changed by making the light emitting color of the multiple color light emitting backlight different from another one. Accordingly, there can be provided a gaming machine, which is capable of diversifying the display mode of symbols by means of the spinning reels.

The gaming machine in the second aspect of the present invention, wherein: in the gaming machine of the present invention in the first aspect, the multiple color light emitting backlight has a respective one of shading portions which are provided for a plurality of spinning reels; and the respective one of the shading portions is configured to shade light in a respective one of partition areas which are partitioned in order to individually emit the light to a respective one of the symbols that are displayed in the symbol display area, so that all of the symbols that are displayed in the symbol display area are allowed to be displayed by means of the multiple color light emitting backlight in a color variable manner.

According to the gaming machine in the second aspect of the present invention, as in the gaming machine according to the first aspect of the present invention, the multiple color light emitting backlight has a shading portion which is provided for a respective one of the spinning reels, for shading light in a respective one of partition areas which are partitioned in order to emit light from the back side individually on a symbol-by-symbol basis. Thus, it becomes possible to prevent the illumination cover from being changed from a target color by being illuminated by the illumination light of the peripheral symbols and then diversify the display mode of symbols.

A gaming machine in the third aspect of the present invention, comprising:

a plurality of spinning reels having symbols arranged on peripheral face thereof;

a symbol display window having a symbol display area in which symbols are scroll-displayed by spinning of the spinning reels and the spinning symbols are stop-displayed by stoppage of the spinning reels;

a multiple color light emitting backlight which is configured to individually illuminate a respective one of the symbols that are displayed in the symbol display area from a back side; and a controller which is configured to migrate from the basic game to a second game to be executed in accordance with a second game program, in a case where there is the spinning reel on which all of the symbols that are displayed in the symbol display area are wild symbols which are allowed to be substituted by another symbols, in the basic game to be executed in accordance with the basic game program;

in the second game, the controller executing processing operations of:

(a) with respect to the spinning reel on which all of the symbols that are displayed in the symbol display area are the wild symbols in the basic game, changing a color, which is produced to illuminate a respective one of the wild symbols from a back side by means of the multiple color light emitting backlight, to a second color which is different from a first color which is produced to illuminate in the basic game;

(b) in a state in which the spinning reel on which the wild symbols are displayed in all of the symbol display area is stopped in the basic game, spinning and stopping another spinning reel and then paying out a payment in accordance with a combination of the symbols that are displayed in the symbol display area;

(c) executing the processing (b) a predetermined number of times; and (d) Subsequent to executing the processing (b) in the predetermined number of times in (c), completing the second game program, and then, upon starting a basic game in accordance with the basic game program, changing to the first color, the second color which is produced to illuminate wild symbols which are displayed in the symbol display window by means of the spinning reels which are held in a stopped state in the second game.

According to the gaming machine in the third aspect of the present invention, in a second game, in a state in which spinning reels having wild symbols displayed thereon are stopped in all of the symbol display area in a basic game, another spinning reels are rotated and stopped, and then, a payment is paid out. The color that is produced by illuminating a wild symbol by means of the multiple color backlight from the back side is changed to a color which is different from the one illuminated in the basic game. Thus, all of the spinning reels of which spinning are stopped can be easily visually recognized to be wild symbols which are allowed to be substituted by other symbols.

In addition, by changing the color that is produced by illuminating the wild symbols from the back side, it becomes possible to display the fact that a payment can be easily obtained by means of wild symbols which are allowed to be substituted by other symbols.

Therefore, there can be provided a gaming machine, which is capable of diversifying the display mode of symbols by means of spinning reels.

A gaming machine in the fourth aspect of the present invention, comprising:

a plurality of spinning reels having symbols arranged on peripheral faces thereof;

a symbol display window having a symbol display area in which symbols are scroll-displayed by spinning of the spinning reels and the spinning symbols are stop-displayed by stoppage of the spinning reels;

a multiple color light emitting backlight having a shading portion which is provided for a respective one of a plurality of spinning reels, the backlight being configured to shade light in a respective one of partition areas which are partitioned in order to individually emit the light from a back side to a respective one of the symbols that are displayed in the symbol display area so that all of the symbols that are displayed in the symbol display area are allowed to be displayed individually in a color changeable manner;

a memory which is configured to store table data for associating a plurality of numeric values with one symbol in accordance with a combination of the symbols and a plurality of colors of the light beams to be emitted from the back side; and a controller which is configured to: randomly determine a light emitting color of the multiple color light emitting backlight after symbols are stop-displayed in the symbol display area; refer to the table data that is stored in the memory in accordance with the light emitting color that is determined to illuminate a respective one of the symbols that are displayed in the symbol display area and the back side thereof; and give a payment in association with the numeric values that are obtained by means of the table data.

According to the gaming machine in the fourth aspect of the present invention, the light emitting color of the multiple color light emitting backlight is randomly determined, and according to the symbols that are displayed in the symbol display area and the light emitting color determined in order to illuminate its back side, a payment is given in association with a numeric value which is obtained by referring to table data. Thus, it becomes possible to recognize the contents of a payment to be given by visually recognizing the colors of the symbols that are displayed in the symbol display area. Therefore, there can be provided a gaming machine, which is capable of diversifying the display mode of symbols by means of spinning reels.

A method of controlling a gaming machine in the fifth aspect of the present invention which comprises a controller, the controller being configured to start a second game in a case where a pattern of specific symbols serving as a trigger for migrating from a basic game to the second game is displayed in a symbol display area in which symbols are stop-displayed by stopping spinning reels having the symbols arranged on peripheral faces thereof, said control method comprising the steps of:

(a) determining a magnification for a respective one of plural kinds of colors which are produced in a color displayable manner by means of a multiple color light emitting backlight which is configured to illuminate a respective one of the symbols that are displayed in the symbol display area individually from a back side, and then, displaying the magnification determined for a respective one of the colors on a display which is arranged at an upper part of the symbol display area, for displaying a video image;

(b) while the magnification of the respective one of the plural kinds of colors that are produced in the color displayable manner is displayed on the display, determining a light emitting color by means of the multiple color light emitting backlight at a back side of a respective one of the specific symbols that are displayed in the symbol display area, from among the plural kinds of colors that are produced in the color displayable manner by means of the multiple color light emitting backlight, and when the second game started is completed, controlling light emission in the determined color; and (c) executing a payout of a number which is obtained by multiplying the magnification that corresponds to the color determined in the processing (b), from among the magnifications of the respective one of the colors, the magnifications being determined in the processing (a), for a payment that corresponds to the pattern of the specific symbols.

According to the method for controlling the gaming machine, in the fifth aspect of the present invention, the light emitting color exerted by the multiple color light emitting backlight on the back side of a specific symbol is determined from among plurality kinds of colors which can be produced in a color displayable manner, and light emission of the multiple color light emitting backlight is controlled by means of the determined color. Therefore, the illumination color can be changed by making the light emitting colors of the multiple color light emitting backlight different from each other. Hence, there can be provided a control method of the gaming machine that is capable of diversifying the display mode of symbols by means of spinning reels.

According to the gaming machine of the present invention, there can be provided a gaming machine and a control method of the gaming machine that is capable of diversifying the display mode of symbols by means of spinning reels.

The gaming machine according to seventh aspect of the present invention, comprising:

a symbol display unit which rearranges a plurality of symbols;

a storage unit in which a plurality of kinds of data including second game start data is stored;

a controller programmed to execute the following processing (a1) to processing (a5):

(a1) processing of rearranging the symbols on the symbol display units and running the base game which is capable of establishing a winning prize based on the rearranged symbols;

(a2) processing or randomly selecting the data in the storage unit;

(a3) processing of rearranging the symbols in a display mode based on the data selected in processing (a2);

(a4) processing of running the second game after the run of the base game when the data selected in processing (a2) is the second game start data; and (a5) processing, when the data selected in processing (a2) is not the second game start data, of randomly selecting whether the second game start condition is established and, when the second game start condition is established, to run the second game after the run of the base game.

According to the gaming machine in the seventh aspect of the present invention, a plurality of conditions for the migration from the base game to the second game exist at least in the sense of internal processing. Thus, the method of migration to the second game is diversified for the player and the second game begins without player recognition. Therefore, the entertainment characteristic can be improved.

The gaming machine according to eighth aspect of the present invention, wherein:

the storage unit stores symbol specific value data used as symbol specific values each of which is correlated to each of the plurality of symbols as the plurality of kinds of data and stores second game start condition data which specifies the second game start condition as the a plurality of kinds of data, and the controller uses the symbol specific value data in the processing (a2) and uses, in processing (a5), the second game start condition data in randomly selecting whether the second game start condition is established.

According to the gaming machine in the eighth aspect of the present invention, symbols to be rearranged in accordance with randomly selected symbol specific value data are determined and, when the symbol specific value data is second game start data, the second game is run. Even if the symbol specific value data is not the second game start data, it is determined whether the second game is to run in accordance with the second game start condition data. Thus, when the rearranged symbols correspond to the second game start data, a second game start condition is satisfied and thus the second game can be started. Even if the rearranged symbols do not correspond to the second game start data, the second game can be started based on the second game start condition data.

The gaming machine according to ninth aspect of the present invention, comprising:

a symbol display unit on which a plurality of symbols are rearranged;

a storage unit in which first second game start data based on which one second game is started in response to a game result data of a base game, and a plurality of kinds of data containing second second game start data is stored; and a controller programmed to execute the following processing (a1) to processing (a3):

(a1) processing of rearranging the symbols on the symbol display unit and running the base game which is capable of establishing a winning prize based on the rearranged symbols;

(a2) processing of randomly determining the game result of the base game; and (a3) processing of running the second game when game result data based on the game result satisfies a condition under which the second game is started in accordance with first or second second game start data which is a second game start condition stored in the storage unit.

According to the gaming machine in the ninth aspect of the present invention, a plurality of conditions for the migration from the base game to the second game exist at least in the sense of internal processing. Thus, the method of migration to the second game is diversified for the player and the second game begins without player recognition. Therefore, the entertainment characteristic can be improved.

The gaming machine according to tenth aspect of the present invention, wherein:

the first second game start data stored in the storage unit is data regarding a specific arrangement of symbols rearranged on a symbol display unit;

the second second game start data is data which is acquired randomly when a specific arrangement of symbols as the first second game start data is not satisfied; and the controller includes processing of determining whether the second game is started based on the second second game start data when the game result does not satisfy the first second game start data in processing (a3).

According to the gaming machine in the tenth aspect of the present invention, when a specific arrangement of symbols corresponding to first second game start data as a game result of the base game is obtained, a second game start condition is satisfied and thus the second game can be started. Even if the game result of the base game does not satisfy the specific arrangement of symbols, the second game can be started based on the second second game start data.

The gaming machine according to eleventh comprising:

a symbol display unit which rearranges a plurality of symbols;

a second game display unit on which the second game is displayed;

a storage unit in which a plurality of kinds of data including symbol specific value data used as symbol specific values each of which is correlated to each of the plurality of symbols is stored;

and a controller programmed to execute the following processing (a1) to processing (a4):

(a1) processing of rearranging the symbols on the symbol display units by randomly selecting the symbol specific values;

(a2) processing of rearranging symbols by the processing (a1) and running a base game which establishes a winning prize based on the rearranged symbols;

(a3) processing of running the second game on the second game display unit using the result rearrangement of the symbols when a winning prize under a predetermined condition is established in the base game; and (a4) processing of rearranging the symbols, by randomly selecting symbol specific values, such that the result of the rearrangement of the symbols during the running of the second game does not establish a winning prize.

In the second game, generally, the winning prize is not established by the rearrangement of the symbols in many cases: thus, it is possible that the players who do not understand this mechanism are confused when payment is not obtained by the rearrangement of the symbol. According to the configuration described above, since the symbols are not rearranged in the mode corresponding to the establishment of the winning prize during the running of the second game, the player can concentrate on playing the second game. Therefore, the entertainment characteristic can be maintained.

The gaming machine according to twelfth aspect of the present invention, wherein:

the storage unit stores symbol specific value data for the base game and symbol specific value data for the second game divided from a predetermined random number range into an arbitrary ranges of numerical values;

the range of numerical value corresponding to the symbols of which a result of rearrangement establishes a winning prize is set to 0 in the symbol specific value data for the second game;

the controller executes random selection in processing (a1) in the predetermined random number ranges in the base game in processing (a2) using the symbol specific value data for the base game, and executes random selection in processing (a1) in the predetermined random number ranges in the second game in processing (a4) using the symbol specific value data for the second game.

According to the gaming machine of the twelfth aspect of the present invention, since the random number range of the symbols relevant to the establishment of the winning prize is set to 0 in the second game, the symbols set to 0 are not rearranged even if the symbols are randomly selected. Thus, the entertainment characteristic can be maintained even if the second game is run based on the result of the rearrangement of the symbols.

According to the gaming machine in the seventh to twelfth aspects of the present invention, a gaming machine which is capable of not reducing the entertainment characteristic can be provided.

BRIEF DESCRIPTION OF THE DRAWINGS

FIG. 9 is a view illustrating a data table stored in the gaming machine according to the first embodiment of the present invention.

FIG. 10 is a view illustrating a data table stored in the gaming machine according to the first embodiment of the present invention.

FIG. 11 is a view illustrating a data table stored in the gaming machine according to the first embodiment of the present invention.

FIG. 29 is a view illustrating a data table stored in the gaming machine according to the second embodiment of the present invention.

FIG. 37 is a view illustrating a symbol table for the base game according to a fourth embodiment of the present invention.

FIG. 39 is a view illustrating a table of conditions under which the second game starts in the fourth embodiment of the present invention.

FIG. 40 is a view illustrating three continuous wild reels determination table in the fourth embodiment of the present invention.

FIG. 41 is a view illustrating a symbol table for a second game according to a fifth embodiment of the present invention.

DESCRIPTION OF THE PREFERRED EMBODIMENTS

Hereinafter, a gaming machine system according to embodiments of the present invention will be described with reference to the drawings. First, a feature of a game processing of the gaming machine according to the first embodiment of the present invention will be described with reference to the FIG. 1.

Figure 1:
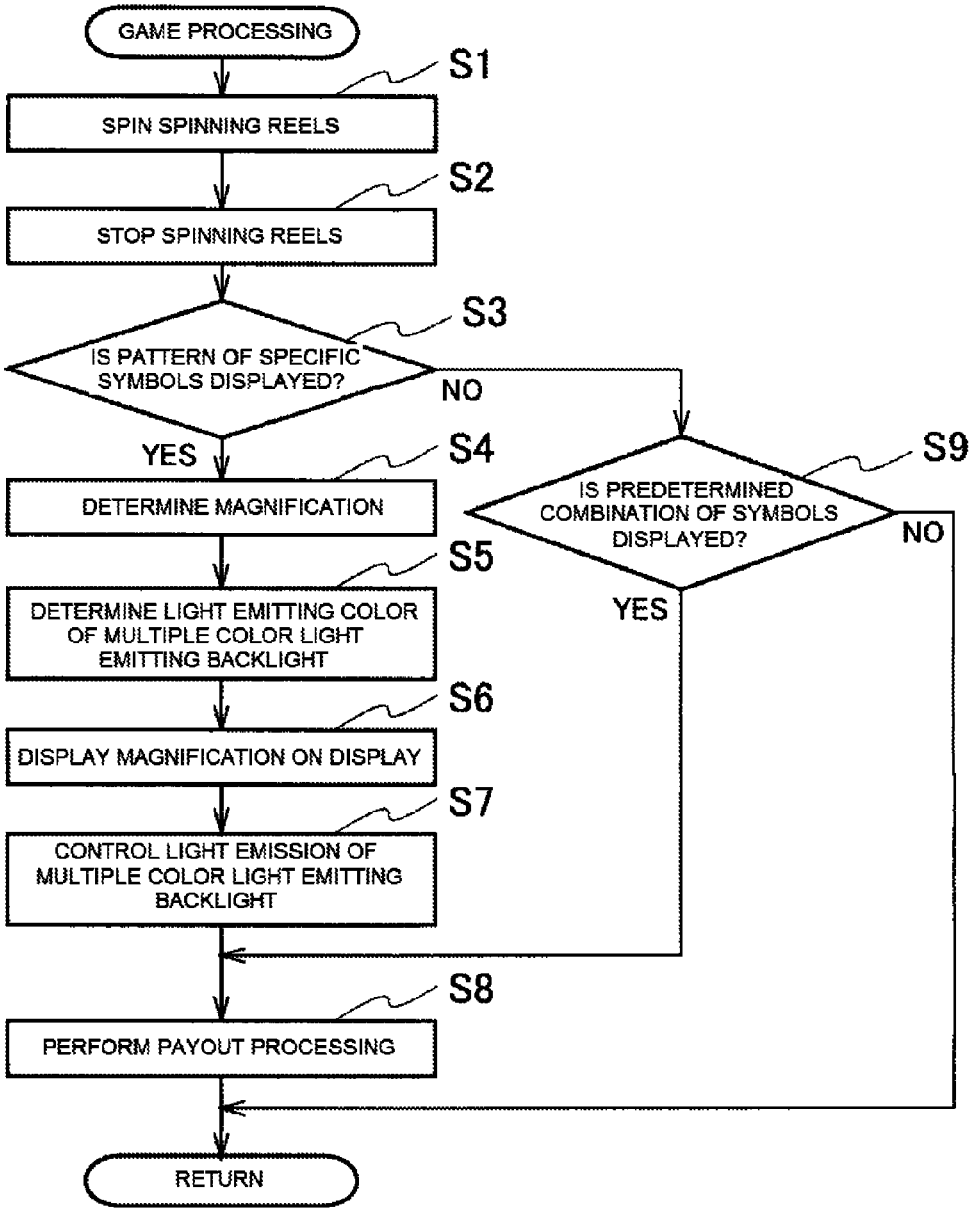
FIG. 1 is a view illustrating a flowchart of the game processing for the gaming machine according to the first embodiment of the present invention.
Figure 2:
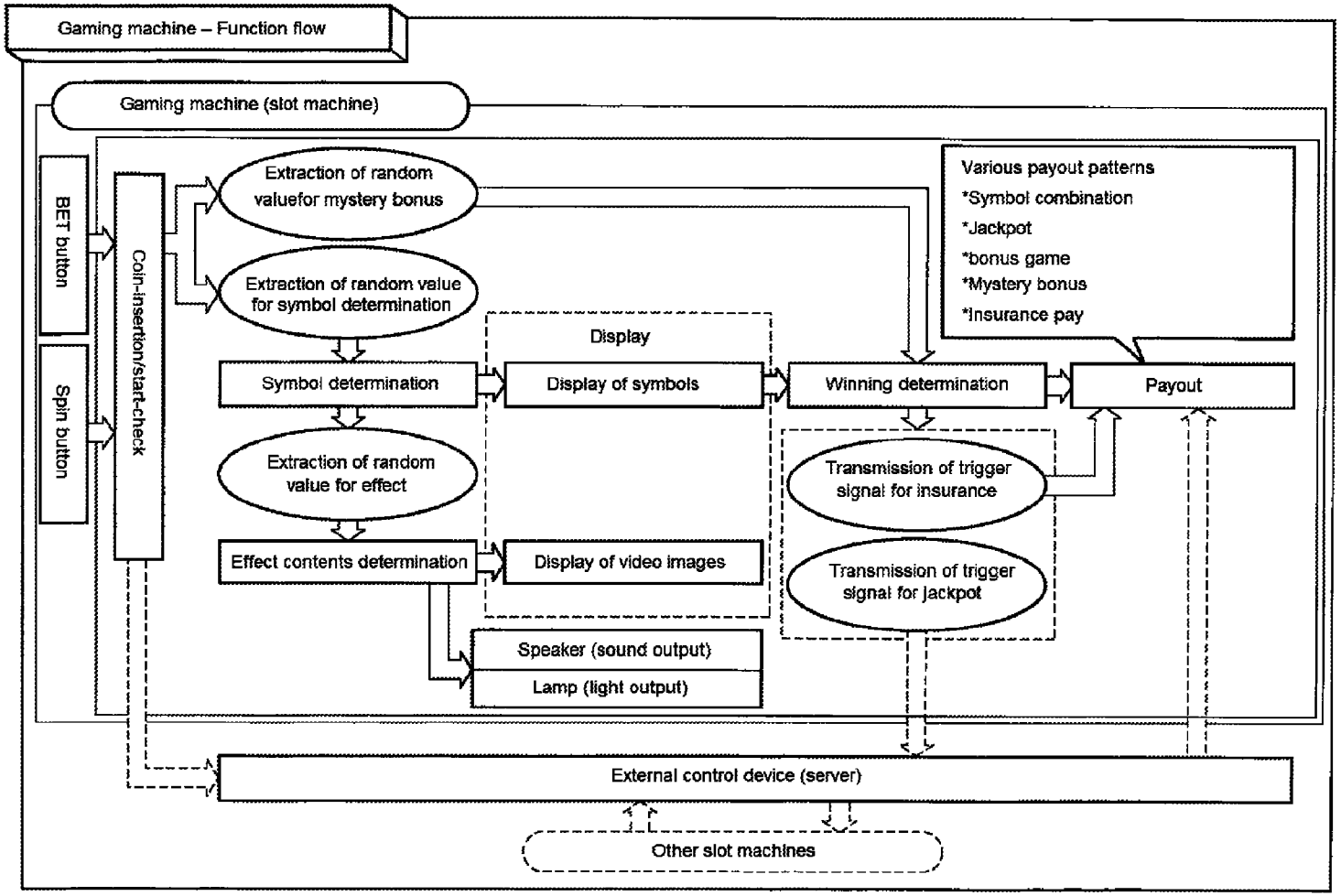
FIG. 2 is a view illustrating a function flow of the gaming machine according to the first embodiment of the present invention.
Figure 3:
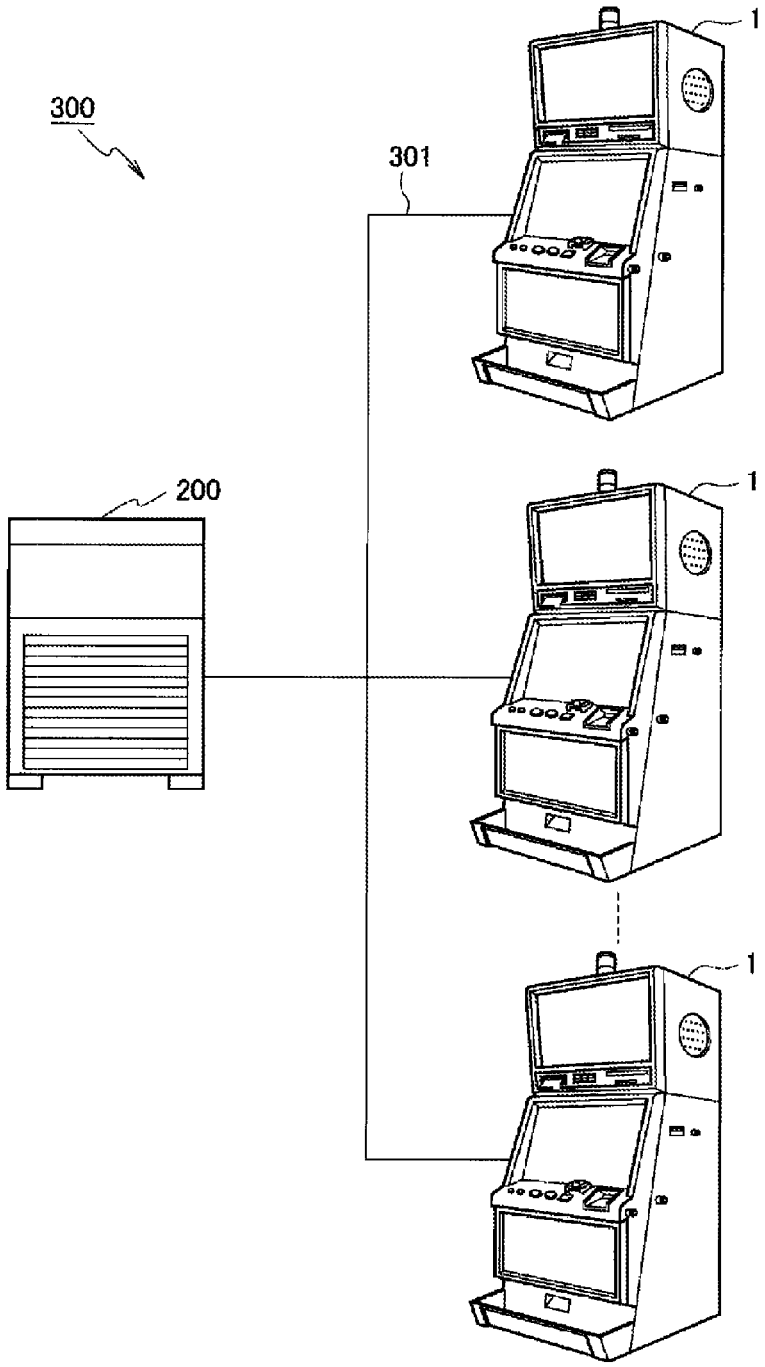
FIG. 3 is a view illustrating the game system including the gaming machine according to the first embodiment of the present invention.
Figure 4:
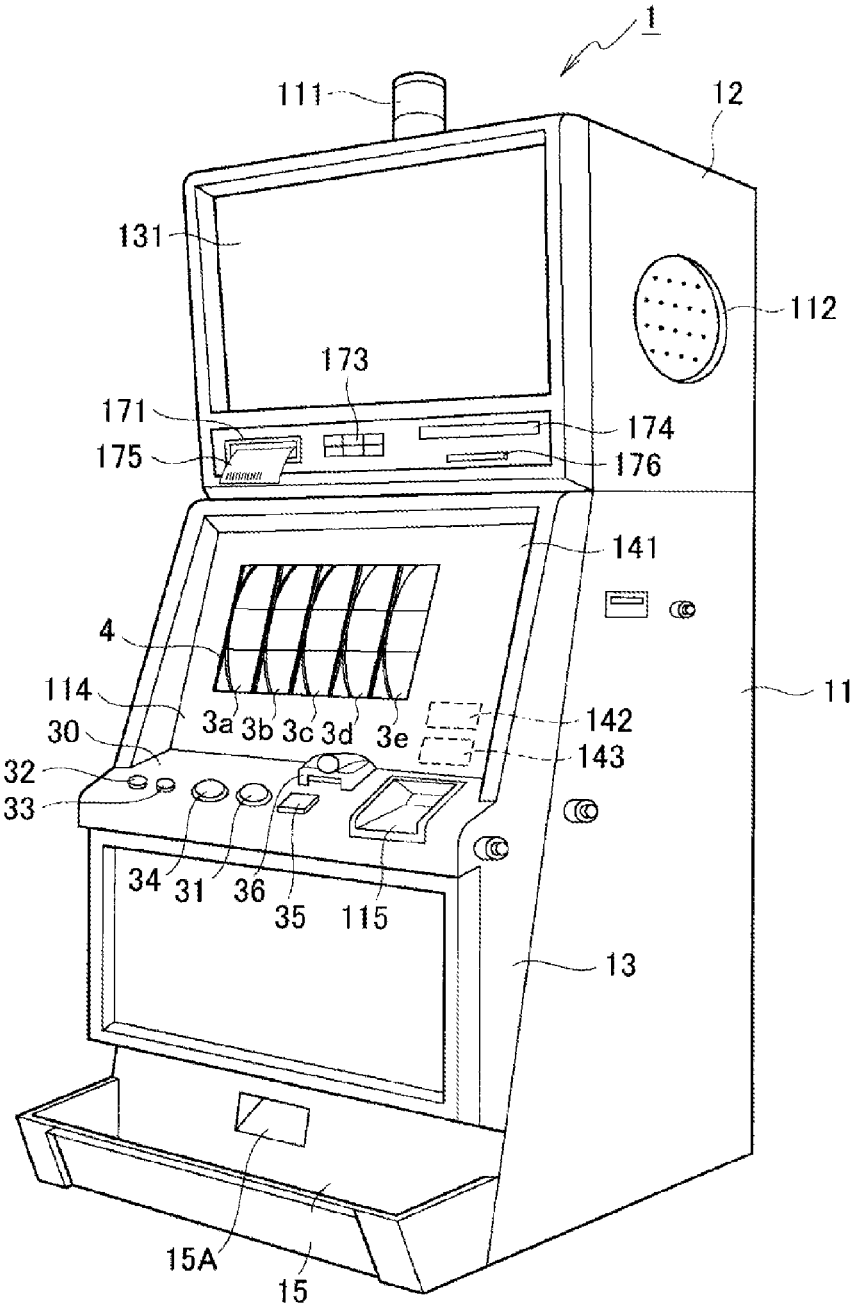
FIG. 4 is a view illustrating the overall configuration of the gaming machine according to the first embodiment of the present invention.
Figure 5:
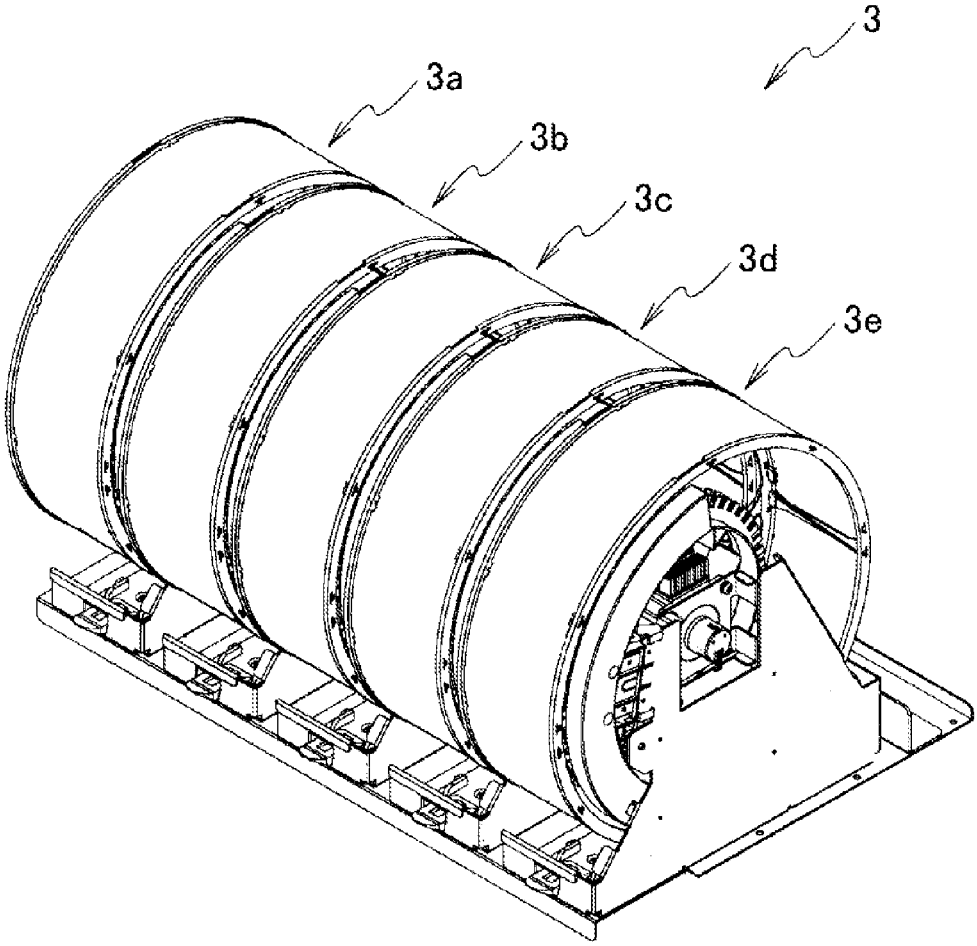
FIG. 5 is a view illustrating a rotational reel in the gaming machine according to the first embodiment of the present invention.
Figure 6:
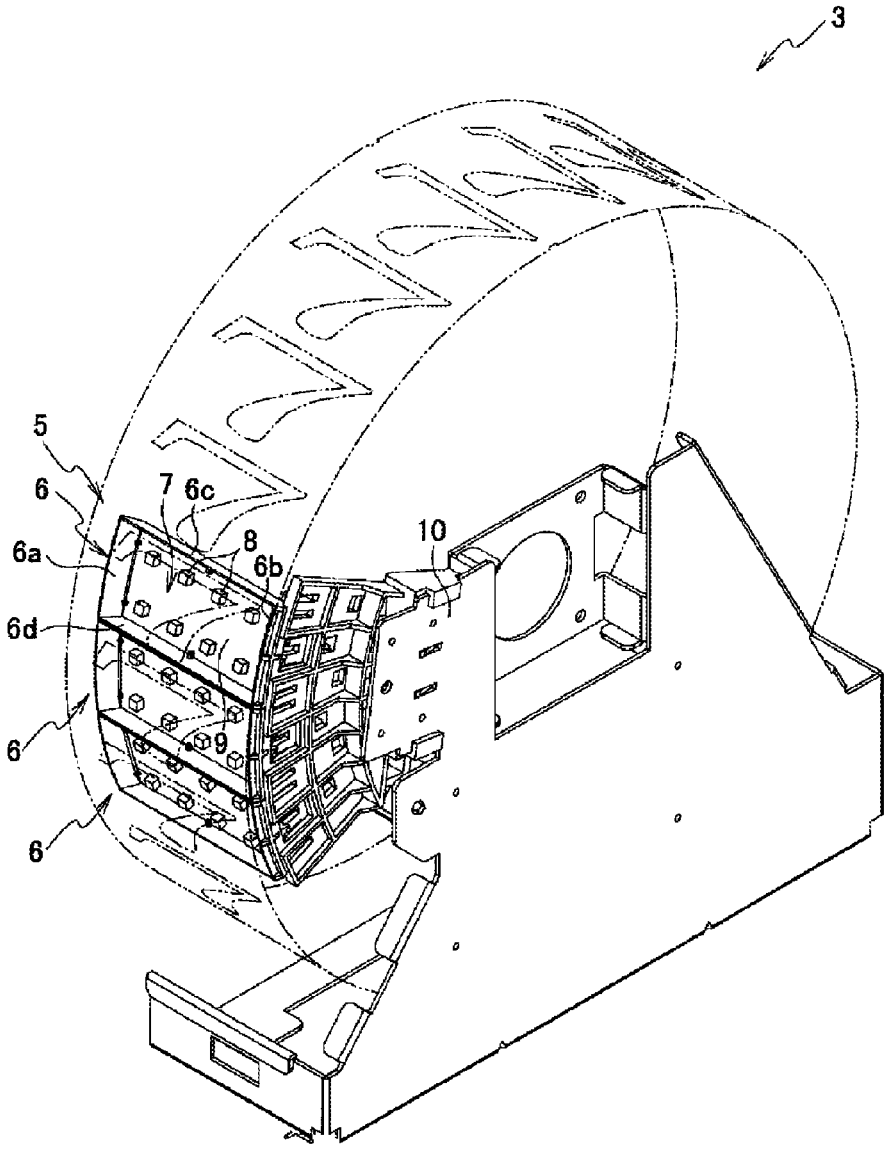
FIG. 6 is a view showing a multiple color backlight of the gaming machine according to the first embodiment of the present invention.
Figure 7:
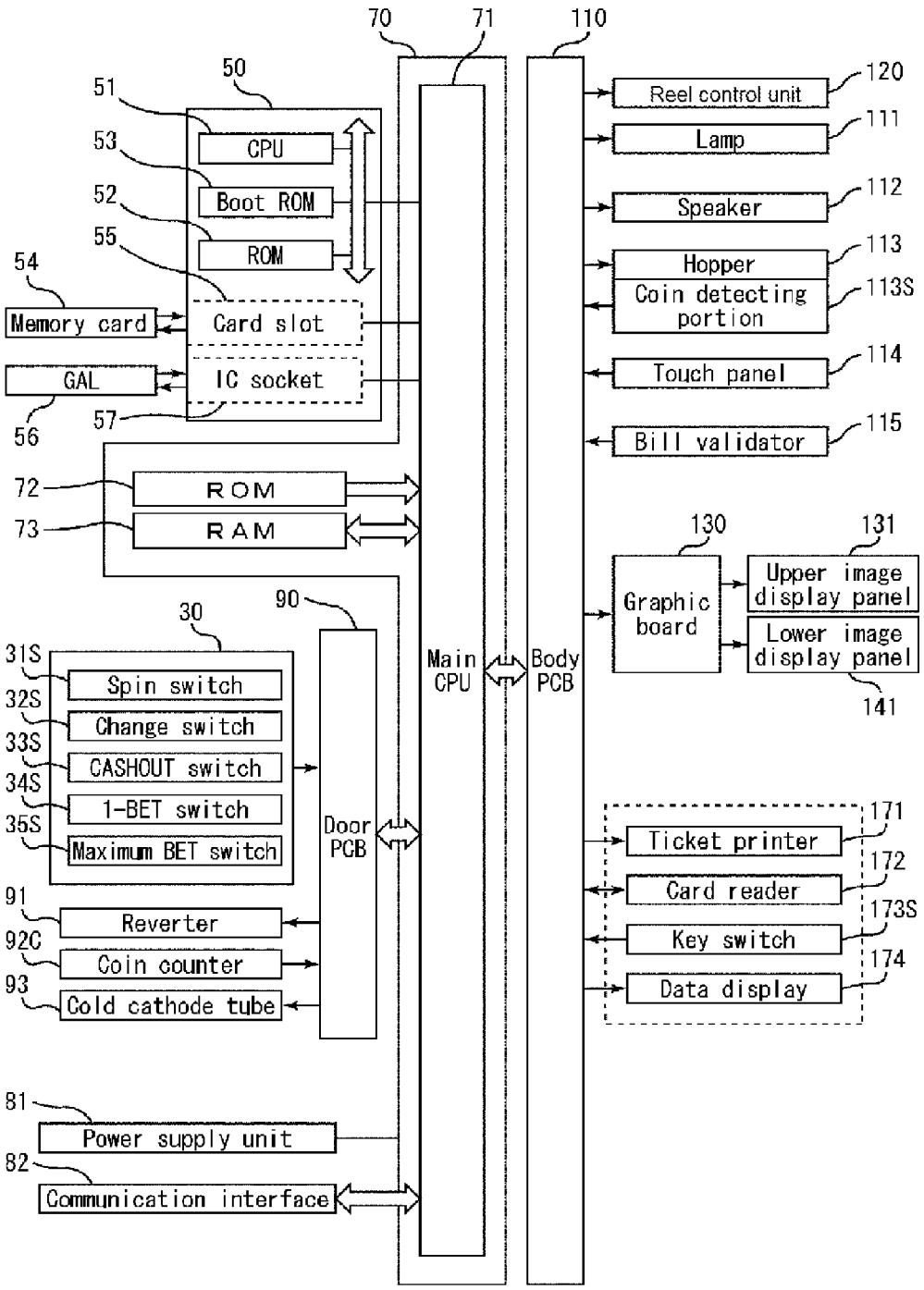
FIG. 7 is a block diagram illustrating an internal configuration of the gaming machine according to the first embodiment of the present invention.

FIG. 1 is a flowchart showing a feature of game processing according to the first embodiment. FIG. 2 is a view illustrating a function flow of the gaming machine according to the first embodiment of the present invention. FIG. 3 is a view illustrating the game system including the gaming machine according to the first embodiment of the present invention. FIG. 4 is a view illustrating the overall configuration of the gaming machine according to the first embodiment of the present invention. FIG. 5 is a view illustrating a function flow of the gaming machine according to the first embodiment of the present invention. FIG. 6 is a view showing a multiple color backlight of the gaming machine according to the first embodiment of the present invention. FIG. 7 is a block diagram illustrating an internal configuration of the gaming machine according to the first embodiment of the present invention.

The gaming machine according to the first embodiment of the present invention is directed to a slot machine, and performs functions to be described later with reference to FIG. 2. As shown in FIG. 3, a plurality of gaming machines 1 are connected to one external control device 200.

As shown in FIG. 4 and FIG. 5, there are provided: a plurality of spinning reels 3 (3*a* to 3*e*) having symbols arranged on peripheral faces thereof; a lower image display panel (symbol display window) 141 having a symbol display area 4 in which symbols are stop-displayed by stoppage of the spinning reels 3 (3*a* to 3*b*); and an upper image display panel (display) 131 which is disposed at an upper part of the lower image display panel 141, for displaying a video image.

In addition, as shown in FIG. 6 and FIG. 7, the gaming machine 1 according to the first embodiment of the present invention is provided with: a multiple color light emitting backlight 5 for individually illuminating the symbols that are displayed in the symbol display area 4 from the back side; and a main CPU (controller) 71 starting a second game in a case where a pattern of specific symbols serving as a trigger for causing a basic game to migrate to a second game is displayed in the symbol display area 4.

The multiple color backlight 5 serves to illuminate with plural kinds of colors from the back side of a respective one of the symbols which are displayed in the symbol display area 4.

In the gaming machine 1 according to the first embodiment of the present invention, in a second game, a predetermined effect image is displayed on the upper image display panel (display) 131, thereby executing a tree climbing competition by a panda animation character (refer to FIG. 13B and FIG. 13C to be described later).

As shown in FIG. 1, the main CPU 71 executes a basic game in which symbols are stop-displayed in the symbol display area 4 by stoppage of the spinning reels 3 (3*a* to 3*e*) after the symbols have been scroll-displayed in the symbol display area 4 by spinning the spinning reels 3 (3*a* to 3*e*) (step S1 and step S2).

Next, the main CPU 71 determines whether or not a pattern of specific symbols have been displayed in the symbol display area 4 in step S2 (step S3).

Figure 13A:
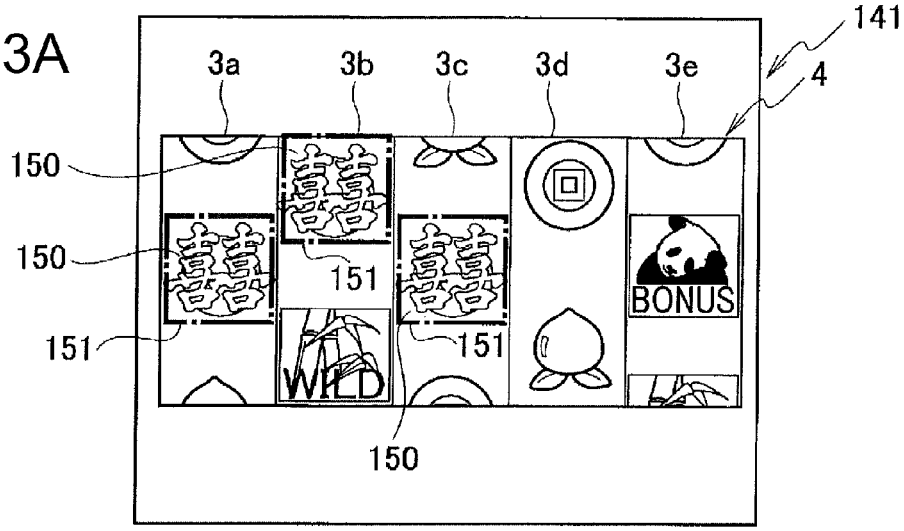
FIGS. 13A, 13B, and 13C are views illustrating a display of the gaming machine according to the first embodiment of the present invention.

Herein, the pattern of specific symbols denotes a pattern of symbols serving as a trigger for causing the symbols that are displayed in the symbol display area 4 to migrate from a basic game to a second game (e.g., a pattern in which three specific symbols 150 to be described later with reference to FIG. 13A are displayed in the symbol display area 4).

Next, in a case where the main CPU 71 determines that a pattern of specific symbols is displayed in the symbol display area 4, based on a result of the determination in step S3, the main CPU 71 causes the routine to migrate from a basic game to a second game and then determines a magnification for a respective one of plural kinds of colors which are produced in a color displayable manner by means of a multiple color light emitting backlight 5 (step S4).

Herein, the magnification for a respective one of plural kinds of colors which are produced in the color displayable manner by means of the multiple color light emitting backlight 5 denotes a magnification (for example, five times, three times, two times) which is specified for a respective one of plural kinds of colors (for example, red, blue, green) which are produced in the color displayable manner by means of the multiple color light emitting backlight 5.

Next, the main CPU 71 determines the light emitting color exerted by the multiple color light emitting backlight 5 at the back side of a respective one of the specific symbols that are displayed in the symbol display area 4, from among plural kinds of colors (for example, red, blue, green) which are allowed to be displayed in the color displayable manner by means of the multiple color light emitting backlight 5 (step S5).

When the second game is started (e.g., when a tree climbing competition by a panda animation character is started), the main CPU 71 then causes the upper image display panel 131 to display the magnification for a respective one of plural kinds of colors which are produced in the color displayable manner by means of the multiple color light emitting backlight 5, the magnification having been determined in step S4 (step S6).

The magnification for a respective one of plural kinds of colors which are produced in the color displayable manner by means of the multiple color light emitting backlight 5 is directed to a magnification image 153 (refer to FIG. 12B to be described later) which is displayed at five times in red, at three times in blue, or at two times in green, and is displayed on the upper image display panel 131.

Next, when the started second game completes (e.g., when the tree climbing competition by the panda animation character completes), the main CPU 71 then controls light emission of the light emitting color by means of the multiple color light emitting backlight 5 at the back side of a respective one of the specific symbols with the color that has been determined in step S5 (step S7). In this manner, the specific symbols are illuminated with the color that has been determined in step S5.

Next, the CPU 71 executes payout processing of performing a payout of a number that is obtained by multiplying the magnification that corresponds to the color determined in step S5 from among the magnifications for a respective one of the colors that are determined in step S4 for a payment that corresponds to a pattern of specific symbols (step S8).

On the other hand, in a case where the main CPU 71 determines that the pattern of specific symbols is not displayed in the symbol display area 4 in step S3, the main CPU 71 determines whether or not the symbols that are displayed in the symbol display area 4 form a predetermined combination, and based on a result of the determination, the main CPU 71 pays out a payment that corresponds to the formed combination of symbols (step S8 and step S9).

As described above, the light emitting color exerted by the multiple color light emitting backlight 5 at the back side of a respective one of the specific symbols is determined from among plural kinds of colors which are produced in the color displayable manner, and then, light emission of the multiple color light emitting backlight 5 is controlled with the determined color. Therefore, the illumination color of the specific symbols can be changed by making the light emitting colors of the multiple color light emitting backlight 5 different from each other. Accordingly, there can be provided a gaming machine which is capable of diversifying the display mode of symbols by means of spinning reels 3 (3*a* to 3*e*).

[Explanation of Function Flow Diagram]

The game processing according to the present the first embodiment has been described above. Next, basics function of the gaming machine 1 according to the first embodiments of the present invention will be described with reference to the FIG. 2.

FIG. 2 is a view illustrating a function flow of the gaming machine 1 according to the first embodiment of the present invention.

<Coin-insertion/Start-check>

First, the gaming machine 1 checks whether or not a BET button has been pressed by a player, and subsequently checks whether or not a spin button has been pressed by the player.

<Symbol Determination>

Next, when a player presses a spin button, the gaming machine 1 extracts the random number values for symbol determination and then stops spinning of the spinning reels 3 (3*a* to 3*e*) on which plural kinds of symbols are arranged, thereby determining the symbols to be stop-displayed in the symbol display area 4 of the lower image display panel 141.

<Symbol Display>

Next, the gaming machine 1 scroll-displays symbols in the symbol display area 4 by spinning of the spinning reels 3 (3*a* to 3*e*) on which plural kinds of symbols are arranged, and then, stop-displays the symbols in the symbol display area 4 by stoppage of the spinning reels 3 (3*a* to 3*e*).

The second game is then started, in a case where a pattern of specific symbols serving as a trigger for causing the routine to migrate from a basic game to a second game is stop-displayed in the symbol display area 4 (in a case where three specific symbols 150 to be described later with reference to FIG. 13A are displayed in the symbol display area 4).

<Winning Determination>

If symbols are stop-displayed in the symbol display area 4 by stoppage of the spinning reels 3*a* to 3*e* in the basic game, the gaming machine 1 then determines whether or not a combination of symbols that are displayed in the symbol display area 4 is associated with a winning prize.

Herein, the gaming machine 1 according to the first embodiment of the present invention determines that a combination of symbols of same kind is associated with a winning prize in a case where the number of symbols of same kind, which are displayed in the symbol display area 4, is a predetermined number or more (for example, three or more).

In addition, if a pattern of specific symbols is stop-displayed in the symbol display area 4 (for example, a pattern in which three specific symbols 150 to be described later with reference to FIG. 13A are displayed in the symbol display area 4), the routine is caused to migrate from a basic game to a second game (a bonus game) and then the light emitting color exerted by the multiple color light emitting backlight 5 at the back side of a respective one of the specific symbols is determined from among plural kinds of colors (for example, red, blue, green) which are produced in a color displayable manner by means of the multiple color light emitting backlight 5.

Further, in the second game, the tree climbing competition by the panda animation character (refer to FIG. 13B and FIG. 13C to be described later) is executed based on the game data according to a magnification that corresponds to the determined color (refer to FIG. 11 to be described later).

<Payout>

In a case where the number of symbols of same kind displayed in the symbol display area 4 is a predetermined number or more in the basic game, the gaming machine 1 then awards a privilege according to the number of symbols of same kind to a player.

For example, when a combination of symbols according to payout of coin is displayed in the basic game (when symbols of same kind are displayed in predetermined number or more in the symbol display area 4), the gaming machine 1 pays out coins or the like of which number is associated with the number of symbols of same kind to a player.

In addition, the gaming machine 1 according to the first embodiment of the present invention starts a second game (a bonus game) when a combination of symbols according to a trigger for causing the routine to migrate from a basic game to the second game is displayed (when three specific symbols 150 to be described later with reference to FIG. 13A are displayed in the symbol display area 4).

When the second game (the bonus game) then completes, coins or the like of which number is obtained by multiplying a magnification that corresponds to the color determined in the second game for a payment that corresponds to a pattern of specific symbols (e.g., a pattern in which three specific symbols 150 to be described later with reference to FIG. 13A are displayed in the symbol display area 4) are paid out to a player.

When a combination of symbols related to a jackpot trigger is displayed, the gaming machine 1 pays out coins in an amount of jackpot to the player.

The jackpot refers to a function which accumulates parts of coins used by players at the respective gaming machines 1 as the amount of jackpot and which, when the jackpot trigger has been established in any of the gaming machines 1, pays out coins of the accumulated amount of jackpot to that gaming machine 1.

In each game, the gaming machine 1 calculates the amount (amount for accumulation) to be accumulated to the amount of jackpot and transmits to an external control device. The external control device accumulates to the amount of jackpot the amounts for accumulation transmitted from the respective gaming machines 1.

Further, in addition to the aforementioned benefits, the gaming machine 1 is provided with benefits such as a mystery bonus and insurance.

The mystery bonus is a bonus in which a predetermined amount of coins are paid out for winning of a lottery that is intended for the mystery bonus. When the spin button has been pressed, the gaming machine 1 extracts a random value for mystery bonus and determines whether or not to establish a mystery bonus trigger by lottery.

The insurance is a function provided for a purpose of relieving the player from a situation in which a bonus game (the second game) has not been played for long periods of time. In the embodiment of the present invention, the player can arbitrarily select whether or not to make the insurance effective. Making insurance effective requires a predetermined insurance-purchase amount to be paid in exchange.

In the case where the insurance has been made effective, the gaming machine 1 starts counting the number of games. The gaming machine 1 conducts a payout of coins of the amount that is set for the insurance, when the number of counted games has reached a previously determined number of times without a large amount of payout relating to a bonus game (a second game) or the like being conducted.

<Determination of Effects>

The gaming machine 1 conducts effect processing by means of image display by the upper image display panel (display) 131 and the lower image display panel (symbol display window) 141, by means of output of light with the use of a lamp, or by means of output of a sound with the use of a speaker. The gaming machine 1 extracts a random value for effect and determines contents of the effects based on the symbols and the like determined by lottery.

Figure 13B:
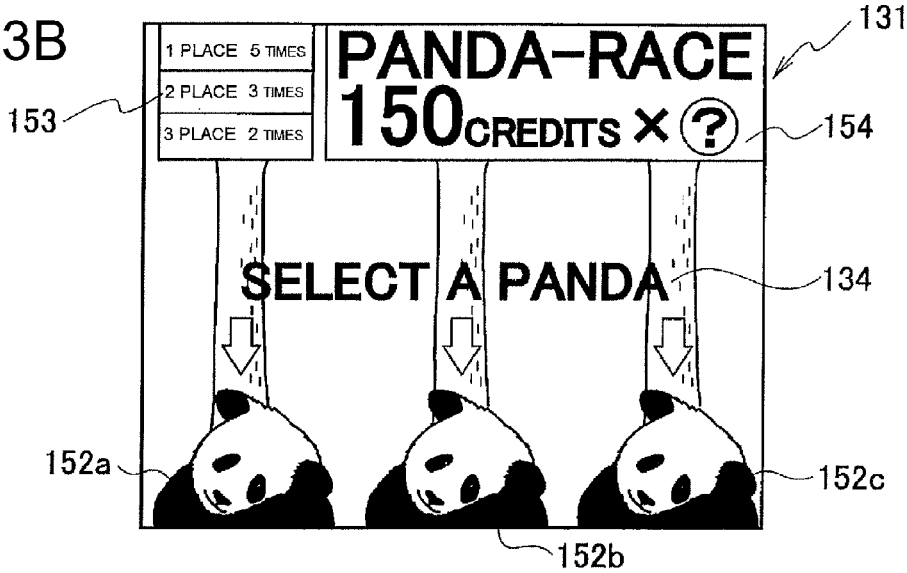

When the second game (the bonus game) is started, the gaming machine 1 according to the first embodiment of the present invention determines a magnification (for example, five times, three times, two times) for a respective one of plural kinds of colors (for example, red, blue, green) which are produced in the color displayable manner by means of the multiple color light emitting backlight 5 and then causes the upper image display panel (display) 131 to display the determined magnification (refer to FIG. 13B to be described later).

In addition, while the magnification for a respective one of the colors is displayed on the upper image display panel (display) 131, the light emitting color exerted by the multiple color light emitting backlight 5 at the back side of a respective one of the specific symbols that are displayed in the symbol display area 4 (the specific symbols 150 to be described later with reference to FIG. 13A) is determined from among plural kinds of colors (for example, red, blue, green) which are produced in a color displayable manner by means of the multiple color light emitting backlight 5.

Then, when the started second game (the bonus game) completes, light emission of the multiple color light emitting backlight 5 is controlled with the determined color that are produced in a color displayable manner by means of the multiple color light emitting backlight 5.

In addition, based on game data (refer to FIG. 11 to be described later) according to the magnification for a respective one of the colors which corresponds to the determined color, the tree climbing competition by the panda animation character is displayed on the upper image display panel (display) 131 (refer to FIG. 13B and FIG. 13C to be described later).

[Overall Game System]

The basic functions of the gaming machine 1 have been described above. Next, with reference to FIG. 3, a game system including the gaming machine 1 is described.

FIG. 3 is a view illustrating the game system including the gaming machine 1 according to the first embodiment of the present invention.

A game system 300 includes a plurality of gaming machines 1, and an external control device 200 that is connected to each of the gaming machines 1 through a communication line 301.

The external control device 200 is for controlling the plurality of gaming machines 1. In the first embodiment of the present invention, the external control device 200 is a so-called hall server which is installed in a game facility having the plurality of gaming machines 1.

Each of the gaming machines 1 is provided with a unique identification number, and the external control device 200 identifies transmission sources of data transmitted from the respective gaming machines 1 by using the identification numbers. Also in the case where the external control device 200 transmits data to a gaming machine 1, the identification numbers are used for specifying the transmission destination.

It is to be noted that the game system 300 may be constructed within a single game facility where various games can be conducted, such as a casino, or may be constructed among a plurality of game facilities. Further, when the game system 300 is constructed in a single game facility, the game system 300 may be constructed in each floor or section of the game facility.

The communication line 301 may be a wired or wireless line, and can adopt a dedicated line, an exchange line or the like.

[Overall Configuration of Gaming Machine]

The game system according to the present the first embodiment has been described above. Next, with reference to FIGS. 4 to 6, an overall configuration of the gaming machine 1 is described.

FIG. 4 is a view illustrating the overall configuration of the gaming machine 1 according to the first embodiment of the present invention. FIG. 5 is a view illustrating a function flow of the gaming machine 1 according to the first embodiment of the present invention. FIG. 6 is a view showing a multiple color light emitting backlight of the gaming machine 1 according to the first embodiment of the present invention.

A coin, a bill, or electrically valuable information corresponding thereto is used as a game medium in the gaming machine 1.

Further, in the first embodiment of the present invention, a barcode-attached ticket to be described later is also employed. It is to be noted that the game medium is not limitative thereto, and for example a medal, token, electric money or the like can be employed.

The gaming machine 1 includes a cabinet 11, a top box 12 installed on the upper side of the cabinet 11, and a main door 13 provided at the front face of the cabinet 11.

A lower image display panel 141 is provided at the center of the main door 13. The lower image display panel 141 has a symbol display area 4, and constitutes a symbol display window. At the back side of the symbol display area 4, five spinning reels 3 (3*a*, 3*b*, 3*c*, 3*d*, 3*e*) are rotatably provided as shown in FIG. 5.

Plural kinds of symbols are arranged on the peripheral faces of the respective spinning reels 3 (3*a* to 3*e*). In the symbol display area 4, symbols are scroll-displayed in a columnar direction by spinning of the spinning reels 3 (3*a* to 3*e*), and after a predetermined period of time has elapsed, the spinning symbols are stop-displayed by stopping the spinning reels 3 (3*a* to 3*e*).

In the first embodiment of the present invention, the gaming machine 1 displays, in the symbol display area 4, a part of the symbol arrays that have been arranged on the respective spinning reels 3 (3*a* to 3*e*) by stoppage of the spinning reels 3 (3*a* to 3*e*).

In the symbol display area 4, according to the respective spinning reels 3 (3*a* to 3*e*), the respective single symbols (including blanks) are displayed in three areas which are made of an upper stage, a middle stage, and a lower stage. Namely, 15 symbols (including blanks) which are obtained by five columns×three symbols are stop-displayed in the symbol display area 4.

At the inner circumferential sides of the respective spinning reels 3 (3*a* to 3*e*), a plurality of multiple color light emitting backlights 5 are provided as shown in FIG. 6. These multiple color light emitting backlights 5 illuminate the symbols that are displayed in the symbol display area 4 individually from the back side.

The multiple color light emitting backlight 5, as shown in FIG. 6, is comprised of: a respective one of a plurality of shading portions 6 which are provided for the respective spinning reels 3 (3*a* to 3*e*); a partition area 7 which is partitioned in order to individually emit light from the back side for a respective one of the symbols that are displayed in the symbol display area 4; and a board 9 having an LED 8 mounted thereon.

The shading portion 6 is comprised of: a left shading plate 6*a* and a right shading plate 6*b* which are adjacent to each other in a horizontal direction, for shading the light from another area; and a top shading plate 6*c* and a bottom shading plate 6*d* which are adjacent to each other in a vertical direction, for shading the light from another area. This shading portion 6 is formed in a rectangular shape.

The respective shading plates 6 (6*a* to 6*d*) are then arranged so that the multiple color light emitting backlights 5 can variably display colors individually for all of the symbols that are displayed in the symbol display area 4.

Namely, a respective one of the shading plates 6 (6*a* to 6*d*) is provided at a position (in a display area 151 to be described later with reference to FIG. 13A) which corresponds to one symbol (one symbol "7" in FIG. 6), and shades the light from another area.

The partition area 7 is constigtuted by dividing the area at the back side of the symbol display area 4 into a plurality of partitions, and is formed by means of the respective shading plates 6 (6*a* to 6*d*) in the partition that corresponds to one symbol (the partition surrounding the periphery of one symbol "7").

The shading plates 6 (6*a* to 6*d*) each shade light in a respective one of partition areas 7 in association with another partition area 7 in order to emit the light from the multiple color light emitting backlight 5 of the partition area 7 individually at the back side for a respective one of the symbols that are displayed in the symbol display area 4.

The board 9 having the LED 8 mounted thereon is engaged in the partition area 7. The LED 8 is comprised of red, blue, and green light emitting LEDs or the like, for example, and emits light with plural kinds of light emitting colors (for example, red, blue, green) indivisually from the back side for a respective one of the symbols.

Since the multiple color light backlight 5 is provided to be fixed to a stage 10 which supports rotary shafts of the spinning reels 3 (3*a* to 3*e*), even if the symbols that are stop-displayed in the symbol display area 4 are changed by spinning of the spinning reels 3 (3*a* to 3*e*), the respective symbols that are displayed in the symbol display area 4 can always be individually illuminated from the back side.

In this way, the multiple color light emitting backlight 5 is provided for a respective one of the spinning reels 3 (3*a* to 3*e*), and the shading portions 6 (6*a* to 6*e*) of the multiple color light emitting backlights 5 are arranged so that the multiple color light emitting backlights 5 can display the symbols that are displayed in the symbol display area 4 in a color variable manner.

Thus, all of the symbols that are displayed in the symbol display area 4 are individually displayed in a color variable manner, whereby the display mode of symbols can be diversified.

In addition, the LEDs 8 that are disposed in the respective partition areas 7 optically shaded by means of the shading portions 6 (6*a* to 6*e*) are configured to emit light, whereby the emitted light is disallowed from escaping into another partition area. Thus, a predetermined symbol are produced in a highlighted manner by indivisually changing the color for a respective one of the symbols.

Further, the specific symbols (specific symbols 150 to be described later with reference to FIG. 13A) are color-displayed in a highlighted manner in a color different from that of another symbol, whereby the state of a game currently executed or a magnification to be multiplied for a payment can be notified. Thus, the contents of the game played can be clarified.

As shown in FIG. 4, the lower image display panel 141 has a number-of-credits display region 142 and a number-of-payouts display region 143. The number-of-credits display region 142 displays the number of coins owned by a player and deposited inside the gaming machine 1 (hereinafter, referred to as the number of credits).

In addition, the number-of-payouts display region 143 displays the number of coins to be paid out to a player when a winning prize is established (hereinafter, referred to as the number of payouts).

The lower image display panel 141 has a built-in touch panel 114. The player can input various commands by touching the lower image display panel 141.

On the lower side of the lower image display panel 141, there are arranged various buttons set in a control panel 30, and various devices to be operated by the player.

A spin button 31 is employed to start scroll-display of symbols by spinning of the respective spinning reels 3 (3*a* to 3*e*). A change button 32 is used when requesting a game facility staff member to exchange money.

A CASHOUT button 33 is used when paying out the coins retained inside the gaming machine 1 to a coin tray 15.

A 1-BET button 34 and a maximum BET button 35 are used for determining the number of coins (hereinafter also referred to as "the number of BETs") to be used in the game from the coins retained inside the gaming machine 1.

The 1-BET button 34 is used when determining one coin at a time for the aforementioned number of BETs. The maximum BET button 35 is used when setting the aforementioned number of BETs to a defined upper limit number.

A coin accepting slot 36 is provided to accept coins. A bill validator 115 is provided to accept bills. The bill validator 115 validates a bill, and accepts a valid bill into the cabinet 11.

It is to be noted that the bill validator 115 may be configured so as to be capable of reading a later-described ticket 175 with a barcode.

An upper image display panel 131 is provided at the front face of the top box 12. The upper image display panel 131 includes a liquid crystal panel, and forms the display for displays a image.

The upper image display panel 131 displays images related to effects and images showing introduction of the game contents and explanation of the game rules. When a second game is started, the gaming machine 1 according to the first embodiment of the present invention determines a magnification (for example, five times, three times, two times) of a respective one of plural kinds of colors (for example, red, blue, green) which are produced in a color displayable manner by means of the multiple color light emitting backlight 5, and then, the gaming machine 1 displays the determined magnification (refer to FIG. 13B to be described later).

In addition, the light emitting color exerted by the multiple color light emitting backlight 5 at the back side of a respective one of the specific symbols that are displayed in the symbol display area 4 (the specific symbols 150 to be described later with reference to FIG. 13A) is determined from among plural kinds of colors (for example, red, blue, green) which are produced in a color displayable manner by means of the multiple color light emitting backlight 5; and based on game data (refer to FIG. 11 to be described later) according to a magnification that corresponds to the determined color, the tree climbing competition by the panda animation character is displayed on the upper image display panel (display) 131 (refer to FIG. 13B and FIG. 13C to be described later).

Further, the top box 12 is provided with a speaker 112 and a lamp 111. The gaming machine 1 produces effects by displaying images, outputting sounds, and outputting the light.

A ticket printer 171, a card slot 176, a data display 174, and a keypad 173 are provided downwardly of the upper image display panel 131.

The ticket printer 171 prints on a ticket a barcode representing encoded data of the number of credits, date, the identification number of the gaming machine 1, and the like, and outputs the ticket as the ticket 175 with a barcode.

The player can make a gaming machine 1 read the ticket 175 with a barcode so as to play a game thereon, and can also exchange the ticket 175 with a barcode with a bill or the like at a predetermined place (e.g. a cashier in a casino) in the game facility.

The card slot 176 is for inserting a card in which predetermined data is stored. For example, the card stores data for identifying the player, and data about the history of games played by the player.

When the card is inserted into the card slot 176, a card reader 172 to be described later reads data from the card or writes data into the card. It is to be noted that the card may store data corresponding to a coin, a bill or a credit.

The data display 174 includes a fluorescent display, LEDs and the like, and displays the data read by the card reader 172 or the data inputted by the player via the keypad 173, for example. The keypad 173 is for inputting a command and data related to issuance of tickets or the like.

[Configuration of Circuit Included in Gaming Machine]

The overall configuration of the gaming machine 1 has been described above. Next, with reference to FIGS. 7 and 8, a configuration of a circuit included in the gaming machine 1 is described.

Figure 8:
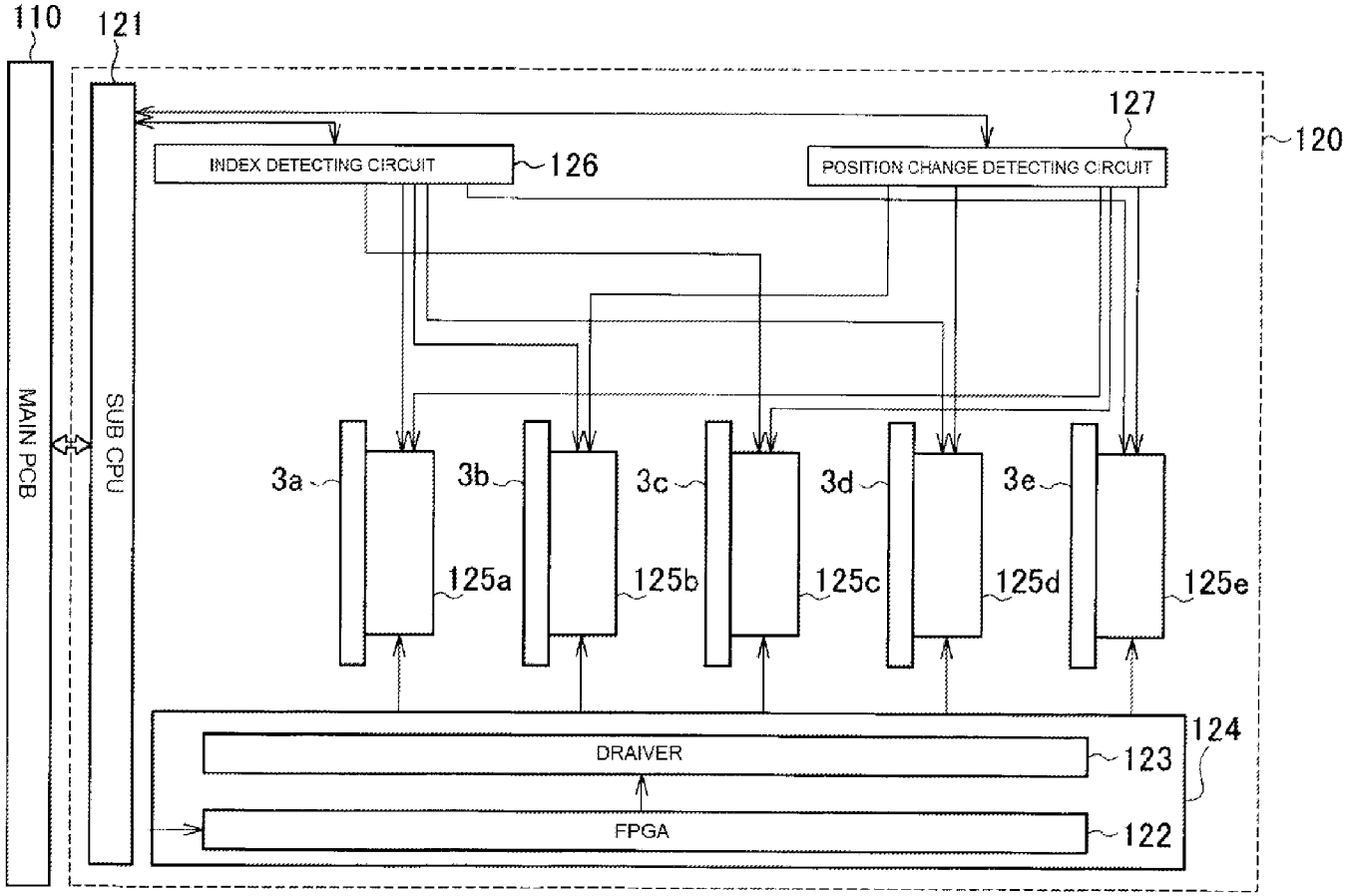
FIG. 8 is a block diagram illustrating an internal configuration of rotational reel in the gaming machine according to the first embodiment of the present invention.

FIG. 7 is a block diagram illustrating an internal configuration of the gaming machine 1 according to the embodiment of the present invention. FIG. 8 is a block diagram illustrating an internal configuration of the gaming machine 1 according to the first embodiment of the present invention.

A gaming board 50 is provided with: a CPU 51, a ROM 52, and a boot ROM 53 which are interconnected by means of an internal bus; a card slot 55 corresponding to a memory card 54; and an IC socket 57 corresponding to a GAL (Generic Array Logic) 56.

The memory card 54 includes a non-volatile memory, and stores game programs and a game system program. The game programs (base game program, second game program) include a program pertinent to the progress of a game; a lottery program; and a program for executing effect rendering with image(s) or sound(s).

A lottery program is a program for determining symbols (to-be-stopped symbols) to be stop-displayed in the symbol display area 4 of the lower image display panel 141 by stopping the spinning reels 3 (3*a* to 3*e*) on which plural kinds of symbols are arranged.

The to-be-stopped symbols are data for determining three to-be-stopped symbols to be stop-displayed in the symbol display area 4, among 22 symbols (including blanks) constituting the symbol arrays arranged on the peripheral faces of the respective spinning reels 3 (3*a* to 3*e*).

The gaming machine 1 according to the first embodiment of the present invention determines symbols to be stop-displayed in a predetermined area (for example, an upper-stage area), as to-be-stopped symbols, among three areas that correspond to the respective spinning reels 3 (3*a* to 3*e*) in the symbol display area 4.

The aforementioned lottery program includes symbol determination data. The symbol determination data is data that specifies random values so that each of the 22 symbols (code numbers from "00" to "21") forming the symbol array is determined at an equal probability (i.e. 1/22), for each rotation reel 3 (3*a* to 3*e*).

The probabilities of the respective 22 symbols being determined are basically equal. However, the numbers of the respective types of symbols included in the 22 symbols vary, and thus the probabilities of the respective types of symbols being determined vary (i.e. different weights on the probabilities are generated).

In the gaming machine 1 according to the first embodiment of the present invention, the abovementioned lottery programs include a program for determining the contents according to a second game (such as magnification for a respective one of plural kinds of colors which are produced in a color displayable manner by means of the multiple color light emitting backlight 5 or light emitting color exerted by the multiple color light emitting backlight 5 at the back side of a respective one of the specific symbols that are displayed in the symbol display area 4).

Further, the card slot 55 is configured so that the memory card 54 can be inserted thereinto and removed therefrom, and is connected to a motherboard 70 by an IDE bus.

The GAL 56 is one type of a PLD (Programmable Logic Device) having an OR-fixed type arrayed structure. The GAL 56 is provided with a plurality of input ports and output ports, and predetermined input into the input port causes output of the corresponding data from the output port.

Further, the IC socket 57 is configured so that the GAL 56 can be inserted thereinto and removed therefrom, and is connected to the motherboard 70 by means of a PCI bus. The contents of the game to be played on the gaming machine 1 can be changed by replacing the memory card 54 with another memory card having another program written therein or by rewriting the program written into the memory card 54 as another program.

The CPU 51, the ROM 52 and the boot ROM 53 mutually connected by the internal bus are connected to the motherboard 70 by a PCI bus. The PCI bus enables a signal transmission between the motherboard 70 and the gaming board 50, and power supply from the motherboard 70 to the gaming board 50.

The ROM 52 stores an authentication program. The boot ROM 53 stores a pre-authentication program, a program (boot code) to be used by the CPU 51 for activating the pre-authentication program, and the like.

The authentication program is a program (tamper check program) for authenticating the game program and the game system program. The pre-authentication program is a program for authenticating the aforementioned authentication program. The authentication program and the pre-authentication program are written along a procedure (authentication procedure) for proving that the program to be the subject has not been tampered.

The motherboard 70 is provided with a main CPU 71, a ROM 72, a RAM 73, and a communication interface 82.

The ROM 72 includes a memory device such as a flash memory, and stores a program such as BIOS to be executed by the main CPU 71, and permanent data. When the main CPU 71 executes a BIOS, a process of initializing predetermined peripherals is performed.

Further, a process of capturing the game programs and game system program stored in the memory card 54 is started via the gaming board 50.

The RAM 73 stores data and programs which are used in operation of the main CPU 71. For example, when the process of loading the aforementioned game program, game system program or authentication program is conducted, the RAM 73 can store these programs.

The RAM 73 is provided with working areas used for operations in execution of these programs. For example, there are provided: a region for storing the number of games played, the number of BETs, the number of payouts, the number of credits or the like; and a region or the like for storing symbols (code numbers) determined by means of lottery, the determined magnification for a respective one of plural kinds of colors which are produced in a color displayable manner by means of the multiple color light emitting backlight 5 in a second game, or the light emitting color exerted by the multiple color light emitting backlight 5 at the back side of a respective one of the specific symbols that are displayed in the symbol display area 4.

The communication interface 82 is for communicating with the external control device 200 such as a server, through the communication line 301. A door PCB 90 and a main body PCB (Printed Circuit Board) 110 to be described latter are connected to the motherboard 70 by means of a USB, respectively. Further, the motherboard 70 is connected to a power unit 81.

When the power is supplied from the power unit 81 to the motherboard 70, the main CPU 71 of the motherboard 70 is activated, and the power is then supplied to the gaming board 50 through the PCI bus so as to activate the CPU 51.

The door PCB 90 and the body PCB 110 are connected to input devices such as a switch and a sensor, and peripheral devices, the operations of which are controlled by means of the main CPU 71.

A control panel 30, a reverter 91, a coin counter 92C and a cold cathode-ray tube 93 are connected to the door PCB 90.

The control panel 30 is provided with a spin switch 31S, a change switch 32S, a CASHOUT switch 33S, a 1-BET switch 34S and a maximum BET switch 35S which correspond to the aforementioned respective buttons. Each of the switches outputs a signal to the main CPU 71 upon detection of press of the button corresponding thereto by the player.

The coin counter 92C validates a coin inserted into the coin accepting slot 36 based on its material, shape and the like, and outputs a signal to the main CPU 71 upon detection of a valid coin. Invalid coins are discharged from a coin payout exit 15A.

The reverter 91 operates based on a control signal outputted from the main CPU 71, and distributes valid coins validated by the coin counter 92C into a hopper 113 or a cash box (not shown).

That is, coins are distributed into the hopper 113 when the hopper 113 is not filled with coins, while coins are distributed into the cash box when the hopper 113 is filled with coins.

The cold cathode-ray tube 93 functions as a backlight installed on the rear face sides of the upper image display panel 131 and the lower image display panel 141, and lights up based on a control signal outputted from the main CPU 71.

The body PCB 110 is connected to the reel control unit 120, the lamp 111, the speaker 112, the hopper 113, a coin detecting portion 113S, the touch panel 114, the bill validator 115, a graphic board 130, the ticket printer 171, the card reader 172, a key switch 173S and the data display 174.

As shown in FIG. 5, a sub CPU 121 included in the reel controller 120 controls rotation and stop of the reels 3 (3*a* to 3*e*). To the sub CPU 121, a motor driving circuit 124, which is provided with an FPGA (Field Programmable Gate Array) 122 and a driver 123, is connected.

The FPGA 122 is an electronic circuit such as a programmable LSI, and functions as a control circuit of stepping motors 125 (125*a* to 125*e*).

The driver 123 functions as a circuit for amplifying pulses input to the stepping motors 125 (125*a* to 125*e*). A stepping motors 125 (125*a* to 125*e*) for executes spinning of the each reels 3 (3*a* to 3*d*) are connected to the motor driving circuit 124. The stepping motors 125 (125*a* to 125*e*) are stepping motors of one-two phase excitation mode.

An index detecting circuit 126 and a position change detecting circuit 127 are connected to the sub CPU 121. An index detecting circuit 126 is configured to detect the positions of reels 3 (3*a* to 3*d*) (later a index) being spun, and further, is capable of detecting spinoff of the reels 3 (3*a* to 3*d*).

The position change detection circuit 127 detects change of stop positions of the reels 3 (3*a* to 3*d*), after rotates of the reels 3 (3*a* to 3*d*) are stopped. For example, the position change detection circuit 127 detects change of positions where the reels 3 (3*a* to 3*d*) are stopped, in the case where a player forcibly changes the positions which actually do not result in a winning combination, to the positions corresponding to a winning combination.

The position change detecting circuit 127 is constituted so that the change of the stop position of the reels 3 (3*a* to 3*d*) can be detected by detecting a fin (not shown) mounted to the inside of the reels 3 (3*a* to 3*d*) at predetermined intervals.

The lamp 111 lights up based on a control signal outputted from the main CPU 71. The speaker 112 outputs sounds such as BGM, based on a control signal outputted from the main CPU 71.

The hopper 113 operates based on a control signal outputted from the main CPU 71, and pays out coins of the specified number of payouts from the coin payout exit 15A to the coin tray 15. The coin detecting portion 113S outputs a signal to the main CPU 71 upon detection of coin-outs by the hopper 113.

The touch panel 114 detects a place on the lower image display panel touched by the player's finger or the like, and outputs to the main CPU 71 a signal corresponding to the detected place.

Upon acceptance of a valid bill, the bill validator 115 outputs to the main CPU 71 a signal corresponding to the face amount of the bill.

The graphic board 130 controls display of images conducted by the respective upper image display panel 131 and lower image display panel 141, based on a control signal outputted from the main CPU 71.

In the symbol display area 4 of the lower image display panel 141, symbols are scroll-displayed by spinning of five spinning reels 3 (3*a* to 3*e*), and after a predetermined period of time has elapsed, the spinning symbols are stop-displayed by stoppage of the spinning reels 3 (3*a* to 3*e*).

The graphic board 130 is provided with a VDP generating image data, a video RAM temporarily storing the image data generated by the VDP, and the like. The number-of-credits display region 142 of the lower image display panel 141 displays the number of credits stored in the RAM 73. The number-of-payouts display region 143 of the lower image display panel 141 displays the number of payouts of coins.

The graphic board 130 is provided with the VDP (Video Display Processor) generating image data based on a control signal outputted from the main CPU 71, the video RAM temporarily storing the image data generated by the VDP, and the like. The VDP displays the image data that is read out from a storage area, on the upper image display panel 131 and the lower image display panel 141.

The image data that is employed when image data is generated by means of the VDP (for example, image data for executing the tree climbing competition by the panda animation character (refer to FIG. 13B and FIG. 13C to be described later)) is read out from the memory card 54, and then, the read out image data is included in a game program which is stored in the RAM 73.

Based on a control signal outputted from the main CPU 71, the ticket printer 171 prints on a ticket a barcode representing encoded data of the number of credits stored in the RAM 73, date, the identification number of the gaming machine 1, and the like, and then outputs the ticket as the ticket 175 with a barcode.

The card reader 172 reads data stored in a card inserted into the card slot 176 and transmits the data to the main CPU 71, or writes data into the card based on a control signal outputted from the main CPU 71.

The key switch 173S is provided in the keypad 173, and outputs a predetermined signal to the main CPU 71 when the keypad 173 has been operated by the player.

The data display 174 displays data read by the card reader 172 and data inputted by the player through the keypad 173, based on a control signal outputted from the main CPU 71.

[Configuration of Various Data Table]

The circuit configuration of the gaming machine 1 has been described above. Next, with reference to FIGS. 9 to 11, the various data tables (table data) are described. The various data tables are stored in the memory card 54, and when acquisition processing is started by means of the main CPU 71, the tables are stored in the RAM 73 (refer to FIG. 7).

First, with reference to FIG. 9, a light emitting data table will be described. The light emitting color data table specifies: a state of a game to be executed in the gaming machine 1 relative to specific symbols (specific symbols 150 to be described later with reference to FIG. 13A); a plurality of identification numbers; and light emitting colors of the multiple color light emitting backlights 5 that correspond to the identification numbers.

The light emitting color data table is employed to determine the light emitting colors by means of the multiple color light emitting backlights 5 in a case where the specific symbols (the specific symbols 150 to be described later with reference to FIG. 13A) are illuminated from the back side by means of the multiple color light emitting backlights 5.

Specifically, in the case of a "basic game", an identification number "0010" is specified. In addition, in the case of a "second game", identification numbers "0011", "0012", and "0013" are specified.

The light emitting colors exerted by the multiple color light emitting backlights 5 are specified for the identification numbers, respectively. Specifically, "white" is specified for the identification number "0010": "red" is specified for "0011"; "blue" is specified for "0012"; and "green" is specified for "0013".

For example, in the "basic game", since the identification number "0010" is selected, "white" is determined as the light emitting color. Therefore, in the basic game, the multiple light emitting backlight 5 emits light in "white", and then, illuminates symbols including a specific symbol from the back side.

In addition, in the case of the "second game", any one of the identification numbers "0011", "0012", and "0013" is selected. Namely, in the case of the "second game", any one of "red", "blue" and "green" is determined as the light emitting colors.

For example, in the "second game", in a case where the identification number "0012" has been selected, "blue" is determined as the light emitting color, and thus, the multiple color light emitting back light 5 emits light in "blue", and then, illuminates specific symbols from the back side.

Next, with reference to FIG. 10, a magnification data table will be described. The magnification data table specifies: a plurality of identification numbers; light emitting colors of the multiple color light emitting backlights 5 that correspond to the identification numbers; and magnifications to be determined in the second game.

The magnification data table is employed to determine the light emitting color of the multiple color light emitting backlight 5 at the back side of a respective one of the specific symbols that are displayed in the symbol display area 4 (the specific symbols 150 to be described later with reference to FIG. 13A) in the second game, thereby indirectly determining a magnification that corresponds to the determined light emitting color.

The light emitting colors exerted by the multiple light emitting backlight 5 are specified for the identification numbers, respectively. Specifically, "white" is specified for the identification number "0010"; "red" is specified for the identification number "0011"; "blue" is specified for the identification number"0012"; and "green" is specified for the identification number "0013".

In addition, for the identification numbers, the magnifications are specified for respective plural kinds of colors which are produced in a color displayable manner by means of the multiple light emitting backlight 5. Specifically, "five times" is specified for "red"; "three times" is specified for "blue"; and "two times" is specified for "green".

For example, in the second game, with respect to the light emitting color of the multiple color light emitting back light 5 at the back side of a specific symbol that is displayed in the symbol display area 4, in a case where "red" has been determined from among plural kinds of colors (red, blue, green) which are produced in the color displayable manner by means of the multiple color light emitting backlight 5, the magnification is determined as "five times" in correspondence with the determined color.

Then, when the second game completes, the number that is obtained by multiplying a magnification which is determined for a payment that corresponds to a pattern of specific symbols (e.g., a pattern in which three specific symbols 150 to be described later with reference to FIG. 13A are displayed in the symbol display area 4) is paid out.

In this way, in the magnification data table, a plurality of numeric values (magnifications) are associated with specific symbols in accordance with a combination of specific symbols and a plurality of colors of light emitted from the back side.

Therefore, if the light emitting color of the light emitted by means of the multiple color light emitting backlight 5 is determined in the second game, the magnification that is indicated by the light emitting color by means of the multiple light emitting backlight 5 can be determined in accordance with the magnification data table, based on the identification number of that light emitting color.

In this way, according to the specific symbols that are displayed in the symbol display area 4 and the light emitting color that is determined in order to illuminate the back side, a payment is given in association with the numeric value (magnification) that is obtained by referring to the magnification data table, so that the contents (magnification) of the payment to be given can be recognized by visually recognizing the color of a respective one of the symbols that are displayed in the symbol display area 4.

Next, with reference to FIG. 11, a game data table will be described. The game data table specifies: a plurality of movie data to be executed in a second game; and a game result relative to the movie data.

The movie data is a plurality of movie data including different results of the tree climbing competition of the panda animation character in the second game (refer to FIG. 13B and FIG. 13C to be described later), and is employed to determine an effect image of the tree climbing competition of the panda animation character according to the magnification that corresponds to the determined color in the second game.

Specifically, as the results of the tree climbing competition to be executed as a second game (refer to FIG. 13B and FIG. 13C to be described later), there are specified: movie data "A" and "B" indicating that a panda 152*a* (refer to FIG. 13C to be described later) is in a first place; movie data "C" and "E" indicating that a panda 152*b* (refer to FIG. 13C to be described later) is in a first place; and movie data "D" and "F" indicating that a panda 152*c* (refer to FIG. 13C to be described later) is in a first place.

For example, in a case where it is determined that the panda 152*a* is in the first place as the result of the tree climbing competition by the pandas according to the magnification that corresponds to the determined color in the second game, the movie data "A" or "B" is determined at random (by means of random number lottery), and then, the effect image of the tree climbing competition by the pandas, the image corresponding to the determined movie data, is displayed on the upper image display panel 131.

[Display Examples of the Upper Image Display Panel and the Lower Image Display Panel]

The description of the symbol combination table has now been completed. Next, with reference to FIGS. 12A, 12B, 13A, 13B, 13C, 14A, and 14B, a description will be given with respect to display examples of the upper image display panel 131 and the lower image display panel 141 in the gaming machine 1 according to the first embodiment of the present invention.

Figure 12A:
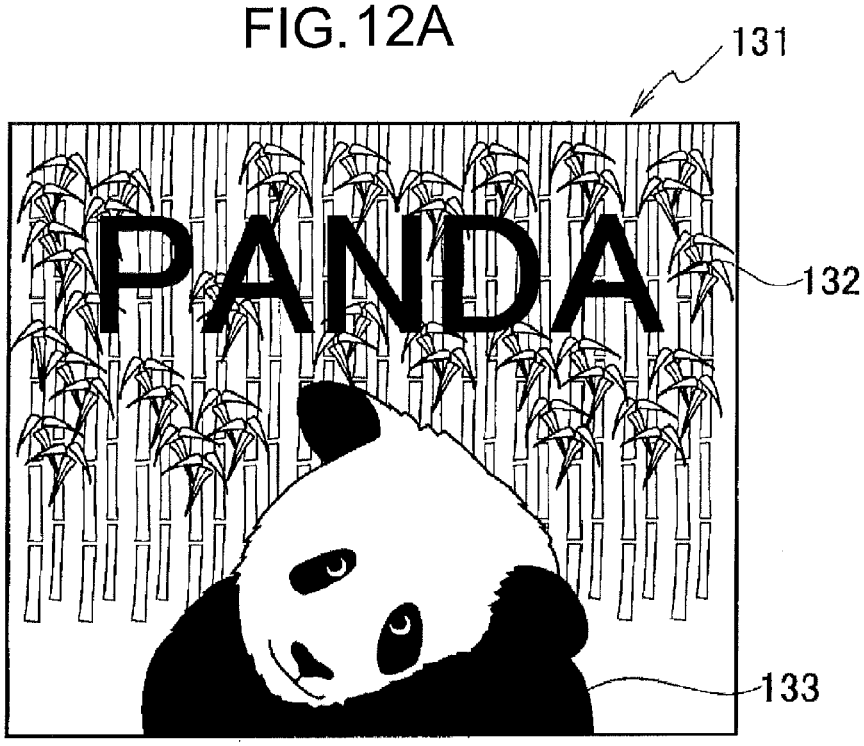
FIGS. 12A and 12B are views illustrating an exemplary display of the gaming machine according to the first embodiment of the present invention.
Figure 12B:
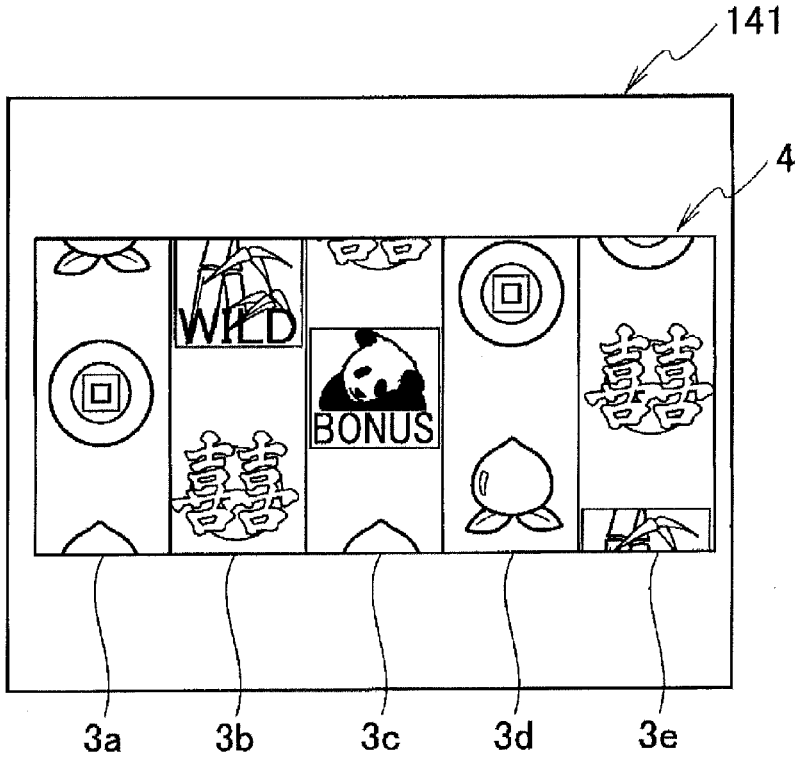

FIG. 12A shows a display example of a case in which an effect image is displayed on the upper image display panel 131 while a basic game is executed. FIG. 12B shows a display example of a case in which symbols are displayed in the symbol display area 4 of the lower image display panel 141 while a basic game is executed.

In addition, FIG. 13A shows a display example of a case in which symbols are displayed in the symbol display area 4 of the lower image display pane 141 while a basic game is executed. FIG. 13B shows a display example of a case in which an effect image is displayed on the upper image display panel 131 when a second game is started. FIG. 13C shows a display example of a case in which an effect image is displayed on the upper image display panel 131 while a second game is executed.

Figure 14A:
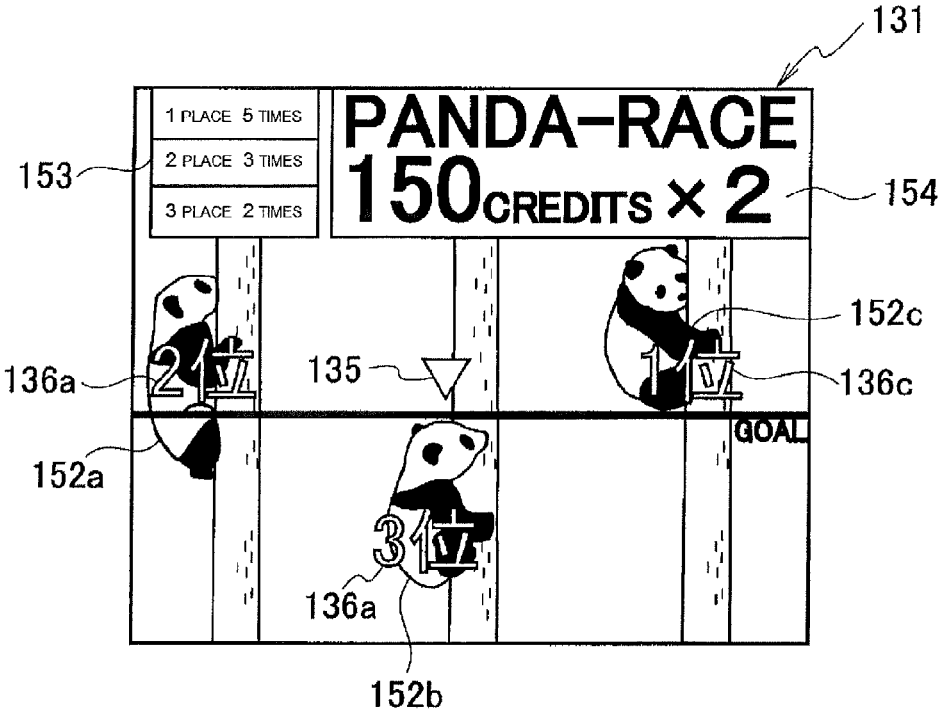
FIGS. 14A and 14B are views illustrating a exemplary display of the gaming machine according to the first embodiment of the present invention.
Figure 14B:
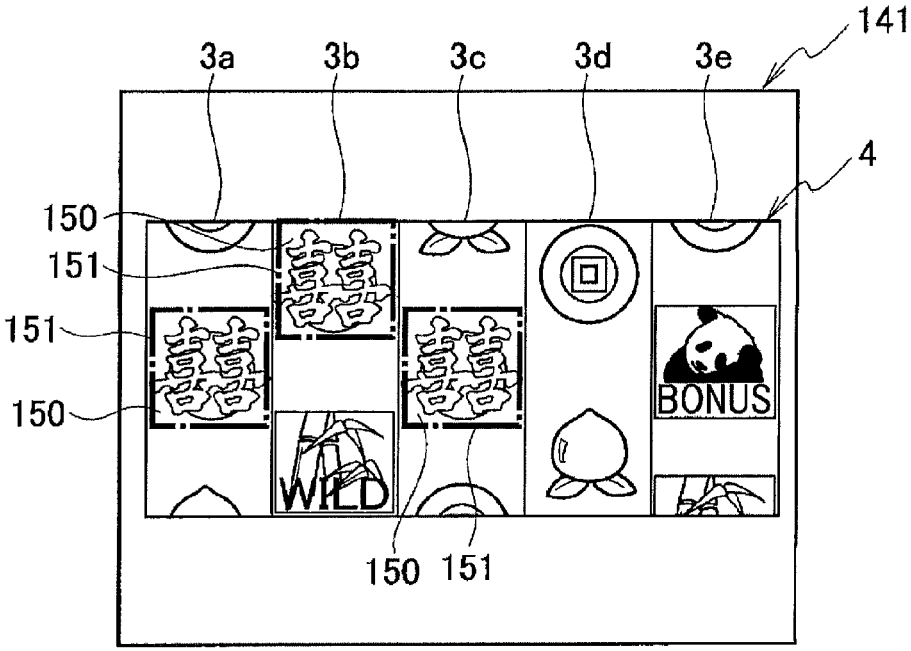

Further, FIG. 14A shows a display example of a case in which an effect image is displayed on the upper image display panel 131 when a second game completes. FIG. 14B shows a display example of a case in which symbols are displayed in the symbol display area 4 of the lower image display panel 141 when a second game completes.

The upper image display panel (display) 131 of the gaming machine 1 according to the first embodiment of the present invention displays a video image arranged at the upper part of the lower image display panel (symbol display window) 141.

On the upper image display panel 131, different effect images are displayed depending on while a basic game is executed or while a second game is executed. In addition, while the second game is executed, an effect image of a tree climbing competition by a panda is displayed on the upper image display panel 131 (refer to FIG. 13B and FIG. 13C to be described later).

As shown in FIG. 12A, while in a basic game, an effect image indicating that the basic game is being executed, is displayed on the upper image display panel 131. Herein, the figure shows a display example of an effect image to be displayed on the upper image display panel 131 when the basic game is started. As shown in FIG. 12A, the upper image display panel 131 displays a "PANDA" character image 132 and a panda movie image 133 which indicate that the basic game is started.

As shown in FIG. 12B, when the basic game is started, symbols are scroll-displayed in the symbol display area 4 of the lower image display panel 141 by spinning the spinning reels 3 (3*a* to 3*e*), and after a predetermined period of time has elapsed, the spinning symbols are stop-displayed in the symbol display area 4 by stopping the spinning reels 3 (3*a* to 3*e*).

While in the basic game, "white" is selected as the light emitting color of the multiple color light emitting backlight 5 (refer to FIG. 9); and the multiple color light emitting backlight 5 emits light in "white", and then, illuminates a respective one of the symbols that are displayed in the symbol display area 4 individually from the back side.

In a case where the symbols that are displayed in the symbol display area 4 form a predetermined combination (in a case where three or more symbols of same kind are displayed), a payment that corresponds to the symbol combination is then paid out.

In the display example of FIG. 12B, since the symbols that are displayed in the symbol display area 4 fail to form a predetermined combination (three or more symbols of same kind are not displayed), the result is determined to be losing.

As shown in FIG. 13A, while in a basic game, if three specific symbols 150 are displayed in the symbol display area 4 of the lower image display panel 141 (if a pattern of the specific symbols 150 is displayed), the routine is caused to migrate from the basic game to a second game. Herein, the figure shows a display example of a case in which the specific symbols 150 that are arranged on the peripheral faces of the spinning reels 3 (3*a* to 3*e*) are stop-displayed in the symbol display area 4.

In the case where three specific symbols 150 are displayed in the symbol display area 4, a display area 151 surrounding the specific symbols 150 may be displayed at a relatively high luminous intensity by controlling the multiple color light emitting backlight 5. In this case, it becomes possible to easily recognize that the symbols (the pattern of specific symbols 150) serving as a trigger for causing the routine to migrate from the basic game to the second game have been displayed.

As shown in FIG. 13B, when the second game is started, the upper image display panel 131 displays panda animation character images 152 (152*a* to 152*c*). Herein, the figure shows a display example of an effect image to be displayed on the upper image display panel 131 when a player selects any panda animation character.

As shown in FIG. 13B, the upper image display panel 131 displays a magnification for a respective one of plural kinds of colors which are produced in a color displayable manner by means of the multiple color light emitting backlight 5, the magnification having been determined in the second game. As the magnifications by color, colors, results (ranks) of the tree climbing competition, and magnifications are specified, the upper image display panel 131 displays a magnification image 153 indicating that a first place is five times in red, a second place is three times in blue, and a third place is two times in green.

In addition, the upper image display panel 131 displays a selection image 134 of "SELECT A PANDA" which prompts a player to select any panda animation character from among a plurality of panda animation character images 152 (152*a* to 152*c*).

Selection of the panda animation character images 152 (152*a* to 152*c*) are made based on an operation relative to an input device (such as a touch panel, for example).

For example, this selection may be configured to be possible by touching a touch panel (not shown) or a selection button (not shown) which is provided on the upper image display panel 131. In addition, this selection may be configured to possible by displaying panda animation characters on the lower image display panel 141 and then touching a touch panel 114 (refer to FIG. 7) or a selection button (not shown).

Further, the upper image display panel 131 displays a number-of-payouts image 154 for displaying a magnification to be multiplied for a payment (150 CREDITS) that corresponds to a pattern of specific symbols 150 when the tree climbing competition by the panda animation character images 152 (152*a* to 152*c*) has completed.

Figure 13C:
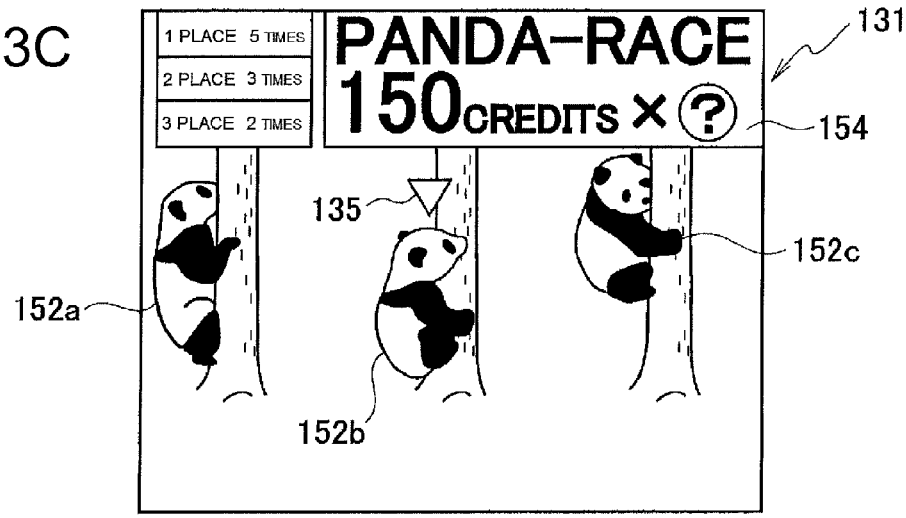

As shown in FIG. 13C, when a player selects any panda animation character, the upper image display panel 131 displays an effect image indicating that the panda animation character images 152 (152*a* to 152*c*) are in tree climbing competition. Herein, the figure shows a display example of an effect image to be displayed on the upper image display panel 131 when the player selects the panda animation character image 152*b*.

As shown in FIG. 13C, when the tree climbing competition is started, an effect image is displayed indicating that the panda animation character images 152 (152*a* to 152*c*) are climbing a tree. In addition, an arrow image 135 is displayed so that the panda animation character image 152*b* selected by the player can be recognized.

As shown in FIG. 14A, when the three climbing competition by the panda animation character images 152 (152*a* to 152*c*) completes, the upper image display panel 131 displays the result of the tree climbing competition (displays the ranking for a respective one of the panda animation characters 152) and then displays the magnification to be multiplied for the payment (150 CREDITS) that corresponds to the pattern of specific symbols 150. Herein, the figure shows a display example of a case in which the panda animation character image 152*b* selected by the player is in a third place.

As shown in FIG. 14B, when the tree climbing competition completes, ranking images 136 (136*a* to 136*c*) are displayed indicating the result (ranking) of the tree climbing competition. Herein, a description will be given with respect to a case in which: the panda animation character image 152*a* is in the second place; the panda animation character image 152*b* is in the third place; and the panda animation character image 152*c* is in the first place.

As shown in FIG. 14B, the upper image display panel 131 displays the ranking images 136 (136*a* to 136*c*) indicating that: the panda animation character image 152*a* is in the second place; the panda animation character image 152*b* is in the third place; and the panda animation character image 152*c* is in the first place.

The ranking images 136 (136*a* to 136*c*) are displayed in the colors that correspond to the magnification images 153. Herein, since the panda animation character image 152*a* is in the second place; the panda animation character image 152*b* is in the third place; and the panda animation character image 152*c* is in the first place, the upper image display panel 131 displays the ranking image 136*a* of the second place in blue, the ranking image 136*b* of the third place in green, and the ranking image 136*c* of the first place with red.

In addition, since the panda animation character image 152*b* selected by the player is in the third place, the upper image display panel 131 displays a number-of-payouts image 154 indicating 150 CREDITS×2 which is a magnification to be multiplied for the payment (150 CREDITS) that corresponds to the pattern of specific symbols 150 (two times which is the magnification that corresponds to the third place).

In the tree climbing competition by the panda animation character images 152 (152*a* to 152*c*), the upper image display panel 131 displays the number-of-payouts image 154 indicating that in a case where the panda animation character selected by the player is in the first place, the magnification to be multiplied is five times; in a case where the selected animation character is in the second place, the magnification is three times; and in a case where the animation character is in the third place, the magnification is two times, and then, executes a payout of the number multiplied for the payment (150 CREDITS) that corresponds to the pattern of specific symbols 150.

As shown in FIG. 14B, when the tree climbing competition completes, the light emitting color exerted by the multiple color light emitting backlight 5 at the back side of a respective one of the specific symbols 150 that are stop-displayed in the symbol display area 4 of the lower image display panel 141 is emitted with light of which color are produced in a color displayable manner by means of the multiple color light emitting backlight 5.

Herein, the figure shows a display example of a case in which the light emitting color of the multiple color light emitting backlight 5 is determined to be "green", since the magnification image 153 is displayed indicating that: the panda animation character image 152*b* selected by the player is in the third place; and when a second game is started, the third place is two times in green (refer to FIG. 13B).

As shown in FIG. 14B, when the tree climbing competition completes, since the multiple color light emitting backlight 5 emits light in "green" and then illuminates the specific symbols 150 that are displayed in the symbol display area 4 from the back side, the display area 151 surrounding the specific symbols 150 is displayed in green.

In this way, the light emitting colors of the multiple color light emitting backlights 5 are configured to be different from each other in accordance with the result (ranking) of the tree climbing competition by the panda animation character selected by the player. Namely, when the second game is started, in a case where the upper image display panel 131 displays the magnification image 153 indicating that the first place is five times in red, the second place is three times in blue, and the third place is two times in green (refer to FIG. 13B), in a case where the result (ranking) of the tree climbing competition by the panda animation character that is selected by the player is in the first place, the second place, or the third place, light emission of the multiple color light emitting backlight 5 is controlled in red, blue, or green.

In addition, among the magnifications for a respective one of the colors that are determined when the second game is started (the magnification image 153 indicating that red and the first place is five times, blue and the second place is three times, and green and the third place is two times), the light emitting color by means of the multiple color light emitting backlight 5 is determined and then the specific symbols 150 each are illuminated from the back side with the determined light emitting color.

Thus, the magnification to be multiplied for a payment that corresponds to the pattern of the specific symbols 150 can be recognized by visually recognizing the display color of the display area 151 surrounding the specific symbols 150, and then, the contents of a game played can be easily grasped.

[Contents of Program]

The descriptions of the display examples of the upper image display panel 131 and the lower image display panel 141 have now been completed. Next, with reference to FIGS. 15 to 24, the program to be executed by the gaming machine 1 is described.

<Main Control Processing>

Figure 15:
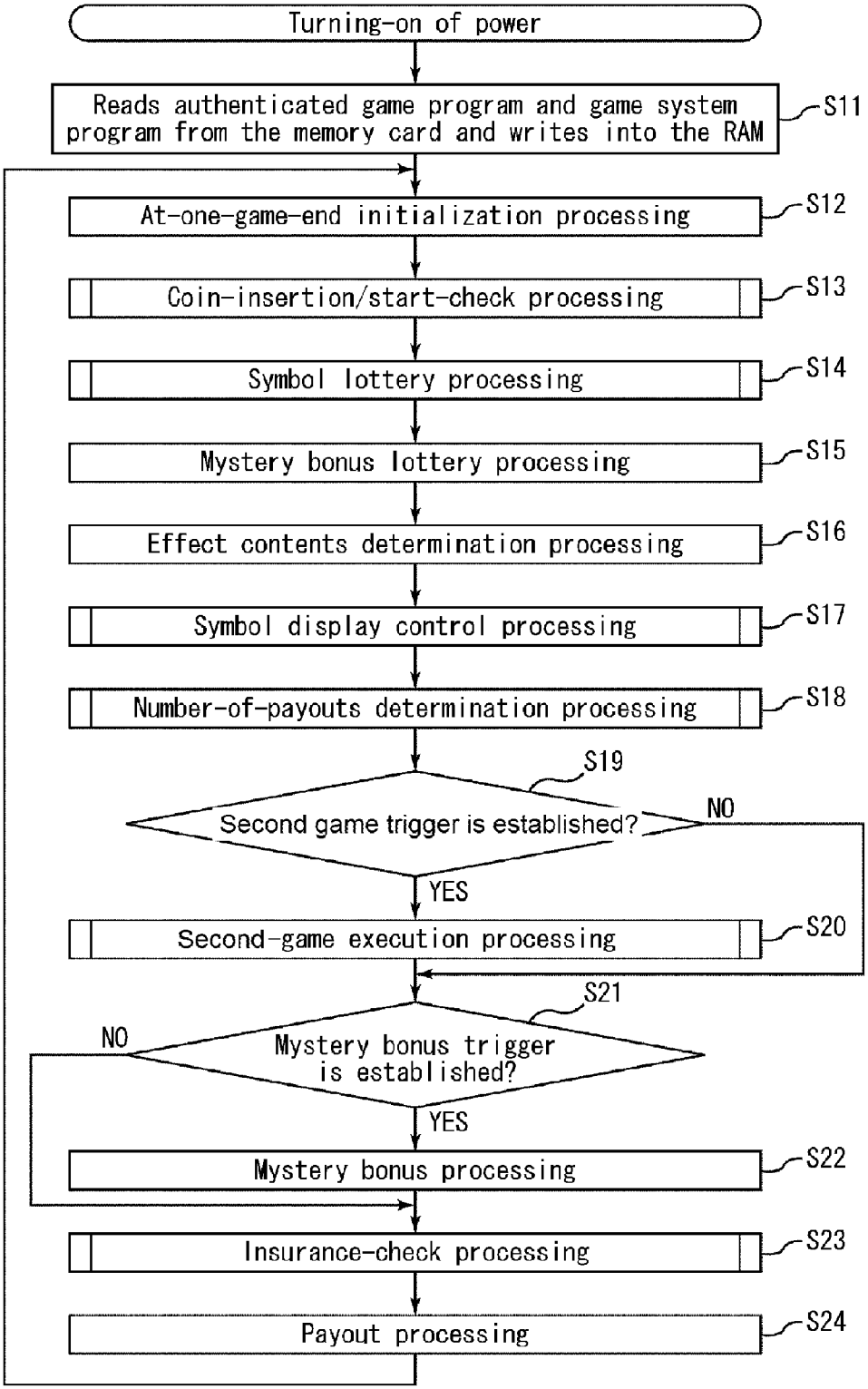
FIG. 15 is a view illustrating a flowchart of the main control processing for the gaming machine according to the first embodiment of the present invention.

First, with reference to FIG. 15, main control processing is described.

FIG. 15 is a view illustrating a flowchart of the main control processing for the gaming machine 1 according to the first embodiment of the present invention.

First, when the power is supplied to the gaming machine 1, the main CPU 71 reads the authenticated game program and game system program from the memory card 54 through the gaming board 50, and writes the programs into the RAM 73 (step S11).

The main CPU 71 performs an initialization process when one game terminates (step S12). For example, data that becomes unnecessary after each game in the working areas of the RAM 73, such as the number of BETs and the symbols determined by lottery, is cleared.

The main CPU 71 conducts coin-insertion/start-check processing which is described later with reference to FIG. 16 (step S13). In the process, input from the BET switch or the spin switch is checked.

The main CPU 71 then conducts symbol lottery processing which is described later with reference to FIG. 19 (step S14). In the processing, to-be stopped symbols are determined based on the random values for symbol determination.

Next, the main CPU 71 conducts mystery bonus lottery processing (step S15). In the processing, lottery determining whether or not to establish a mystery bonus trigger is held. For example, the main CPU 71 extracts a random value for mystery bonus from the numbers in a range of "0 to 99", and establishes the mystery bonus trigger when the extracted random value is "0".

The main CPU 71 conducts effect contents determination processing (step S16). The main CPU 71 extracts a random value for effect, and determines any of the effect contents from the preset plurality of effect contents by lottery. For example, based on the contents of effect determined by means of lottery, the upper image display panel 131 displays the "PANDA" character image 132 and the panda movie image 133, when a basic game is started (refer to FIG. 12A).

The main CPU 71 then conducts symbol display control processing which is described later with reference to FIG. 20 (step S17). In this process, by spinning the spinning reels 3 (3*a* to 3*e*), symbols are scroll-displayed in the symbol display area 4, and after a predetermined period of time has elapsed, by stopping the spinning reels 3 (3*a* to 3*e*), the to-be-stopped symbols determined in the symbol lottery processing of step S14 are stopped at the predetermined positions (for example, in the upper stage area in the symbol display area 4) (refer to FIG. 12B).

That is, three symbols including the to-be stopped symbol are displayed in the symbol display region 4. For example, when the to-be stopped symbol is the symbol associated with the code number of "10" and it is to be displayed to the upper region, the symbols associated with the respective code numbers of "11" and "12" are to be displayed to the respective upper central region, central region and lower region in the symbol display region 4.

Next, the main CPU 71 conducts number-of-payouts determination processing which is described later with reference to FIG. 21 (step S18). In this process, the number of payouts is determined based on the number of symbols of same kind that are displayed in the symbol display area 4, and then, the determined number of payouts is stored in the number-of-payouts storage area that is provided in the RAM 73.

The main CPU 71 then determines whether or not the second game trigger has been established (step S19). Here, the second game trigger is performed in a case where three specific symbols 150 have been displayed in the symbol display area 4 (refer to FIG. 13A).

Upon judging that the second game trigger is established (step S19: YES), the main CPU 71 performs the second game execution process described later with reference to FIG. 23 (step S20). The result of the second game executed by the gaming machine 1 according to the first embodiment of the present invention is determined in accordance with the ranking of the tree climbing competition by the panda animation character images 152 (152*a* to 152*c*) (refer to FIGS. 12A and 12B and FIGS. 13A, 13B, and 13C).

Next, when determining after the processing of step S20 or in step S19 that the second game trigger has not been established (step S19: NO), the main CPU 71 determines whether or not the mystery bonus trigger is established (step S21).

Upon judging that the mystery bonus trigger has been established (step S21: YES), the main CPU 71 performs a mystery bonus process (step S22). In the processing, the number of payouts (e.g. 300) being set for the mystery bonus is stored into the number-of-payouts storage area provided in the RAM 73.

After the processing of step S22 or when determining in step S21 that the mystery bonus trigger has not been established (step S21:NO), the main CPU 71 conducts insurance-check processing which is described later with reference to FIG. 22 (step S23). In the processing, whether or not to conduct payout by the insurance is checked.

The main CPU 71 conducts payout processing (step S24). The main CPU 71 adds the value stored in the number-of-payouts storage area to a value stored in a number-of-credits storage area provided in the RAM 73. It is to be noted that operations of the hopper 113 may be controlled based on input from the CASHOUT switch 33S, and coins of the number corresponding to the value stored in the number-of-payouts storage area may be discharged from the coin payout exit 15A.

Further, operations of the ticket printer 171 may be controlled and a ticket with a barcode may be issued on which a value stored in the number-of-payouts storage area is recorded. After the processing has been conducted, the processing is shifted to step S12.

<Coin-insertion/Start-Check Processing>

Figure 16:
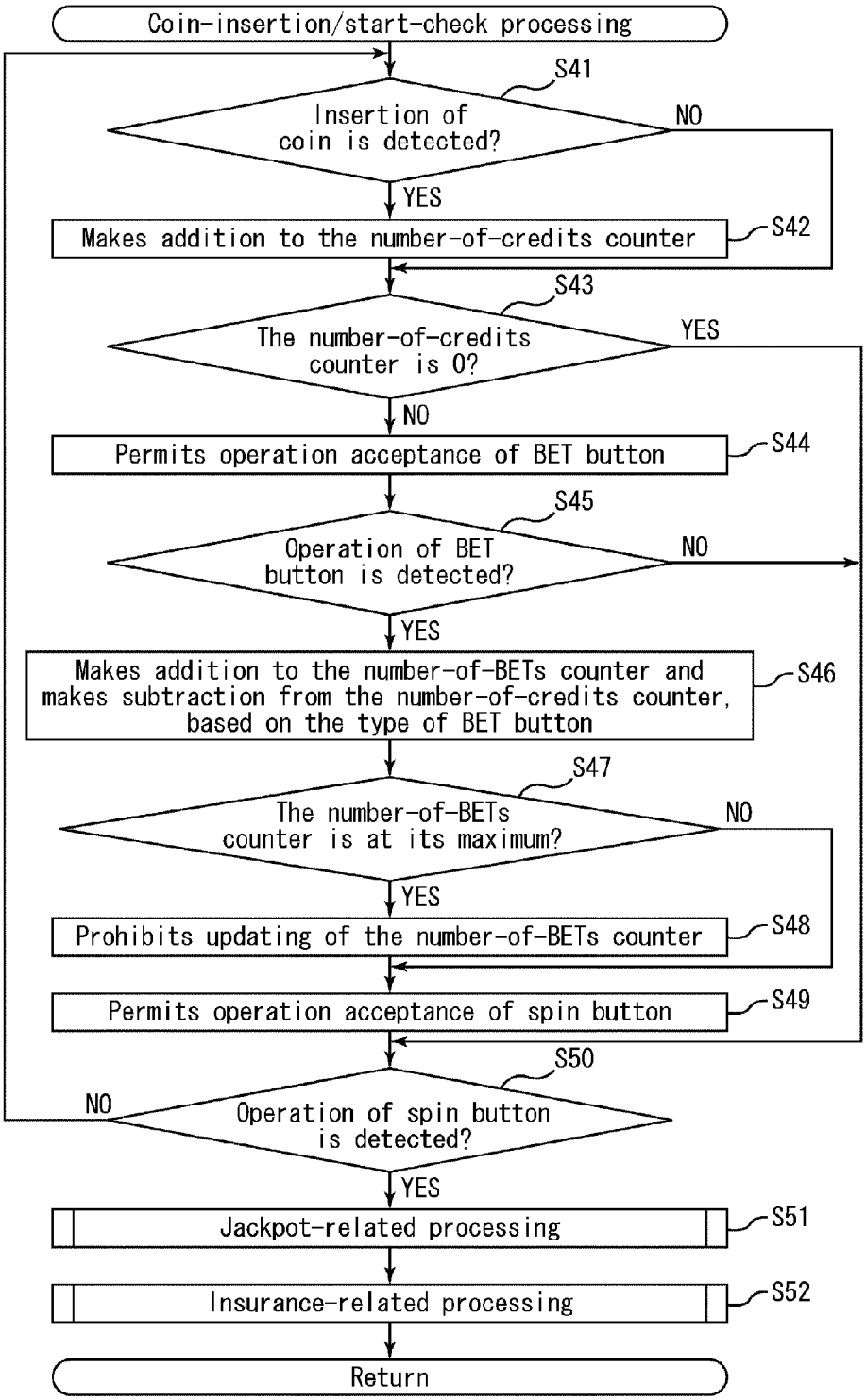
FIG. 16 is a view illustrating a flowchart of the coin-insertion/start-check processing for the gaming machine according to the first embodiment of the present invention.

Next, with reference to FIG. 16, coin-insertion/start-check processing is described. FIG. 16 is a view illustrating a flowchart of the coin-insertion/start-check processing for the gaming machine 1 according to the first embodiment of the present invention.

First, the main CPU 71 determines whether or not insertion of a coin has been detected by the coin counter 92C (step S41). When the main CPU 71 determines that coin insertion has been determined (step S41: YES), the main CPU 71 adds the value stored in the number-of-credits storage area (step S42). It is to be noted that, in addition to the insertion of a coin, the main CPU 71 may determine whether or not insertion of a bill has been detected by the bill validator 115, and when determining that the insertion of a bill has been detected, the main CPU 71 may add a value according to the bill to the value stored in the number-of-credits storage area.

After step S42 or when determining in step S41 that the insertion of a coin has not been detected (step S41:NO), the main CPU 71 determines whether or not the value stored in the number-of-credits storage area is 0 (step S43). When the main CPU 71 determines that the value stored in the number-of-credits storage area is not 0 (step S43: NO), the main CPU 71 permits operation acceptance of the BET buttons (step S44).

Next, the main CPU 71 determines whether or not operation of any of the BET buttons has been detected (step S45). When the main CPU 71 determines that the BET switch has detected press of the BET button by the player, the main CPU 71 makes an addition to a value stored in a number-of-BETs storage area provided in the RAM 73 and makes a subtraction from the value stored in the number-of-credits storage area, based on the type of the BET button (step S46).

The main CPU 71 then determines whether or not the value stored in the number-of-BETs storage area is at its maximum (step S47). When the main CPU 71 determines that the value stored in the number-of-BETs storage area is at its maximum (step S47: YES), the main CPU 71 disables updating of the value that is stored in the number-of-BETs storage area (step S48).

After step S48 or when determining in step S47 that the value stored in the number-of-BETs storage area is not at its maximum (step S47: NO), the main CPU 71 permits operation acceptance of the spin button (step S49).

After step S49 or when determining in step S45 that the operation of any of the BET buttons has not been detected (step S45: NO), or when determining in step S43 that the value stored in the number-of-credits storage area is 0 (step S43: YES), the main CPU 71 determines whether or not operation of the spin button has been detected (step S50). When the main CPU 71 determines that the operation of the spin button has not been detected (step S50: NO), the processing is shifted to step S41.

When the main CPU 71 determines that the operation of the spin button has been detected, the main CPU 71 conducts jackpot-related processing which is described later with reference to FIG. 17 (step S51). In the processing, the amount to be accumulated to the amount of jackpot is calculated, and the amount is transmitted to the external control device 200.

Next, the main CPU 71 conducts insurance-related processing which is described later with reference to FIG. 18 (step S52). In the processing, counting of the number of games is conducted which triggers a payout by the insurance. After the process has been conducted, the coin-insertion/start-check process is completed.

<Jackpot-related Processing>

Figure 17:
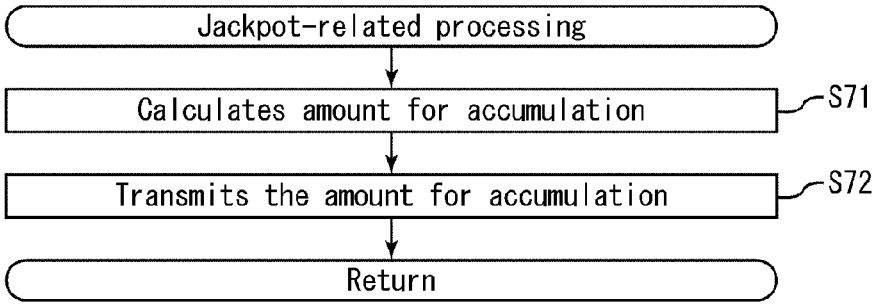
FIG. 17 is a view illustrating a flowchart of the jackpot-related processing for the gaming machine according to the first embodiment of the present invention.

Now, with reference to FIG. 17, the jackpot-related processing is described.

FIG. 17 is a view illustrating a flowchart of the jackpot-related processing for the gaming machine 1 according to the embodiment of the present invention.

First, the main CPU 71 calculates the amount for accumulation (step S71). The main CPU 71 obtains the product of the value stored in the number-of-BETs storage area and a preset accumulation ratio, so that the amount for accumulation to the amount of jackpot is calculated.

Next, the main CPU 71 transmits the calculated amount for accumulation to the external control device 200 (step S72). Upon reception of the amount for accumulation, the external control device 200 updates the amount of jackpot. After the process has been conducted, the jackpot-related process is completed.

<Insurance-related Processing>

Figure 18:
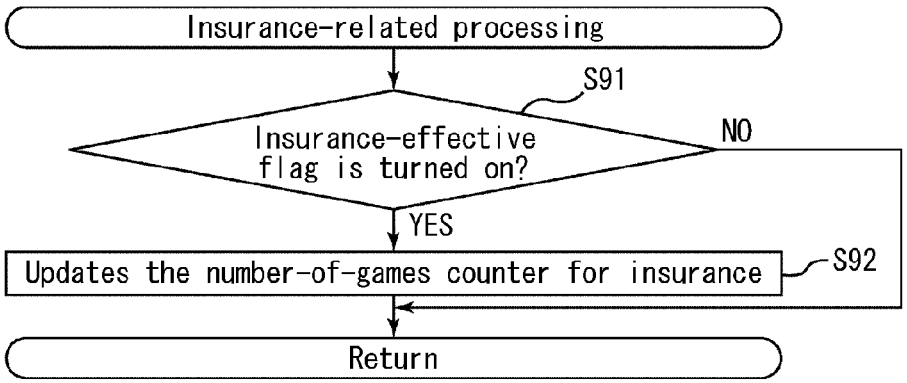
FIG. 18 is a view illustrating a flowchart of the insurance-related processing for the gaming machine 1 according to the first embodiment of the present invention.

Next, with reference to FIG. 18, the insurance-related processing is described. FIG. 18 is a view illustrating a flowchart of the insurance-related processing for the gaming machine 1 according to the embodiment of the present invention.

First, the main CPU 71 determines whether or not the insurance-effective flag is turned on (step S91). The insurance-effective flag is turned on when a command to make the insurance effective is inputted by the player in the insurance selection processing which is described later with reference to FIG. 24.

When the judgment result is negative (step S91:NO), the main CPU 71 ends the insurance-check processing. On the other hand, when the main CPU 71 determines that the insurance-effective flag is turned on (step S91: YES), the main CPU 71 updates the value that is stored in the number-of-games-played storage area for insurance, provided in the RAM 73 (step S92). The number-of-games storage area for insurance is an area for storing the number of games up to the time of the payout by the insurance.

In the processing of step S92, the main CPU 71 adds one to the value stored in the number-of-games storage area for insurance. After the process has been conducted, the insurance-related process is completed.

<Symbol Lottery Processing>

Figure 19:
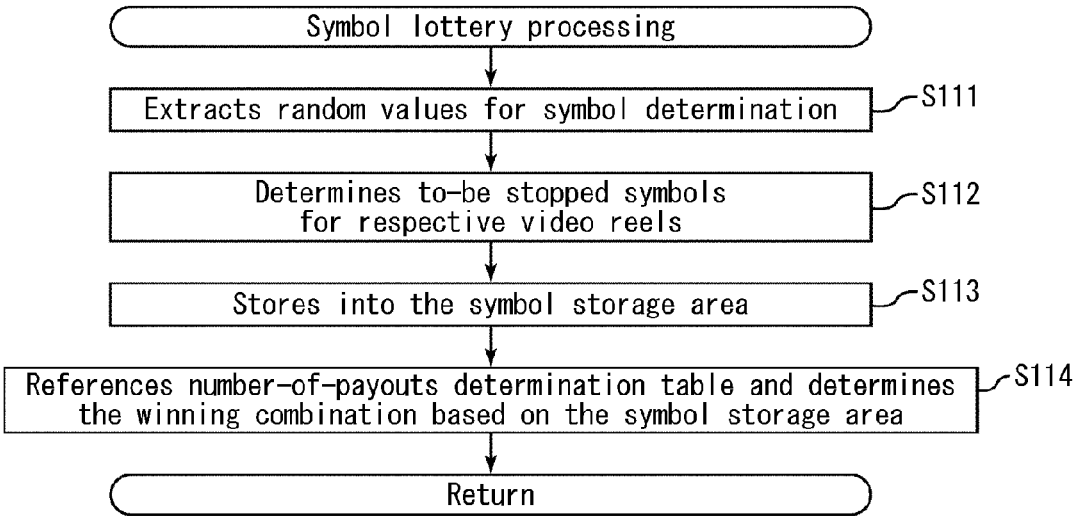
FIG. 19 is a view illustrating a flowchart of the symbol lottery processing for the gaming machine 1 according to the first embodiment of the present invention.

Next, with reference to FIG. 19, the symbol lottery processing is described.

FIG. 19 is a view illustrating a flowchart of the symbol lottery processing for the gaming machine 1 according to the embodiment of the present invention.

First, the main CPU 71 extracts random values for symbol determination (step S111). Next, the main CPU 71 determines to-be stopped symbols for the respective rotation reels 3 (3*a* to 3*e*) by lottery (step S112).

The main CPU 71 holds a lottery for each rotational reel 3 (3*a* to 3*e*), and determines any one of the 22 symbols (code numbers from "00" to "21") as a to-be stopped symbol. At this time, each of the 22 symbols (code numbers from "00" to "21") is determined at an equal probability (i.e. 1/22).

The main CPU 71 then stores the determined to-be identification data of stopped symbols for the respective rotational reels 3 (3*a* to 3*e*) into a symbol storage area provided in the RAM 73 (step S113). Next, referring to a symbol combination table (not shown) specifying winning combinations according to the number of symbols of same kind, the main CPU 71 determines a winning combination, based on the symbol storage area (step S114).

The main CPU 71 determines whether or not a combination of symbols that are displayed in the symbol display area 4 coincides with a combination of symbols that are specified in the symbol combination table, and then, determines a winning combination. After the processing has been conducted, the symbol lottery processing is completed.

<Symbol Display Control Processing>

Figure 20:
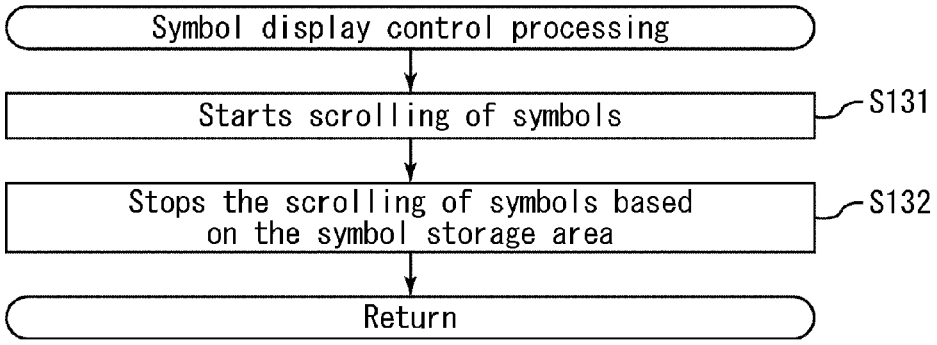
FIG. 20 is a view illustrating a flowchart of the symbol display control processing for the gaming machine according to the first embodiment of the present invention.

Next, with reference to FIG. 20, the symbol display control processing is described.

FIG. 20 is a view illustrating a flowchart of the symbol display control processing for the gaming machine 1 according to the first embodiment of the present invention.

First, the main CPU 71 starts scrolling of symbols to be displayed in the symbol display area 4 of the lower image display panel 141 (step S131). Symbol scrolling is started by spinning the spinning reels 3 (3*a* to 3*e*) by means of the reel control portion 120 (refer to FIG. 7), and then, symbols are scroll-displayed in the symbol display area 4.

The main CPU 71 then stops the scrolling of the symbols of the respective rotational reels 3 (3*a* to 3*e*), based on the aforementioned symbol storage area (step S132). In the case of the stoppage of scrolling, spinning of the spinning reels 3 (3*a* to 3*e*) is controlled by means of a reel control portion 120 (refer to FIG. 7) and then symbols are stop-displayed in the symbol display area 4. After the processing has been conducted, the symbol display control processing is completed.

Figure 21:
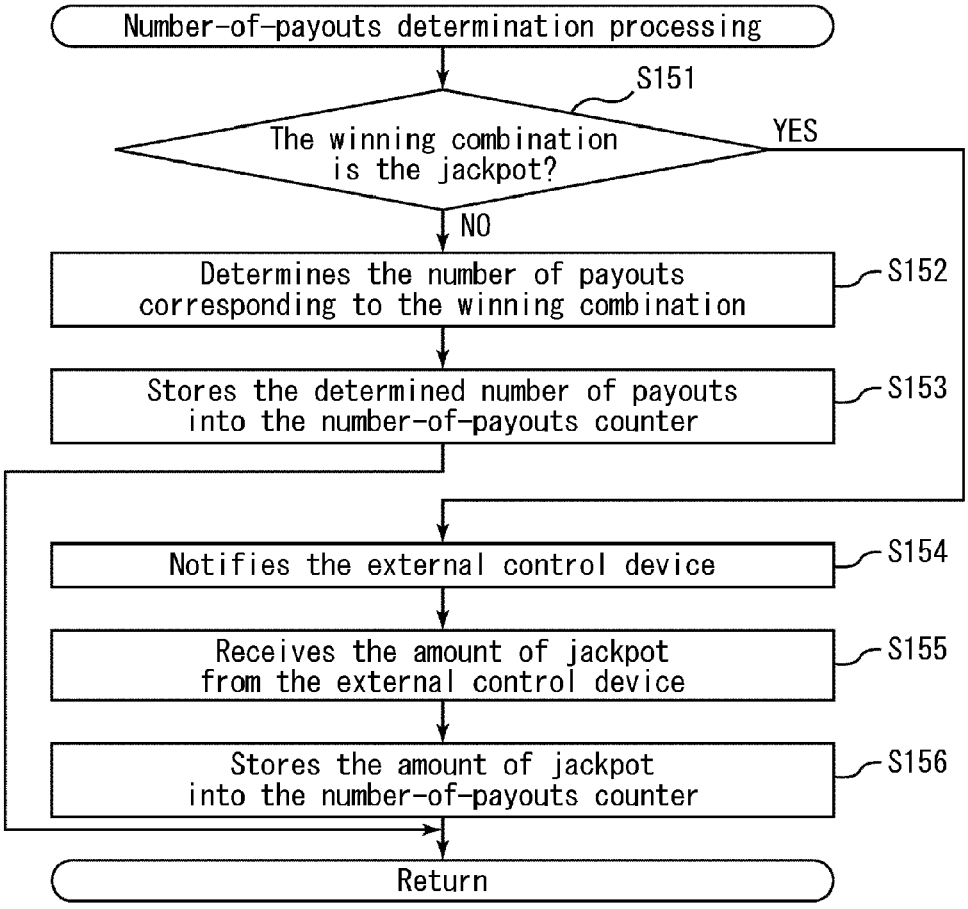
FIG. 21 is a view illustrating a flowchart of the number-of-payouts determination processing for the gaming machine according to the first embodiment of the present invention.

FIG. 21 is a view illustrating a flowchart of the number-of-payouts determination processing for the gaming machine 1 according to the embodiment of the present invention.

The main CPU 71 first determines whether or not the winning combination is the jackpot (step S151). When the main CPU 71 determines that the winning combination is not the jackpot (step S151: NO), the main CPU 71 determines the number of payouts corresponding to the winning combination (step S152).

For example, in a basic game, in a case where the symbols that are displayed in the symbol display area 4 form a predetermined combination (for example, in a case where three or more symbols of same kind have been displayed), the number of payouts that corresponds to the symbol combination is determined.

It is to be noted that the main CPU 71 determines "0" as the number of payouts in the case where the game is lost. Next, the main CPU 71 stores the determined number of payouts into the number-of-payouts storage area (step S153). After the processing has been conducted, the number-of-payouts determination processing is completed.

When the main CPU 71 in step S151, determines that the winning combination is the jackpot (step S151: YES), the main CPU 71 notifies the external control device 200 of the winning of the jackpot (step S154).

It is to be noted that, upon reception of the notification, the external control device 200 transmits to the gaming machine 1 the amount of jackpot having updated up to that time. At this time, a part (e.g. 80%) of the amount of jackpot may be the payout subject and the rest (e.g. 20%) may be carried over for the upcoming establishment of the jackpot trigger.

Next, the main CPU 71 receives the amount of jackpot from the external control device 200 (step S155). The main CPU 71 then stores the received amount of jackpot into the number-of-payouts storage area (step S156). After the processing has been conducted, the number-of-payouts determination processing is completed.

<Insurance-check Processing>

Figure 22:
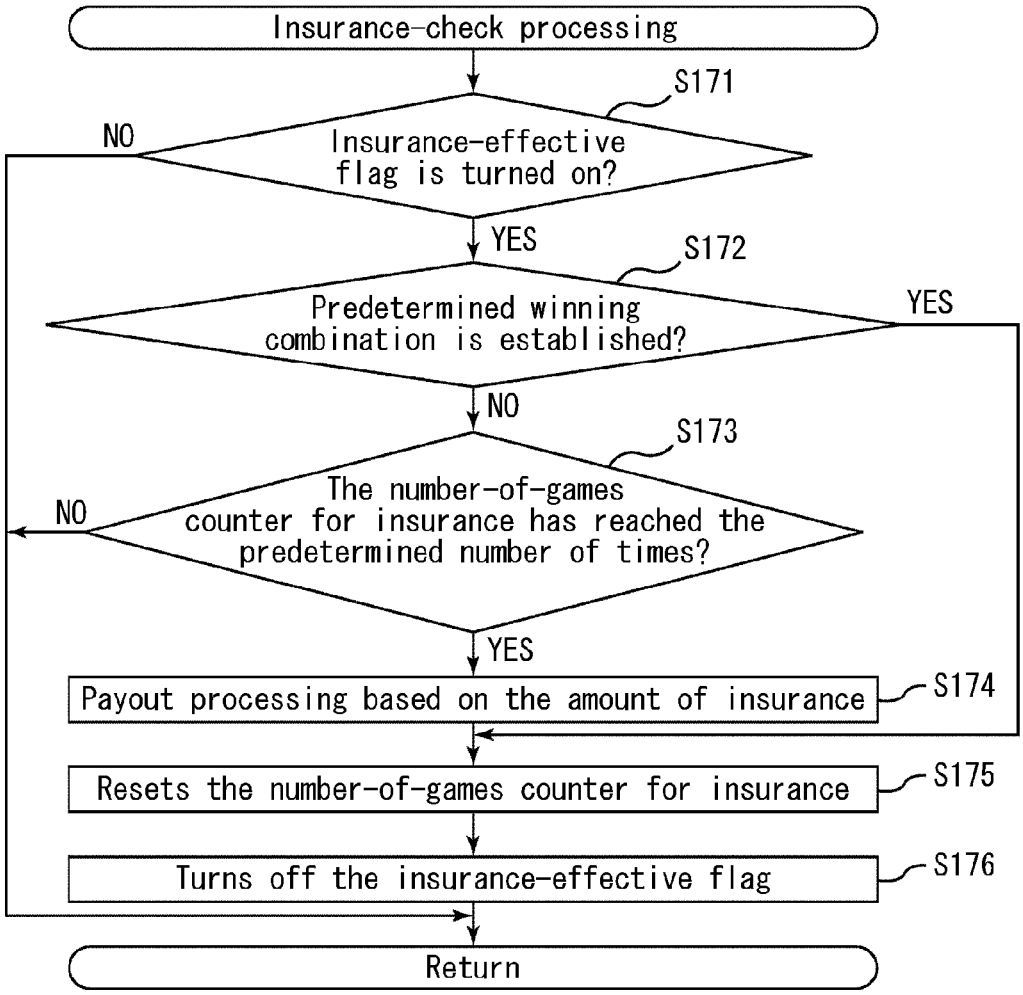
FIG. 22 is a view illustrating a flowchart of the insurance-check processing for the gaming machine according to the first embodiment of the present invention.

Next, with reference to FIG. 22, the insurance-check processing is described.

FIG. 22 is a view illustrating a flowchart of the insurance-check processing for the gaming machine 1 according to the embodiment of the present invention.

First, the main CPU 71 determines whether or not the insurance-effective flag is turned on (step S171). When the judgment result is negative (step S171:NO), the main CPU 71 ends the insurance-check processing.

When the main CPU 71 determines that the insurance-effective flag is turned on (step S171: YES), the main CPU 71 determines whether or not a predetermined winning combination is established (step S172). In the first embodiment of the present invention, "second game trigger", "jackpot" and "mystery bonus" are subjects of the predetermined winning combination.

When the main CPU 71 determines that the predetermined winning combination has not been established (step S172: NO), the main CPU 71 determines whether or not the value stored in the number-of-games storage area for insurance has reached a predetermined number of times (e.g. 300) (step S173). When the main CPU 71 determines that the value stored in the number-of-games storage area for insurance has not reached the predetermined number of times (step S173: NO), the main CPU 71 completes the insurance-check processing.

When the main CPU 71 determines that the value stored in the number-of-games storage area for insurance has reached the predetermined number of times (step S173: YES), the main CPU 71 conducts payout processing based on the amount of insurance (step S174). The main CPU 71 adds an amount (e.g. 200) previously set as the amount of insurance to the value stored in the number-of-credits storage area.

After step S174 or when determining in step S172 that the predetermined winning combination has been established (step S172: YES), the main CPU 71 resets the value stored in the number-of-games storage area for insurance (step S175).

Next, the main CPU 71 turns the insurance-effective flag off (step S176). After the process has been conducted, the insurance-check process is completed.

<Second Game Processing>

Figure 23:
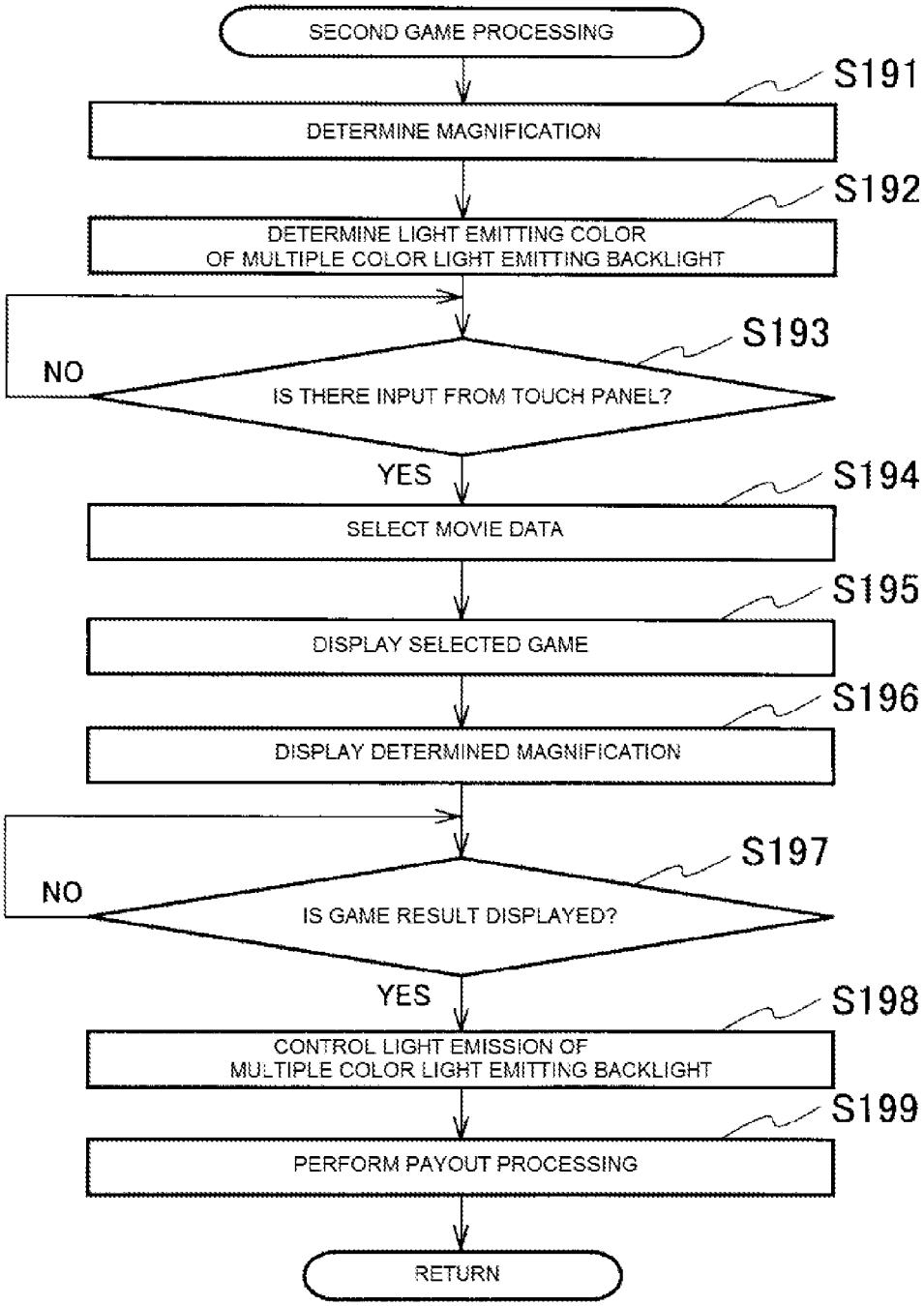
FIG. 23 is a view illustrating a flowchart of a second game processing for the gaming machine according to the first embodiment of the present invention.

Next, with reference to FIG. 23, the second game processing is described.

FIG. 23 is a view illustrating a flowchart of a second game processing for the gaming machine 1 according to the first embodiment of the present invention.

First, the main CPU 71 determines a magnification for a respective one of plural kinds of colors which are produced in a color displayable manner by means of the multiple color light emitting backlight 5 (step S191). In determining the magnification, a plurality of magnifications (five times, three times, two times) which are specified in a magnification data table (refer to FIG. 10) may be determined. In addition, a predetermined number (for example, three) may be determined at random (by means of random number lottery) from a plurality of magnifications (for example, 10 times, seven times, five times, three times, two times).

Next, the main CPU 71 determines the light emitting color exerted by the multiple light emitting backlight 5 at the back side of a respective one of the specific symbols 150 that are displayed in the symbol display area 4 from among plural kinds of colors which are produced in a color displayable manner by means of the multiple light emitting backlight 5 (step S192). In determining the light emitting color, with respect to the multiple color light emitting backlight 5, while the upper image display panel 131 displays a magnification of respective one of the colors which are produced in a color displayable manner by means of the multiple color light emitting backlight 5, the light emitting color is determined at random (by means of random number lottery), based on a light emitting table (refer to FIG. 9).

When the light emitting color is determined, the upper image display panel 131 displays an effect image which prompts a player to select any panda animation character image from a plurality of panda animation character images 152 (152*a* to 152*c*) (refer to FIG. 13B).

Next, the main CPU 71 determines whether or not input from an input device (such as a touch panel, for example) is made (step S193). Namely, from among the panda animation character images 152 (152*a* to 152*c*) that are displayed on the upper image display panel 131, the main CPU 71 determines whether or not the player has selected any panda animation character image by means of the input from the input device (refer to FIG. 13B).

Herein, the input device may be a touch panel (not shown) or a selection button (not shown) which is provided on the upper image display panel 131. In addition, the input device may be a touch panel 114 (refer to FIG. 7) or a selection button (not shown) which is provided on the lower image display panel 141.

When the main CPU 71 determines that the input from the input device is not made (step S193: NO), the main CPU 71 waits until the input from the input device is made.

On the other hand, when the main CPU 71 determines that the input from the input device is made (step S193: YES), movie data is selected (step S194). In selecting the movie data, any item of the movie data that corresponds to the color determined in step S192, among the magnifications that are determined in step S191, is selected from among a plurality of movie data (FIG. 11), based on the input from the input device.

For example, in a case where the color determined in step S192 is red, the magnification that corresponds to the identification number for red is determined to be five times, referring to the magnification data table (refer to FIG. 10). In the case where the magnification is five times, movie data is determined at random (by means of random number lottery) from the movie data "A" and "B" indicating that the result of the tree climbing competition by pandas (refer to FIGS. 13A, 13B, and 13C and FIGS. 14A and 14B) is a first place.

Next, the main CPU 71 causes the upper image display panel 131 to display a game that corresponds to the selected movie data (step S195). When the game that corresponds to the selected movie data is started, the upper image display panel 131 displays an effect image indicating that the panda animation character images 152 (152*a* to 152*c*) are climbing the tree (refer to FIG. 13C).

Next, the main CPU 71 causes the upper image display panel 131 to display the magnification of a respective one of plural kinds of colors which are produced in the color displayable manner by means of the multiple color light emitting backlight 5, the magnification having been determined in step S191 (step S196). The upper image display panel 131 displays a magnification image 153 indicating that the first place is five times in red, the second place is three times in blue, and the third place is two times in green (refer to FIG. 13B).

Next, the main CPU 71 determines whether or not a game result has been displayed (step S196). Namely, the main CPU 71 determines whether or not the result of the tree climbing competition has been displayed (the ranking has been displayed) after the completion of the tree climbing competition by the panda animation character images 152 (152*a* to 152*c*), having been started by selection of movie data (step S197).

The result of the tree competition is obtained by displaying the ranking images 136 (136*a* to 136*c*) on the upper image display panel 131. For example, in a case where the panda animation character image 152*a* is in the second place, the panda animation character image 152*b* is in the third place, and the panda animation character image 152*c* is in the first place, the upper image display panel 131 displays the ranking image 136*a* of the second place in blue, the ranking image display 136*b* of the third place in blue, and the ranking image 136*c* of the first place in red (refer to FIG. 14A).

When the main CPU 71 determines that a game result is not displayed on the upper image display panel 131 (step S197: NO), the main CPU 71 waits until the game result is displayed. On the other hand, when the main CPU 71 determines that the game result has been displayed on the upper image display panel 131 (step S197: YES), the main CPU 71 controls light emission of the multiple color light emitting backlight 5 (step S198).

Namely, the main CPU 71 controls light emission of the multiple color light emitting backlight 5, thereby illuminating the specific symbols 150 that are displayed in the symbol display area 4 of the lower image display panel 141, from the back side with the light emitting color that is determined in step S192.

For example, in a case where the panda animation character image selected by the player is in the third place, the magnification image 153 displayed in step S196 is green, and the third place is two times (refer to FIG. 13B), the multiple color light emitting backlight 5 emits light in "green" and then illuminates the specific symbol 150 from the back side (refer to FIG. 14B).

The main CPU 71 conducts payout processing (step S199). In this payout processing, the main CPU 71 executes a payout which is obtained by multiplying a magnification that corresponds to the color that is determined in step S191 for a combination of specific symbols 150 that are displayed in the symbol display area 4 (refer to FIG. 14B).

Namely, the payout processing is executed based on the magnification image 153 that is displayed in step S196 (refer to FIG. 13B). For example, in step S193, in a case where the panda animation character selected by the player is in the first place, a payout of a number is executed the payout being that is obtained by multiplying five times, three times, or two times in the case where the panda animation character selected by the player is in the first place, the second place, or the third place, for a payment that corresponds to a combination of specific symbols 150.

After the process has been conducted, the second game process is completed. When the second game processing has been completed, the processing is shifted to the processing of step S21 described with reference to FIG. 15.

While the foregoing second game processing described a case in which: a magnification is determined for a respective one of plural kinds of colors which are produced in a color displayable manner by means of the multiple color light emitting backlight 5 (step S191); a color is determined from among plural kinds of colors which are produced in the color displayable manner by means of the multiple color light emitting backlight 5 (step S192); and a payout is executed as the one that is obtained by multiplying the magnification that corresponds to the determined color from among the determined magnifications for the payment that corresponds to the pattern of specific symbols 150, the present invention is not limited thereto.

For example, it may be that: one magnification is determined for a respective one of plural kinds of colors which are produced in a color displayable manner by means of the multiple color light emitting backlight 5; the color that corresponds to the determined magnification is determined from among plural kinds of colors which are produced in the color displayable manner by means of the multiple color light emitting backlight 5; light emission from the multiple light emitting backlight 5 is controlled with the determined color; and a payout is executed as the one that is obtained by multiplying the determined magnification for the payment that corresponds to the pattern of specific symbols 150.

In this way, the magnification is determined for a respective one of plural kinds of colors which are produced in the color displayable manner by means of the multiple color light emitting backlight 5; the light emitting color exerted by the multiple color light emitting backlight 5 at the back side of a respective one of the specific symbols is determined from among plural kinds of colors; and light emission of the multiple color light emitting backlight 5 is controlled with the determined color. Thus, the specific symbols 150 can be illuminated with the determined color from among the magnifications of the determined colors.

In addition, the light emitting color of the multiple color light emitting backlight 5 is determined at random, and according to the symbols that are displayed in the symbol display area 4 and the light emitting color that is determined in order to illuminate the back side, a payment is given in association with a numeric value (identification number, magnification) which is obtained by referring to a magnification data table (table data, refer to FIG. 10). Thus, the contents of a payment to be given can be recognized by visually recognizing the color of a respective one of the symbols that are displayed in the symbol display area 4. Therefore, there can be provided a gaming machine which is capable of diversifying the display mode of symbols by means of the spinning reels 3 (3*a* to 3*e*).

<Insurance Selection Processing>

Figure 24:
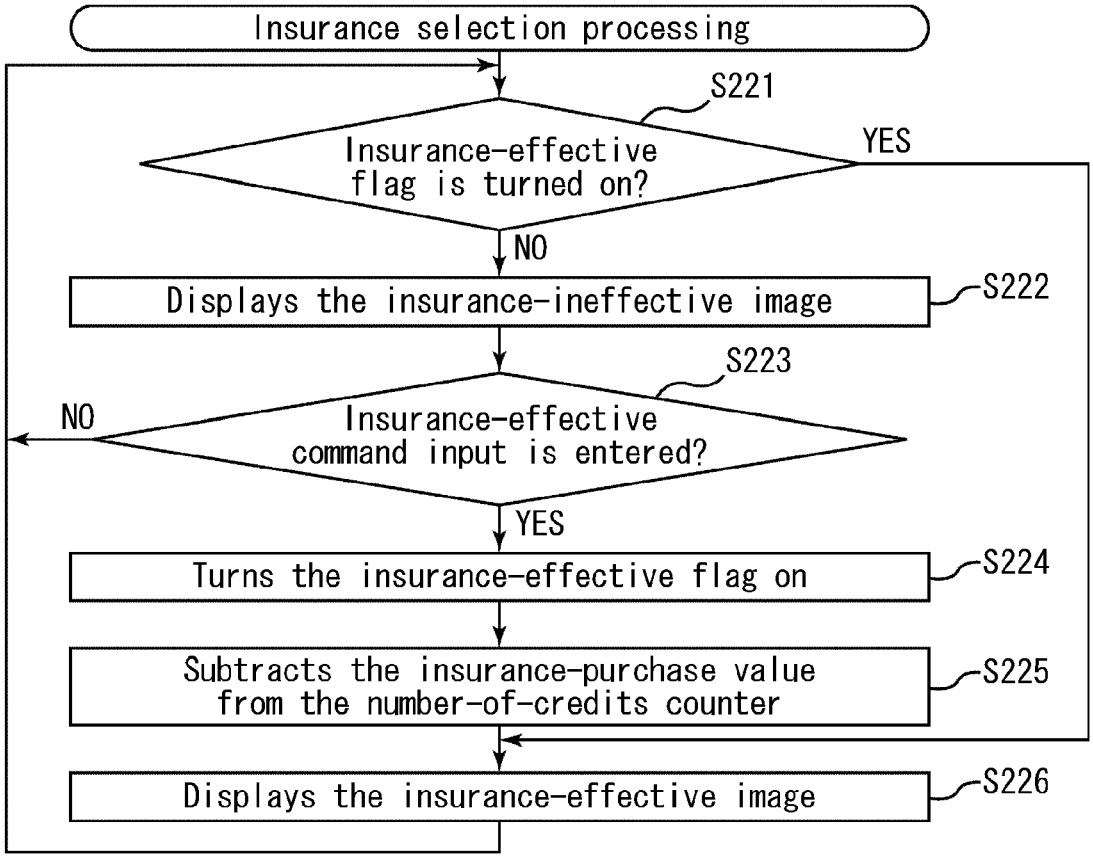
FIG. 24 is a view illustrating a flowchart of the insurance selection processing for the gaming machine according to the embodiment of the present invention.

Next, with reference to FIG. 24, the insurance selection processing is described.

FIG. 24 is a view illustrating a flowchart of the insurance selection processing for the gaming machine 1 according to the first embodiment of the present invention.

First, the main CPU 71 determines whether or not the insurance-effective flag is turned on (step S221). When the judgment result is negative (step S221:NO), the main CPU 71 displays an insurance-ineffective image (step S222).

The main CPU 71 transmits a command to display the insurance-ineffective image to the graphic board 130. Based on the command, the graphic board 130 generates the insurance-ineffective image and displays the image to the lower image display panel 141.

As the insurance-ineffective image, for example, an image indicating "INSURANCE BET $1.00 TOUCH TO BET" is displayed. This image is an image for prompting the player to select whether or not to make the insurance effective, and notifying the player of the amount required for making the insurance effective. The player can input a command to make the insurance effective by touching a predetermined place on the touch panel 114.

Subsequently, the main CPU 71 determines whether or not an insurance-effective command input has been entered (step S223). When the main CPU 71 determines that the insurance-effective command input has not been entered (step S223: NO), the main CPU 71 shifts the processing to step S221 with the insurance-effective flag turned off.

On the other hand, when the main CPU 71 determines that an insurance-effective command has been entered (step S223: YES), an insurance-effective flag is turned on (step S224).

Next, the main CPU 71 subtracts the insurance-purchase amount from the value stored in the number-of-credits storage area (step S225). In the present embodiment, an amount corresponding to, for example, one dollar is subtracted from the value stored in the number-of-credits storage area.

When determining that the insurance-effective flag is turned on after step S225 or in step S221 (step S221: YES), the main CPU 71 displays the insurance-effective image (step S226).

As the insurance-effective image, for example, an image showing "INSURANCE CONTINUED WIN 200 CREDIT" is displayed. This image is an image informing the player that the insurance is effective, and that the value of "200" is to be added to the value stored in the number-of-credits storage area when the insurance condition is satisfied. After the processing has been conducted, the processing is shifted to step S221.

In this manner, the gaming machine 1 according to the first embodiment of the present invention, comprising:

a plurality of spinning reels 3 (3*a* to 3*e*) having symbols arranged on peripheral faces thereof;

a lower image display panel (a symbol display window) 141 having a symbol display area 4 in which symbols are scroll-displayed by spinning of the spinning reels 3 (3*a* to 3*e*) and the spinning symbols are stop-displayed by stoppage of the spinning reels 3 (3*a* to 3*e*);

an upper image display panel (a display) 131 which is arranged at an upper part of the lower image display panel 141, for displaying a video image;

a multiple color light emitting backlight 5 which is configured to individually illuminate a respective one of the symbols that are displayed in the symbol display area 4 from a back side; and a main CPU (a controller) 71 which is configured to start a second game in a case where a pattern of specific symbols 150 (see FIG. 13A) serving as a trigger for migrating from a basic game to a second game is displayed in the symbol display area 4, wherein the main CPU 71 executing processing operations of:

(a) determining a magnification of a respective one of plural kinds of colors which are produced in a color displayable manner by means of the multiple color light emitting backlight 5 and then displaying the magnification that is determined for the respective one of the colors on the upper image display panel 131 (processing of step S191 in FIG. 23);

(b) while the magnification of the respective one of the plural kinds of colors that are reproduced in the color displayable manner by means a multiple color light emitting backlight 5 is displayed on the upper image display panel 131 (see FIG. 13B), determining a light emitting color by means of the multiple color light emitting backlight 5 at a back side of a respective one of the specific symbols 150 that are displayed in the symbol display area 4, from among the plural kinds of colors that are produced in the color displayable manner by means of the multiple color light emitting backlight 5 (processing of step S192 in FIG. 23), and when the second game started is completed, controlling light emission in the determined color (processing of step S198 in FIG. 23); and (c) executing a payout of a number which is obtained by multiplying the magnification that corresponds to the color determined in the processing of step S192, from among the magnifications of the respective colors, the magnifications being determined in the processing of step S191, for a payment that corresponds to the pattern of the specific symbols 150 (step S199).

Further, the gaming machine 1 according to the first embodiment of the present invention, wherein:

the multiple color light emitting backlight 5 has a respective one of shading portions 6 (6*a* to 6*d*) which are provided for a plurality of spinning reels 3 (3*a* to 3*e*) (see FIG. 6); and the respective one of the shading portions 6 (6*a* to 6*d*) is configured to shade light in a respective one of partition areas 7 which are partitioned in order to individually emit the light to a respective one of the symbols that are displayed in the symbol display area 4, so that all of the symbols that are displayed in the symbol display area 4 are allowed to be displayed by means of the multiple color light emitting backlight 5 in a color variable manner.

Furthermore, the gaming machine 1 according to the first embodiment of the present invention, a plurality of spinning reels 3 (3*a* to 3*e*) having symbols arranged on peripheral faces thereof;

a lower image display panel (a symbol display window) 141 having a symbol display area 4 in which symbols are scroll-displayed by spinning of the spinning reels 3 (3*a* to 3*e*) and the spinning symbols are stop-displayed by stoppage of the spinning reels 3 (3*a* to 3*e*);

a multiple color light emitting backlight having a shading portion (see FIG. 6) which is provided for a respective one of a plurality of spinning reels 3 (3*a* to 3*e*), the backlight 5 being configured to shade light in a respective one of partition areas 7 which are partitioned in order to individually emit the light from a back side to a respective one of the symbols that are displayed in the symbol display area 4 so that all of the symbols that are displayed in the symbol display area 4 are allowed to be displayed individually in a color changeable manner;

a memory RAM 73 which is configured to store magnification data table (see, table data, FIG. 10) for associating a plurality of numeric values with one symbol in accordance with a combination of the symbols and a plurality of colors of the light beams to be emitted from the back side; and a main CPU 71 (a controller) 71 which is configured to: randomly determine a light emitting color of the multiple color light emitting backlight 5 after symbols are stop-displayed in the symbol display area 4; refer to the table data (table data) that is stored in the memory RAM 73 in accordance with the light emitting color that is determined to illuminate a respective one of the symbols that are displayed in the symbol display area 4 and the back side thereof; and give a payment in association with the numeric values (identification number, magnification) that are obtained by means of the magnification data table (table data).

Moreover a method of controlling a gaming machine 1 according to the first embodiment of the present invention which comprises a main CPU (a controller) 71, the main CPU 71 being configured to start a second game in a case where a pattern of specific symbols (see FIG. 13A) serving as a trigger for migrating from a basic game to the second game is displayed in a symbol display area 4 in which symbols are stop-displayed by stopping spinning reels 3 (3*a* to 3*e*) having the symbols arranged on peripheral faces thereof, said control method comprising the steps of:

(a) determining a magnification for a respective one of plural kinds of colors which are produced in a color displayable manner by means of a multiple color light emitting backlight 5 which is configured to illuminate a respective one of the symbols that are displayed in the symbol display area 4 individually from a back side, and then, displaying the magnification determined for a respective one of the colors on the upper image display panel (a display) 131 which is arranged at an upper part of the symbol display area 4, for displaying a video image (processing of step S191 in FIG. 23);

(b) while the magnification of the respective one of the plural kinds of colors that are produced in the color displayable manner is displayed on the upper image display panel 131, determining a light emitting color by means of the multiple color light emitting backlight 5 at a back side of a respective one of the specific symbols 150 that are displayed in the symbol display area 4, from among the plural kinds of colors that are produced in the color displayable manner by means of the multiple color light emitting backlight 5 (processing of step S192 in FIG. 23), and when the second game started is completed, controlling light emission in the determined color (processing of step S198 in FIG. 23); and (c) executing a payout of a number which is obtained by multiplying the magnification that corresponds to the color determined in the processing of step S192, from among the magnifications of the respective one of the colors, the magnifications being determined in the processing of step S191, for a payment that corresponds to the pattern of the specific symbols (step S199).

In addition, with the gaming machine 1 according to the first embodiment of the present invention, the light emitting color exerted by the multiple color light emitting backlight 5 at the back side of a respective one of the specific symbols 150 is determined from among plural kinds of colors which are produced in the color displayable manner, and then, light emission of the multiple color light emitting backlight 5 is controlled with the determined color. Therefore, the illumination color of the specific symbols 150 can be changed by making the light emitting color of the multiple color light emitting backlight 5 different from another one. Accordingly, there can be provided a gaming machine which is capable of diversifying the display mode of symbols by means of the spinning reels 3 (3*a* to 3*e*).

In this manner, there can be attained an advantageous effect which is identical to that in a case where the number of symbols arranged on the peripheral faces of the spinning reels 3 (3*a* to 3*e*) has been increased.

In addition, the magnifications is determined for a respective one of plural kinds of colors which are produced in a color displayable manner by means of the multiple color light emitting backlight 5, and then, the determined magnification is displayed on the display (the upper image display panel 131), so that the magnification that corresponds to the light emitting color can be grasped by visually recognizing the color of the specific symbols 150. Therefore, the game result can be clearly grasped.

In addition, with the gaming machine 1 according to the first embodiment of the present invention, the multiple color light emitting backlights 5 has a respective one of the shading portions 6 (6*a* to 6*d*) which is provided for a respective one of the spinning reels 3 (3*a* to 3*e*), and light is shaded in a respective one of the partition areas 7 that have been partitioned in order to emit the light from the back side individually for a respective one of the symbols. Thus, it becomes possible to prevent the illumination color from being changed from a target color by being illuminated by the illumination light of the peripheral symbols, and the display mode of symbols can be diversified.

Further, the LED 8 that is disposed in a respective one of the partition areas 4 that have been shaped by the shading portions 6 (6*a* to 6*e*) is caused to emit light, whereby light does not leak into another partition area, so that predetermined symbols are produced in a highlighted manner by individually changing colors on a symbol-by-symbol basis, for example.

Then, the color of the specific symbols 150 is displayed in a highlighted manner with a color which is different from that of another symbol, whereby the state of a game currently executed and the magnification to be multiplied for a payment can be notified, thus making it possible to clarify the contents of the game played.

In addition, with the gaming machine 1 according to the first embodiment of the present invention, the light emitting color of the multiple color light emitting backlight 5 is determined at random, and according to the symbols that are displayed in the symbol display area 4 and the light emitting color that is determined in order to illuminate its back side, a payment is given in association with a numeric value (identification number, magnification) that is obtained by referring to the magnification data table (table data, Refer to FIG. 10). Thus, the contents of a payment to be given can be recognized by visually recognizing the color of a respective one of the symbols that are displayed in the symbol display area 4. Therefore, there can be provided a gaming machine which is capable of diversifying the display mode of symbols by means of the spinning reels 3 (3*a* to 3*e*).

Next, a gaming machine 1 according to a second embodiment of the present invention will be described in detail with reference to the drawings.

The gaming machine 1 according to the second embodiment has an appearance, circuitry, and the like that are substantially the same as those of the gaming machine 1 according to the first embodiment. Thus, a duplicated explanation is omitted here. In addition, like constituent elements of the gaming machine 1 according to the first embodiment are designated by like reference numerals, and a further description will be given.

The gaming machine 1 according to the second embodiment of the present invention is provided with: a plurality of spinning reels 3 (3*a* to 3*e*) having symbols arranged on peripheral faces thereof; and a lower image display panel (symbol display window) 141 having a symbol display area 4 in which symbols are stop-displayed by stoppage of the spinning reels 3 (3*a* to 3*e*) (refer to FIG. 4).

Figure 26A:
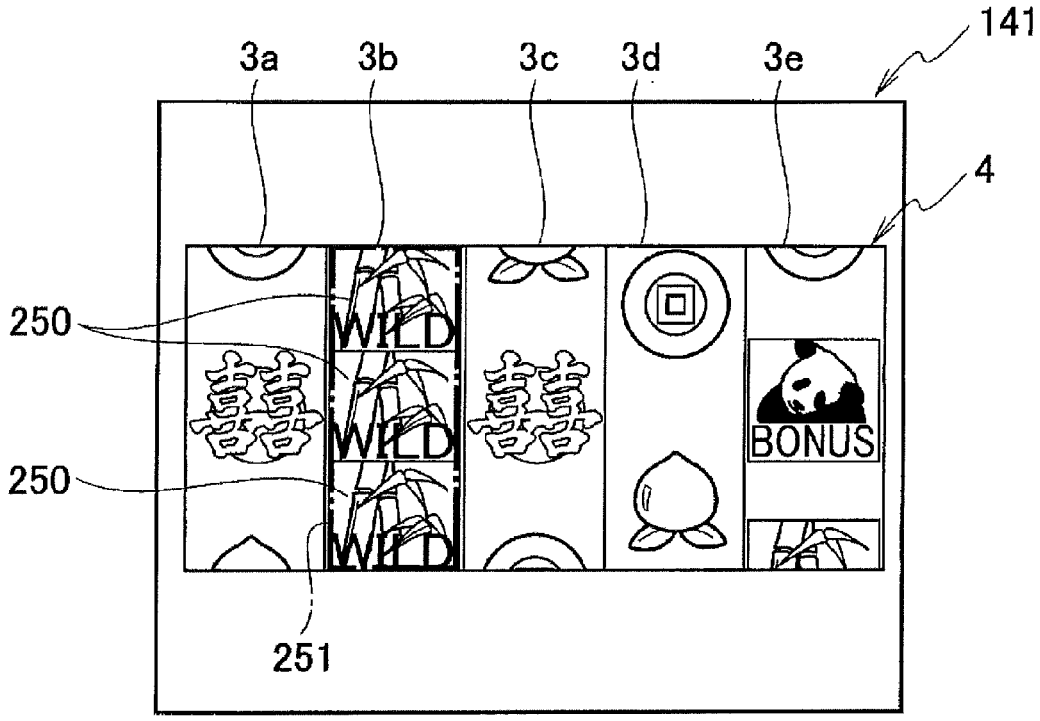
FIGS. 26A and 26B are views illustrating an exemplary display of the gaming machine according to the second embodiment of the present invention.

A plurality of symbols of same kind are continuously arranged on the peripheral faces of the spinning reels 3 (3*a* to 3*e*) according to the second embodiment of the present invention (for example, three wild symbols (WILD) 250 to be described later with reference to FIG. 26A are continuously arranged).

In addition, the gaming machine 1 according to the second embodiment of the present invention is provided with: a multiple color light emitting backlight 5 (refer to FIG. 6) which is provided for a respective one of a plurality of spinning reels 3 (3*a* to 3*e*), the backlight 5 having a respective one of the shading portions 6 (6*a* to 6*d*) for shading light in a respective one of partition areas 7 in order to emit light to the symbols that are displayed in the symbol display area 4 individually from the back side so that all of the symbols that are displayed in the symbol display area 4 are allowed to be individually displayed in a color variable manner.

Further, the gaming machine 1 according to the second embodiment of the present invention is provided with a CPU (a controller. Refer to FIG. 7) 71 which executes a basic game in accordance with a basic game program and then executes a second game in accordance with a second game program.

The gaming machine 1 according to the second embodiment of the present invention executes a second game a predetermined number of times in which another spinning reel is spun and stopped in a state in which spinning of a spinning reel having a wild symbol displayed thereon is stopped.

Figure 25:
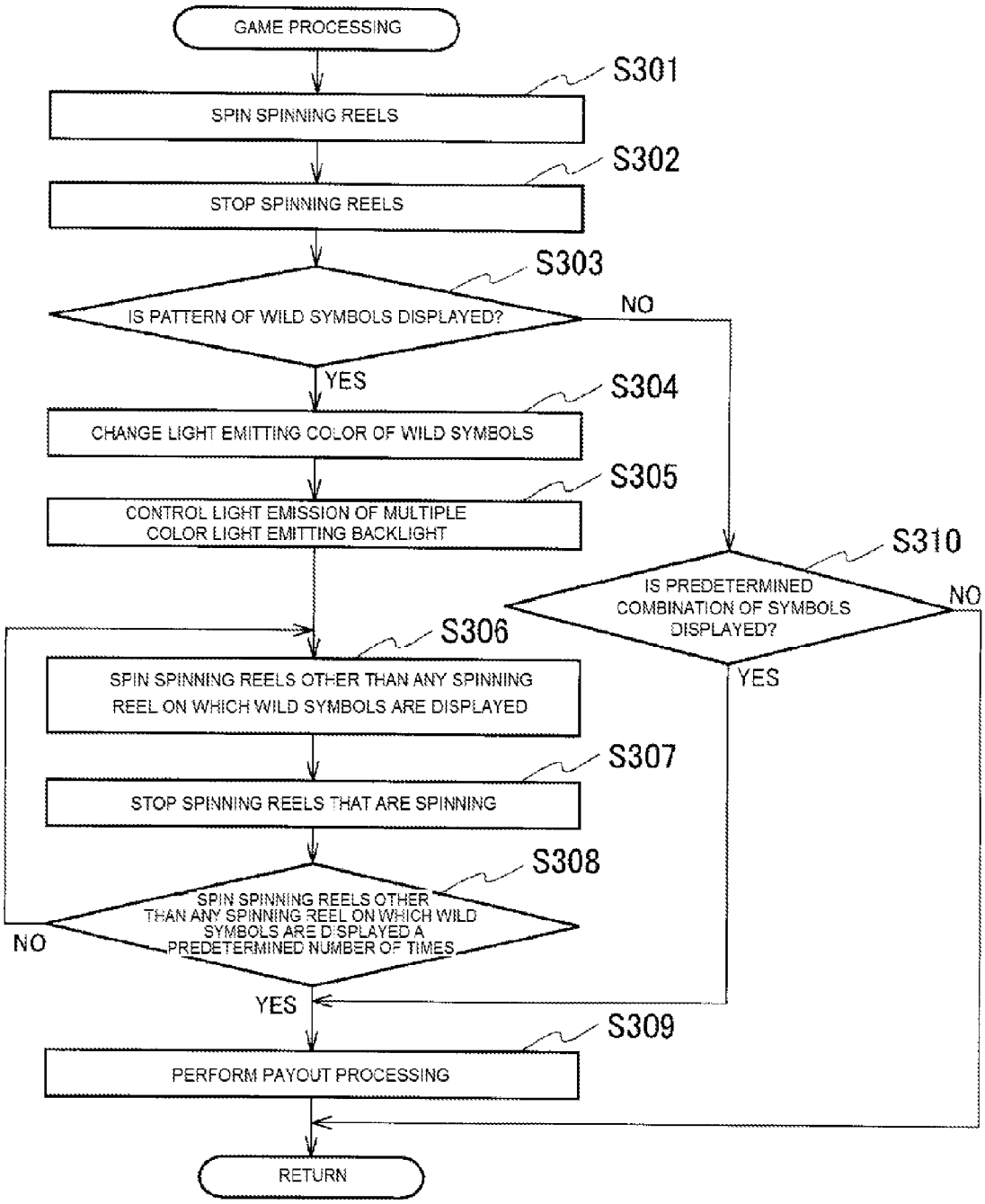
FIG. 25 is a view illustrating a flowchart of the game processing for the gaming machine according to the second embodiment of the present invention.

Next, with reference to FIG. 25 to FIG. 28, the gaming machine 1 according to the second embodiment of the present invention will be described. First, character of game processing of the game machine 1 according to the second embodiment of the present invention is described referring to FIG. 25. FIG. 25 is flowchart showing character of game processing concerning the second embodiment of the present invention.

As shown in FIG. 25, the main CPU 71 executes a basic game in which symbols are scroll-displayed in the symbol display area 4 by spinning the spinning reels 3 (3*a* to 3*e*), and then, the spinning reels 3 (3*a* to 3*e*) are stopped, whereby the symbols spinning are stop-displayed in the symbol display area 4 (step S301, step S302).

Next, the main CPU 71 determines whether or not a pattern of wild symbols has been displayed in the symbol display area 4 in step S302 (step S303).

Herein, the wild symbol is referred to as a symbol which are allowed to be substituted by another symbol (for example, a wild symbol (WILD) 250 to be described later with reference to FIG. 26A). In addition, a pattern of wild symbols is referred to as a case in which there exists a spinning reel on which all of the symbols that are displayed in the symbol display area 4 are wild symbols (for example, a case in which three wild symbols (WILD) 250 to be described later with reference to FIG. 26A are continuously displayed in a columnar direction in the symbol display area 4).

In a case where the main CPU 71 determines that a pattern of wild symbols is displayed in the symbol display area 4, based on a result of the judgment in step S303, the main CPU 71 causes the routine to migrate from a basic game to a second game and then changes a light emitting color of wild symbols (step S304).

With respect to changing the light emitting color, for example, in a case where the light emitting color of symbols including a wild symbol is specified as white (a first color) in a basic game, when the routine migrates to the second game, the light emitting color of a respective one of the wild symbols is changed to red (a second color).

Next, the main CPU 71 controls light emission of the multiple color light emitting backlight 5, with the light emitting color that is obtained by changing, in step S304, the light emitting color exerted by the multiple color light emitting backlight 5 at the back side of a respective one of the wild symbols that are displayed in the symbol display area 4 (step S305).

Next, the main CPU 71 executes a second game in which another spinning reel is spun in a state in which a spinning reel having a wild symbol displayed thereon is stopped, and after a predetermined period of time has elapsed, the spinning reel is stopped, whereby symbols are stop-displayed in the symbol display area 4 (step S306, step S307).

Next, the main CPU 71 determines whether or not a spinning reel other than the one having a wild symbol displayed thereon has been spun a predetermined number of times (whether or not the processing operations in step S306 and step S307 have been repeated a predetermined number of times), and then, the main CPU 71 pays out a payment that corresponds to a combination of symbols including the wild symbol, based on a result of the judgment (step S308, step S309).

On the other hand, in a case where the main CPU 71 determines that a pattern of wild symbols has not been displayed in the symbol display area 4 in step S303, the main CPU 71 determines whether or not the symbols that are displayed in the symbol display area 4 form a predetermined combination, and then, the main CPU 71 pays out a payment that corresponds to the combination of the symbols, based on a result of the judgment (step S309, step S310).

After the payment has been paid out, the light emitting color is returned to the illumination color before changed in step S304. For example, the illumination color that has been changed to red (the second color) when the routine migrates to the second game is changed to white (the first color) before starting the basic game.

As described above, in the second game, in a state in which spinning of the spinning reels on which wild symbols have been displayed in all of the symbol display area 4 in the basic game, another spinning reel is spun and stopped, and then, a payment is paid out. The color that is produced by illuminating a respective one of the wild symbols from the back side by means of the multiple color light emitting backlights 5 is changed to a color which is different from the one illuminated in the basic game. Thus, with respect to all of the spinning reels of which spinning is stopped, it becomes possible to display wild symbols which are allowed to be substituted by other symbols in a easily visually recognizable manner.

In addition, it becomes possible to display the fact that a payment can be easily obtained by wild symbols which are allowed to be substituted by other symbols, by changing the color that is produced by illuminating a respective one of the wild symbols by means of the multiple color light emitting backlight 5.

Therefore, there can be provided a gaming machine which is capable of diversifying the display mode of symbols by means of the spinning reels 3 (3*a* to 3*e*).

The description of features of game processing according to the second embodiment of the present invention has now been completed. Next, with reference to FIGS. 26A and 26B and FIGS. 27A and 27B, a description will be given with respect to a display example of the lower image display panel 141 in the gaming machine 1 according to the second embodiment of the present invention.

Figure 26B:
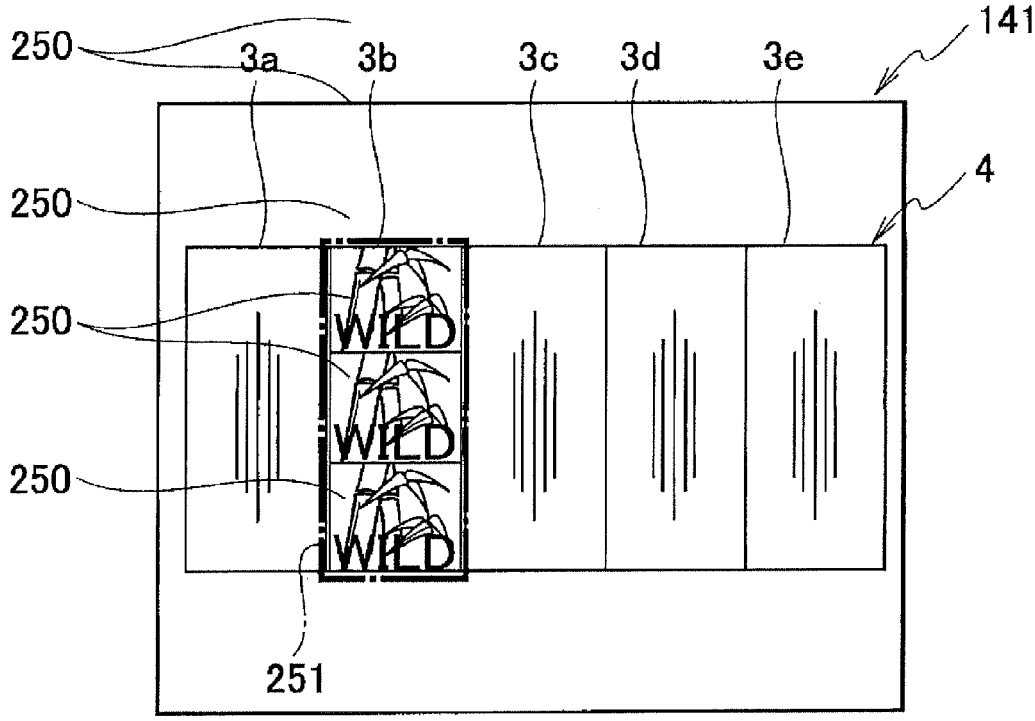

FIG. 26A shows a display example of a case in which a pattern of wild symbols is displayed in the lower image display panel 141 while a basic game is executed. FIG. 26B shows a display example of a case in which a spinning reel other than the one having a wild symbol displayed thereon has been spun.

Figure 27A:
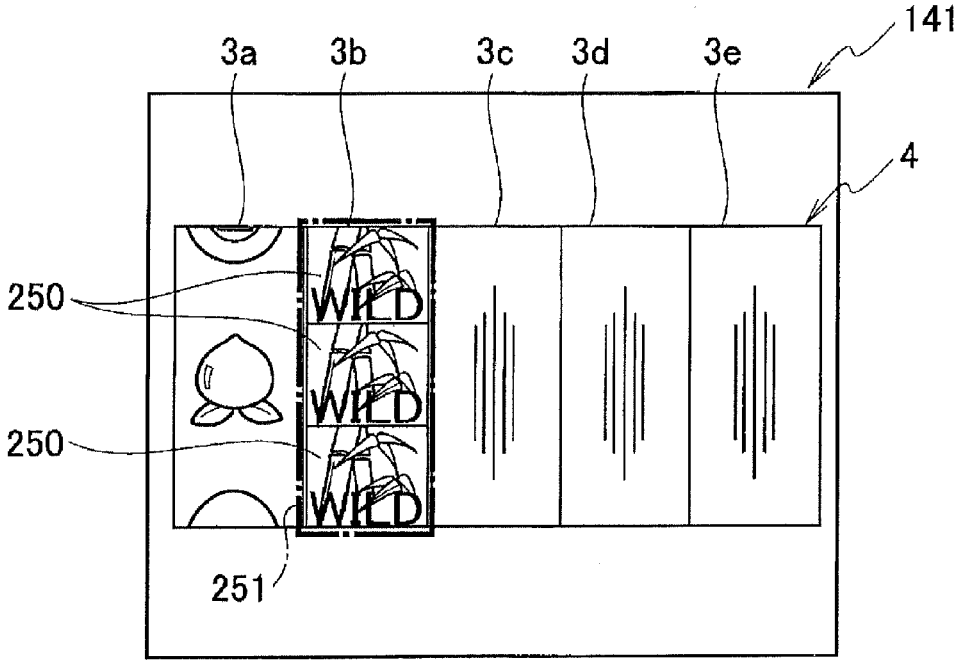
FIGS. 27A and 27B are views illustrating an exemplary display of the gaming machine according to the second embodiment of the present invention.
Figure 27B:
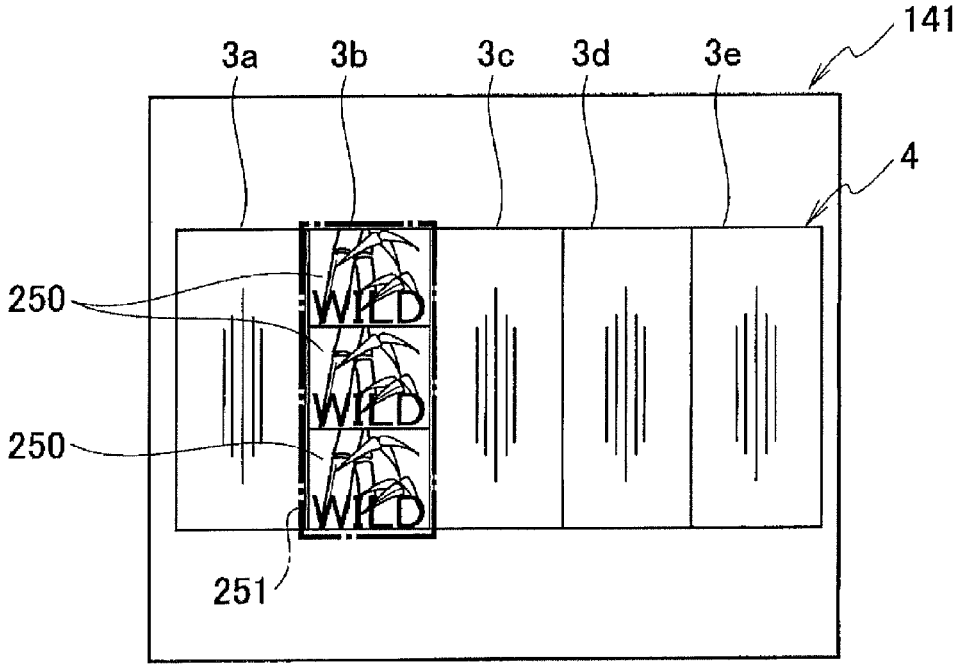

In addition, FIG. 27A shows a display example of a case in which a spinning reel having spun while a second game is executed has stopped. FIG. 27B shows a display example of a case in which a spinning reel other than the one having a wild symbol displayed thereon has been spun.

As shown in FIG. 26A, when a basic game is started, symbols are scroll-displayed in the symbol display area 4 of the lower image display panel 141 by spinning the spinning reels 3 (3*a* to 3*e*), and after a predetermined period of time has elapsed, the spinning symbols are stop-displayed in the symbol display area 4 by stopping the spinning reels 3 (3*a* to 3*e*).

In the basic game, since the light emitting color of the multiple color light emitting backlight 5 is specified as white (the first color), the multiple color light emitting backlight 5 emits light in "white" and then illuminates the symbols that are displayed in the symbol display area 4 individually from the back side.

In a case where the symbols that are displayed in the symbol display area 4 form a predetermined combination (in a case where three or more symbols of same kind are displayed), a payout that corresponds to the combination of the symbols is paid out.

As shown in FIG. 26A, in a case where there is a spinning reel on which all of the symbols that are displayed in the symbol display area 4 of the lower image display panel 141 are wild symbols (WILD) 250 while in a basic game (in a case where there is a spinning reel on which three WILD 250 symbols are continuously displayed in a columnar direction), the routine is caused to migrate from the basic game to a second game. Herein, a description will be given with respect to a case in which a spinning reel on which all of the symbols that are displayed in the symbol display area 4 is wild symbols 250 is a spinning reel 3*b*.

In a case where a pattern of wild symbols 250 is displayed in the symbol display area 4 (e.g., in a case where three WILD 250 symbols are continuously displayed in a columnar direction), a display area 251 surrounding the wild symbols 150 symbols may be displayed at a relatively high luminous intensity by controlling the multiple color light emitting backlight 5. In this case, it becomes possible to easily recognize that symbols serving as a trigger for causing the routine to migrate from a basic game to a second game (a pattern of WILD 250) have been displayed.

As shown in FIG. 26A, if three wild symbols 250 are continuously displayed in a columnar direction in the symbol display area 4 by means of the spinning reel 3*b* on which all of the symbols that are displayed in the symbol display area 4 are wild symbols 250 (if a pattern of wild symbols 250 is displayed), the multiple color light emitting backlight 5 emits light in "red" and then illuminates the wild symbols 250 that are displayed in the symbol display area 4, so that the display area 251 surrounding the wild symbols 250 is displayed in red.

Namely, while in the basic game, since the multiple color light emitting backlight 5 is controlled to illuminate the wild symbols 250 from the back side in white, the background of the wild symbols 250 is white.

On the other hand, when the routine migrates to the second game, since the multiple color light emitting backlight 5 is controlled to illuminate the wild symbols 250 from the back side with a color other than white, the background of the wild symbols 250 becomes the color other than white.

Thus, in a case where a spinning reel on which all of the symbols that are displayed in the symbol display area 4 are wild symbols 250 is a spinning reel 3*b*, the display area 251 surrounding the wild symbols 250 is emitted with light in red (the second color) by controlling the multiple color light emitting backlight 5, and then, the background of the wild symbols 250 is displayed in red (the second color).

As shown in FIG. 26B, if the background of the wild symbols 250 is displayed in red, in a state in which spinning of the spinning reel 3*b* on which wild symbols 250 are displayed in all of the symbol display area 4 in a basic game has been stopped, symbols are scroll-displayed by spinning other spinning reels 3*a*, 3*c*, 3*d*, 3*e*.

As shown in FIG. 27A, after other spinning reels 3*a*, 3*c*, 3*d*, 3*e* have been spun, spinning varies to a speed which is lower than the spinning speed of the spinning reels 3 (3*a* to 3*e*) in the case of the basic game, and then, spinning is stopped in sequential order from the spinning reel 3*a* to spinning reel 3*c*, and then, spinning reels 3*d*, 3*e*.

Further, in a case where symbols with high payment are stop-displayed in the symbol display area 4 by stopping spinning of the spinning reels 3*a*, 3*c*, 3*d*, 3*e*, the multiple color light emitting backlight 5 blinks or illuminates and then emits light in a color other than white or red from the back side of the symbols with high payment.

In a case where there are a plurality of spinning reels on which all of the symbols that are displayed in the symbol display area 4 are wild symbols 250, another spinning reel is spun and stopped in a state in which the plurality of spinning reels are stopped.

Then, spinning of the spinning reels 3*a*, 3*c*, 3*d*, 3*e* stops, and in a case where a combination of symbols including the wild symbols 250 stop-displayed in the symbol display area 4 is a predetermined combination, a payment is paid out.

Namely, since the wild symbols 250 are symbols which are allowed to be substituted by other symbols, in a case where three symbols of same kind are displayed in the symbol display area 4, three wild symbols 250 are also displayed in the symbol display area 4; and therefore, a payment is paid out assuming that six symbols of same kind have been displayed.

As shown in FIG. 27B, spinning and stopping of the spinning reels 3*a*, 3*c*, 3*d*, 3*e* are not executed a predetermined number of times, symbols are scroll-displayed by spinning other spinning reels 3*a*, 3*c*, 3*d*, 3*e* in a state in which spinning of the spinning reel 3*b* on which wild symbols (WILD) 250 are displayed again in all of the symbol display area 4 in a basic game has been stopped.

The description of the display examples of the upper image display panel 131 and the lower image display panel 141 has now been completed.

The processing operations that are conducted by the main CPU 71 of the gaming machine 1 according to the second embodiment, described above, are almost identical to those which are conducted by the main CPU 71 of the gaming machine 1 according to the first embodiment. In addition, in the gaming machine 1 according to the second embodiment, a second game trigger is changed to three continuous displays of the wild symbols 250.

In addition, the main CPU 71 of the gaming machine 1 according to the second embodiment, conducts processing operations of which contents are different from those of the flowchart shown in FIG. 23, in the second game processing in step S20 of FIG. 15.

Next, with reference to FIG. 28, a description will be given with respect to the second game processing to be conducted by the main CPU 71 in the gaming machine 1 according to the second embodiment of the present invention.

Figure 28:
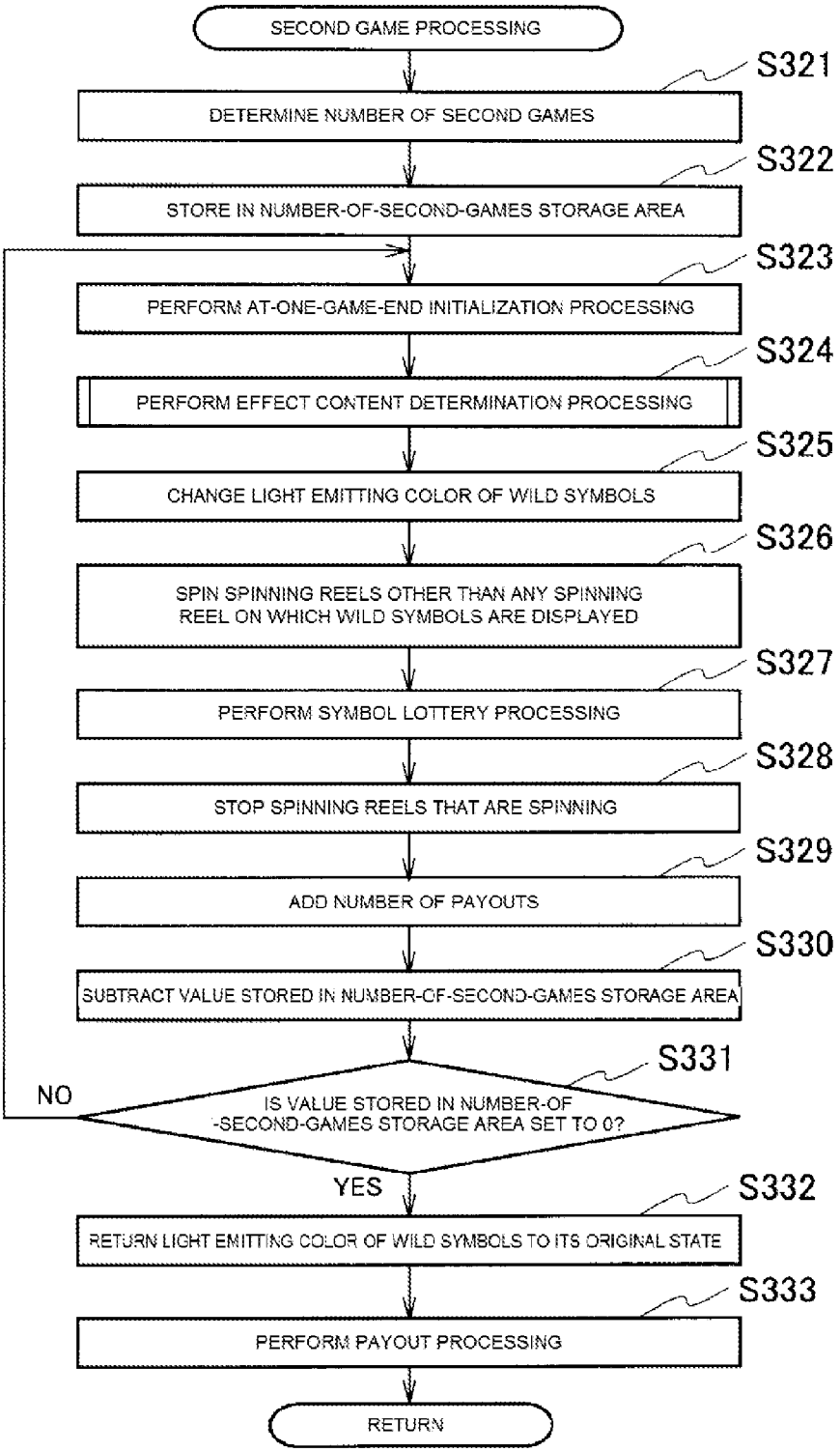
FIG. 28 is a view illustrating a flowchart of a second game processing for the gaming machine according to the second embodiment of the present invention.

FIG. 28 is a view illustrating a flowchart of a second game processing for the gaming machine 1 according to the second embodiment of the present invention.

The main CPU 71 first determines the number of second games (step S321). A predetermined number of times may be determined as the number of second games. In addition, random number values for determining the number of second games are extracted, and then, any one of plural numbers of second games such as "2", "3", and "5", for example, may be determined by means of lottery.

Next, the main CPU 71 stores the determined number of second games into a number-of-second-games storage area provided in the RAM 73 (step S322).

The main CPU 71 then conducts at-one-game-end initialization processing in the same way as the processing of step S12 described with reference to FIG. 15 (step S323). Then, the main CPU 71 conducts the effect contents determination processing in the same way as the processing of step S16 described with reference to FIG. 15 (step S324).

Next, the main CPU 71 changes the light emitting color of the multiple color light emitting backlight 5 at the back side of a respective one of wild symbols 250 (step S325). In changing the light emitting color, for example, in a case where the light emitting color of the symbols including the wild symbols 250 is specified as white (the first color) in a basic game, when the routine migrates to a second game, the light emitting color of the wild symbols is changed to red (the second color) (refer to FIG. 26A).

If the light emitting color of a respective one of the wild symbols is changed, light emission of the multiple color light emitting backlight 5 is controlled in the light emitting color (red color) that has been changed by means of the multiple color light emitting backlight 5 at the back side of a respective one of the wild symbols that are displayed in the symbol display area 4.

Namely, the main CPU 71 controls light emission of the multiple color light emitting backlight 5, thereby illuminating the wild symbols 250 displayed in the symbol display area 4 of the lower image display panel 141 from the back side in the changed light emitting color (red).

Next, the main CPU 71 controls the spinning reels 3 (3*a* to 3*e*) by means of a reel control portion 120 (refer to FIG. 7), and then, spins other spinning reels in a state in which the spinning reels having the wild symbols 250 displayed thereon are stopped (step S326).

Namely, other spinning reels are spun in a state in which spinning of the spinning reels on which all of the symbols that are displayed in the symbol display area 4 are wild symbols 250 in a basic game (on which three WILD 250 are continuously displayed in a columnar direction) have been stopped (refer to FIG. 26B and FIG. 27B).

For example, in a case where a spinning reel on which all of the symbols that are displayed in the symbol display area 4 are wild symbols 250 (on which three WILD 250 are continuously displayed in a columnar direction) is the spinning reel 3*b*, symbols are scroll-displayed by spinning other spinning reels 3*a*, 3*c*, 3*d*, 3*e*.

Spinning of the spinning reels other than the one having the wild symbols 250 displayed thereon is changed to a speed which is lower than the spinning speed of the spinning reels 3 (3*a* to 3*e*) in the case of a basic game, by means of the reel control portion 120 (refer to FIG. 7).

Next, the main CPU 71 conducts symbol lottery processing (step S327). In this process, to-be-stopped symbols are determined for spinning reels other than the one on which all of the wild symbols 250 have been displayed.

In the symbol lottery processing, the to-be-stopped symbols may be determined based on the random number values for determining symbols for the second game, by employing a table in which random numbers are specified so that there is a relatively higher possibility of awarding a winning prize than that in the basic game.

Next, the main CPU 71 controls the spinning reels 3 (3*a* to 3*e*) by means of the reel control portion 120 (refer to FIG. 7), and then, stops spinning reels other than the one on which the wild symbols 250 have been displayed (step S328).

The spinning reels other than the one on which the wild symbols 250 have been displayed are stopped in sequential order of spinning reels 3*a*, 3*c*, 3*d*, 3*e* by means of the reel control portion 120 (refer to FIG. 7) in a case where the spinning reel on which all of the symbols that are displayed in the symbol display area 4 are wild symbols 250 is the spinning reel 3*b* (refer to FIG. 27A).

Namely, in the basic game, the spinning reels 3 (3*a* to 3*e*) stop spinning simultaneously, whereas in the second game, spinning is stopped in sequential order from the left side spinning reel to the right side spinning reel.

Next, the main CPU 71 cumulatively adds the number of payouts (payment) that corresponds to a combination of symbols including wild symbols in a payout storage area (step S329).

Next, the main CPU 71 subtracts 1 from a value stored in the number-of-second-games storage area (step S330).

Next, the main CPU 71 determines whether or not the value stored in the number-of-second-games storage area is set to 0 (step S331). When the main CPU 71 determines that the value stored in the number-of-second-games storage area is not set to 0 (step S331: NO), the routine reverts to step S323.

On the other hand, when it is determined that the value stored in the number-of-second-games storage area is set to 0 (step S331: YES), the light emitting color of the multiple color light emitting backlight 5 at the back side of a respective one of the wild symbols 250 is returned to a light emitting color (white) before changed in step S325. For example, when the routine migrates to the second game, the light emitting color that has been changed to red (the second color) is changed to the light emitting color in white (the first color) when a basic game is started.

Next, the main CPU 71 conducts payout processing of paying out a payment that corresponds to a combination of symbols including wild symbols 250 which have cumulatively added in the payout storage area in step S330 (step S333). When this process is conducted, the second game processing is completed. When the second game processing is completed, the routine reverts to step S21 described with reference to FIG. 15.

In this way, in the second game, a payment is paid out by spinning and then stopping other spinning reels, in a state in which the spinning reels having the wild symbols 250 displayed in all of the symbol display area 4 in the basic game have been stopped. The color that is produced by illuminating a respective one of the wild symbols 250 from the back side by means of the multiple color light emitting backlight 5 is changed to a color (the second color) which is different from the color (the first color) that is produced by the illumination in the basic game. Thus, it becomes possible to easily visually recognize that all of symbols in an illumination color different from another one (which are illuminated in the second color) are wild symbols 250 which are allowed to be substituted by other symbols.

In addition, it becomes possible to display the fact that a payment can be easily obtained by wild symbols which are allowed to be substituted by other symbols, by changing the color that is produced by illuminating a respective one of the wild symbols 250 from the back side by means of the multiple color light emitting backlight 5.

Further, in a case where the second game has been completed, the light emitting color (the second color) of the multiple color light emitting backlight 5 at the back side of a respective one of the wild symbols 250 is returned to the light emitting color (the first color) before changed. Thus, it becomes possible to recognize that a game state has migrated from the second game to the basic game, by visually recognizing the color of a respective one of the wild symbols 250. Therefore, the display mode of symbols can be diversified and then the game state can be clearly grasped.

Therefore, there can be provided a gaming machine which is capable of diversifying the display mode of symbols by means of the spinning reels 3 (3*a* to 3*e*).

In this manner, A gaming machine 1 according to the second embodiment of the present invention, comprising:

a plurality of spinning reels 3 (3*a* to 3*e*) having symbols arranged on peripheral face thereof;

a lower image display (a symbol display window) 141 having a symbol display area 4 in which symbols are scroll-displayed by spinning of the spinning reels 3 (3*a* to 3*e*) and the spinning symbols are stop-displayed by stoppage of the spinning reels 3 (3*a* to 3*e*);

a multiple color light emitting backlight 5 which is configured to individually illuminate a respective one of the symbols that are displayed in the symbol display area 4 from a back side; and a main CPU (a controller) 71 which is configured to migrate from the basic game to a second game to be executed in accordance with a second game program, in a case where there is the spinning reel on which all of the symbols that are displayed in the symbol display area 4 are wild symbols 250 which are allowed to be substituted by another symbols, in the basic game to be executed in accordance with the basic game program;

in the second game, the main CPU 71 executing processing operations of:

(a) with respect to the spinning reel on which all of the symbols that are displayed in the symbol display area 4 are the wild symbols 250 in the basic game, changing a color, which is produced to illuminate a respective one of the wild symbols 350 from a back side by means of the multiple color light emitting backlight 5, to a second color which is different from a first color which is produced to illuminate in the basic game (processing of step S325 in FIG. 28);

(b) in a state in which the spinning reel on which the wild symbols 250 are displayed in all of the symbol display area is stopped in the basic game, spinning and stopping another spinning reel and then paying out a payment in accordance with a combination of the symbols that are displayed in the symbol display area 4 (processing of step S323 to step S331, step S333 in FIG. 28);

(c) executing the processing of step S323 to step S331 a predetermined number of times; and (d) Subsequent to executing the processing in the predetermined number of times in step S323 to step S331, completing the second game program, and then, upon starting a basic game in accordance with the basic game program, changing to the first color, the second color which is produced to illuminate wild symbols 250 which are displayed in the symbol display window 4 by means of the spinning reels which are held in a stopped state in the second game (processing of step S332 in FIG. 28).

Further the gaming machine 1 according to the second embodiment of the present invention, wherein:

the multiple color light emitting backlight 5 has a respective one of shading portions 6 (6*a* to 6*e*) which are provided for a plurality of spinning reels 3 (3*a* to 3*e*) (refer to FIG. 6); and the respective one of the shading portions 6 (6*a* to 6*d*) is configured to shade light in a respective one of partition areas 7 which are partitioned in order to individually emit the light to a respective one of the symbols that are displayed in the symbol display area 4, so that all of the symbols that are displayed in the symbol display area 4 are allowed to be displayed by means of the multiple color light emitting backlight 5 in a color variable manner.

Furthermore a method of controlling a gaming machine 1 according to the second embodiment of the present invention, which comprises a main CPU (a controller) 71, the main CPU 71 being configured to migrate from a basic game to a second game to be executed in accordance with a second game program in a case where there is a spinning reel on which all of symbols displayed in a symbol display area 4 in which the symbols are stop-displayed by stoppage of a plurality of spinning reels 3 (3*a* to 3*e*) having the symbols arranged on peripheral faces are wild symbols 250 which are allowed to be substituted by other symbols, said control method comprising the steps of:

(a) with respect to the spinning reel on which all of the symbols that are displayed in the symbol display area 4 are the wild symbols 250 in the basic game, changing a color, which is produced to illuminate a respective one of the wild symbols 350 from a back side by means of the multiple color light emitting backlight 5, to a second color which is different from a first color which is produced to illuminate in the basic game (processing of step S325 in FIG. 28);

(b) in a state in which the spinning reel on which the wild symbols 250 are displayed in all of the symbol display area 4 is stopped in the basic game, spinning and stopping another spinning reel and then paying out a payment in accordance with a combination of the symbols that are displayed in the symbol display area 4 (processing of step S323 to step S331, step S333 in FIG. 28);

(c) executing the processing of step S323 to step S331 a predetermined number of times; and (d) Subsequent to executing the processing in the predetermined number of times in step S323 to step S331, completing the second game program, and then, upon starting a basic game in accordance with the basic game program, changing to the first color, the second color which is produced to illuminate wild symbols 250 which are displayed in the symbol display window 4 by means of the spinning reels which are held in a stopped state in the second game (processing of S332 in FIG. 28).

In addition, with the gaming machine 1 according to the second embodiment of the present invention, in the second game, a payment is paid out by spinning and stopping other spinning reels in a state in which a spinning reel on which wild symbols 250 are displayed in the whole symbol display area 4 in the basic game has been stopped. The color that is produced by illuminating a respective one of the wild symbols 250 from the back side by means of the multiple color light emitting backlight 5, is changed to a color (the second color) which is different from a color (the first color) which is illuminated in the basic game. Thus, it becomes possible to easily visually recognize that the all of the spinning reels of which spinning is stopped are wild symbols which are allowed to be substituted by other symbols.

In addition, it becomes possible to display the fact that a payment can be easily obtained by the wild symbols 250 that are substituted by other symbols, by changing the color that is produced by illuminating a respective one of the wild symbols 250 from the back side by means of the multiple light emitting backlight 5.

Further, in a case where the second game has completed, the light emitting color (the second color) of the multiple light emitting backlight 5 at the back side of a respective one of the wild symbols 250 is returned to the light emitting color (the first color) before changed. Thus, by visually recognizing the color of a respective one of the wild symbols 250, it becomes possible to recognize that a game state has migrated from the second game to the basic game. Therefore, the display mode of the symbols can be diversified and then the game state can be clearly grasped.

Accordingly, there can be provided a gaming machine which is capable of diversifying the display mode of symbols by means of the spinning reels.

In addition, in the second game, in a case where the number of spinning reels in the basic game is N (for example, five), if M (for example, two) spinning reels are configured to hold a state of stopping the spinning reels on which all of the symbols that are displayed in the symbol display area 4 are wild symbols 250, the second game is a game in which N-M spinning reels are spun. In a case where the symbol display area 4 is visually recognized, since all of the stopping reels are wild symbols which are allowed to be substituted by other symbols, it becomes possible to display the fact that a payment can be easily obtained.

Namely, while, in the conventional video reels, the number of reels can be easily increased or decreased since video reels may be increased or decreased, it has been almost impossible to increase or decrease spinning reels. However, the gaming machine 1 according to the second embodiment of the present invention is substantially capable of executing a game in which the number of reels has been changed according to the basic game and the second game.

In addition, with the gaming machine 1 according to the second embodiment of the present invention, the multiple color light emitting backlights 5 have the shading portions 6 (6*a* to 6*d*) that are provided for a respective one of the spinning reels 3 (3*a* to 3*e*), for shading light relative to a respective one of the partition areas 7 that are partitioned in order to emit the light individually from the back side for a respective one of the symbols. Thus, it becomes possible to prevent an illumination color from being changed from a target color by being illuminated by the illumination light from the peripheral symbols.

In addition, the LED 8 that is arranged in a respective one of the partition areas 4 in which light has been shaded by means of the shading portions 6 (6*a* to 6*e*) is caused to emit light, whereby the light does not leak into another partition area, so that predetermined symbols are produced in a highlighted manner by individually changing colors on a symbol-by-symbol basis.

The color of a respective one of the wild symbols 250 is displayed in a highlighted manner in a color which is different from that of another symbol, whereby the state of a game currently executed can be notified, thus making it possible to clarify the contents of the game played.

Next, a modification example according to the second embodiment of the present invention will be described with reference to the drawings. The second embodiment described a case of changing the light emitting color to red (the second color) when the routine has migrated to the second game in the case where the light emitting color of the multiple color light emitting backlight 5 at the back side of a respective one of the wild symbols 250 is white (the first color) in the basic game, whereas in the modification example according to the second embodiment of the present invention, a light emitting color is determined at random (by means of random number lottery) from among a plurality of light emitting colors (a plurality of second colors).

With reference to FIG. 29, a description will be given with respect to a light emitting color change data table to be referred to, in a case where any one is determined and changed from a plurality of light emitting colors of multiple color light emitting backlights at the back sides of wild symbols.

The light emitting color change data table is stored in the memory card 54, and when acquisition processing is started by means of the main CPU 71, the table is stored in the RAM 73 (refer to FIG. 7).

The illumination color change data table specifies: a plurality of identification numbers relative to wild symbols 250; light emitting colors by means of the multiple color light emitting backlights 5; and the number of times of the second games played.

The illumination color change data table is employed to determine the number of the game of the second game and, determine light emitting colors by means of the multiple color light backlights 5 in a case where wild symbols 250 are illuminated from the back side by means of the multiple color light emitting backlights 5.

In the illumination color change data table, a plurality of identification numbers are specified for wild symbols 250, and the light emitting color exerted by the multiple color light emitting backlight 5 is specified for a respective one of the identification numbers.

Specifically, "yellow" is specified for an identification number "0021"; "blue" is specified for an identification number "0022"; and "red" is specified for an identification number "0023". In addition, the number of times of the second game is specified for a respective one of the identification numbers, and "two times" is specified for the identification number "0021"; "three times" is specified for the identification number "0022"; and "five times" is specified for the identification number "0023".

For example, random number values for determining the number of second games are extracted, and in a case where the identification number "0022" is determined, "three times" is determined as the number of time of the second game, the multiple light emitting backlight 5 emits light in "blue" and then illuminates a respective one of the wild symbols 250 from the back side.

The thus specified illumination color change data table is referred to when the number of second games is determined in the processing of step S321 in FIG. 29 that has been described in the second embodiment; and in the processing of step S325 in FIG. 29, the light emitting color of the multiple color light emitting backlight 5 is changed to a light emitting color that corresponds to the number of second games determined in the processing of step S321.

In this way, with respect to the wild symbols 250 that are displayed in the symbol display area 4, a payment is given in association with the numeric value (the number of games) that is obtained by referring to the light emitting color change data table (table data) specifying the light emitting colors for illuminating the back side and the number of games that corresponds to the light emitting color (the obtained payment of the number of games is cumulatively added, and the payment is given after the game has been completed). Thus, the number of second games can be recognized by visually recognizing the color of a respective one of the wild symbols 250 that are displayed in the symbol display area 4.

In this way, a gaming machine 1 according to modification example of the second embodiment of the present invention, comprising:

a plurality of spinning reels 3 (3*a* to 3*e*) having symbols arranged on peripheral faces thereof;

a lower image display panel (a symbol display window) 141 having a symbol display area 4 in which symbols are scroll-displayed by spinning of the spinning reels 3 (3*a* to 3*e*) and are stop-displayed by stoppage of the spinning reels 3 (3*a* to 3*e*);

a multiple color light emitting backlight 5 having a shading portion 6 (6*a* to 6*d*) which is provided for a respective one of a plurality of spinning reels 3 (3*a* to 3*e*), the backlight 5 being configured to shade light in a respective one of partition areas 7 which are partitioned in order to individually emit the light from a back side to a respective one of the symbols that are displayed in the symbol display area 4 so that all of the symbols that are displayed in the symbol display area 4 are allowed to be displayed individually in a color changeable manner;

a memory card 54, a ROM 72 (a memory) which is configured to store table data (see FIG. 10) for associating a plurality of numeric values with one symbol in accordance with a combination of the symbols and a plurality of colors of the light beams to be emitted from the back side; and a main CPU 71 (a controller) which is configured to: randomly determine a light emitting color of the multiple color light emitting backlight 5 after symbols are stop-displayed in the symbol display area 4; refer to the table data (see FIG. 10) that is stored in the memory card 54, ROM 72 in accordance with the light emitting color that is determined to illuminate a respective one of the symbols that are displayed in the symbol display area 4 and the back side thereof; and give a payment in association with the numeric values that are obtained by means of the table data.

In addition, with the gaming machine 1 according to the modification example of the second embodiment, with respect to the wild symbols 250 that are displayed in the symbol display area 4, a payment is given in association with the numeric value (the number of games) that is obtained by referring to the light emitting color change data table (table data) having specified the light emitting colors for illuminating the back side and the number of games that corresponds to the light emitting color (the obtained payment of the number of games is cumulatively added, and the payment is given after the game has been completed). Thus, the number of second games can be recognized by visually recognizing the color of a respective one of the wild symbols 250 that are displayed in the symbol display area 4. Therefore, there can be provided a gaming machine which is capable of diversifying the display mode of symbols by means of the spinning reels 3 (3*a* to 3*e*).

Next, a gaming machine 1 according to a third embodiment of the present invention will be described in detail with reference to the drawings.

The gaming machine 1 according to the third embodiment has an appearance, circuitry, and the like that are substantially the same as those of the gaming machine 1 according to the first embodiment. Thus, a duplicated explanation is omitted here. In addition, like constituent elements of the gaming machine 1 according to the first embodiment are designated by like reference numerals, and a further description will be given.

A gaming machine 1 according to the third embodiment of the present invention, comprising:

a plurality of spinning reels having symbols arranged on peripheral faces thereof;

a symbol display window having a symbol display area in which symbols are scroll-displayed by spinning of the spinning reels and the spinning symbols are stop-displayed by stoppage of the spinning reels;

a display which is arranged at an upper part of the symbol display window, for displaying a video image;

a controller which is configured to shift from a basic game to a second game in a case where a pattern of specific symbols is displayed in the symbol display area, wherein in the second game, the controller executing processing operations of:

(a) displays on the display, a plurality of squares to which prizes are assigned, respectively, are arranged to be continuous in the chain shape at the start point, (b) executes the second game which is spinning and stopping the spinning reels, (c) determine as a payment relative to the second game, the prize that is assigned to the square as the movement destination moved in a direction from start point to the goal points of the plurality of squares by the number of squares that corresponds to the number of specific symbols that are displayed in the symbol display window in the second game, (d) executes the number of times decided on the (c) processing, and (e) executes the payout of the payment determined in the (c) processing.

The gaming machine 1 according to the third embodiment of the present invention, comprising:

a plurality of spinning reels 3 (3*a* to 3*e*) having symbols arranged on peripheral faces thereof;

a lower image display (a symbol display window) 141 having a symbol display area 4 in which symbols are scroll-displayed by spinning of the spinning reels 3 (3*a* to 3*e*) and the spinning symbols are stop-displayed by stoppage of the spinning reels 3 (3*a* to 3*e*); and an upper image display panel (a display) 131 which is arranged at an upper part of the lower image display panel 141, for displaying a video image (see FIG. 4).

Further the gaming machine 1 according to the third embodiment of the present invention including a main CPU (a controller, refer to FIG. 7) 71 which is configured to start a second game in a case where a pattern of specific symbols serving as a trigger for migrating from a basic game to a second game is displayed in the symbol display area 4.

The gaming machine 1 according to the third embodiment of the present invention executes, as a second game, a dice game in which a piece moves on a dice game board on which a plurality of squares are provided.

A dice game is a game in which a piece is moved from a start point toward goal points on a plurality of squares which are continued in a chain shape at the start point. The number of moving pieces can be defined according to a result of a second game, as described later.

Figure 30:
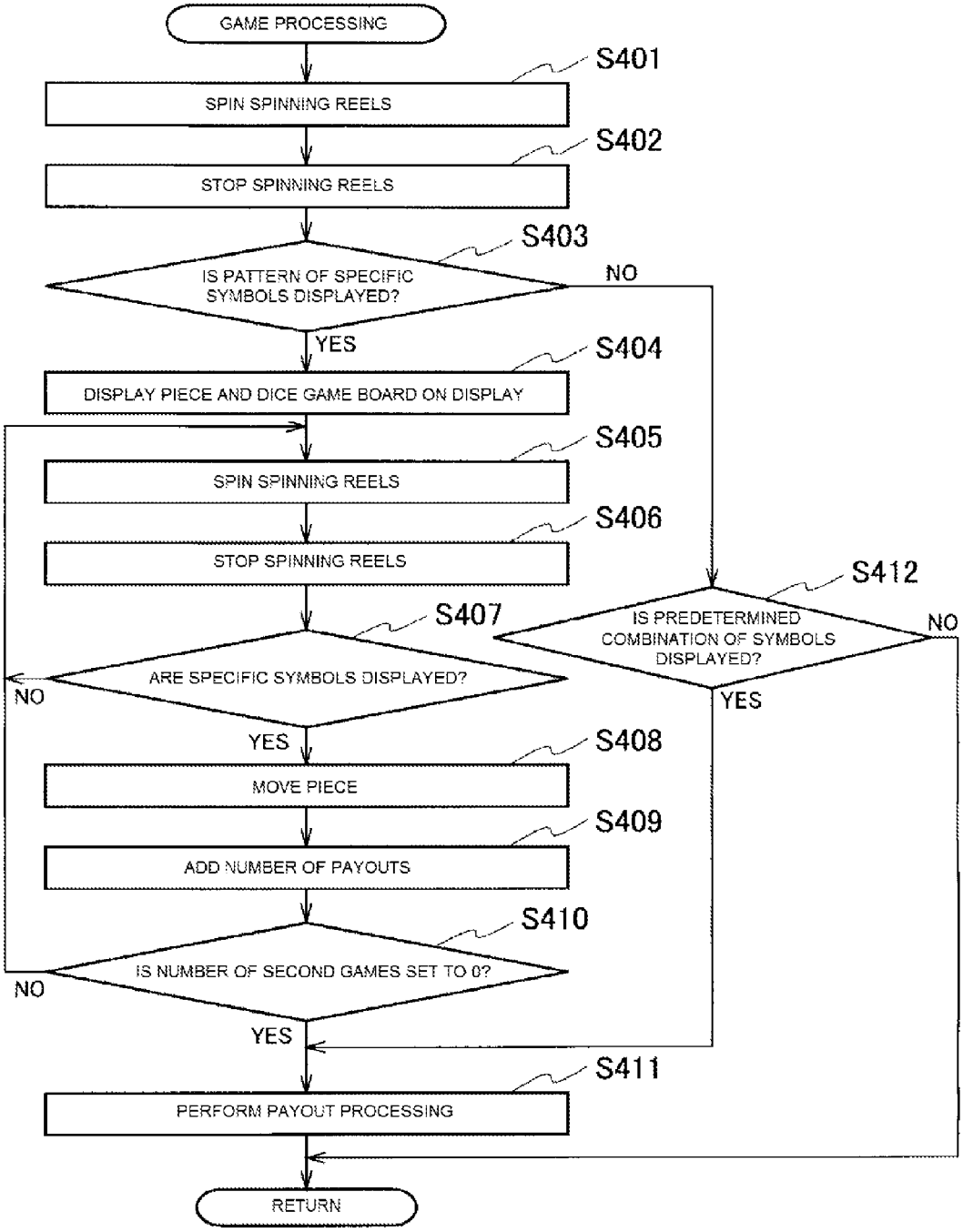
FIG. 30 is a view illustrating a flowchart of the game processing for the gaming machine according to the third embodiment of the present invention.

Next, with reference to FIG. 30 to FIG. 35, the gaming machine 1 according to the third embodiment of the present invention will be described. First, with reference to FIG. 30, features of game processing in the gaming machine 1 according to the third embodiment of the present invention will be described. FIG. 30 is a flowchart showing the features of the game processing according to the third embodiment of the present invention.

As shown in FIG. 30, the main CPU 71 executes a basic game in which symbols are stop-displayed in the symbol display area 4 by stopping the spinning reels 3 (3*a* to 3*e*) after the symbols have been scroll-displayed in the symbol display area 4 by spinning the spinning reels 3 (3*a* to 3*e*) (step S401, step S402).

Next, the main CPU 71 determines whether or not a pattern of specific symbols have been displayed in the symbol display area 4 in step S402 (step S403).

Figure 31:
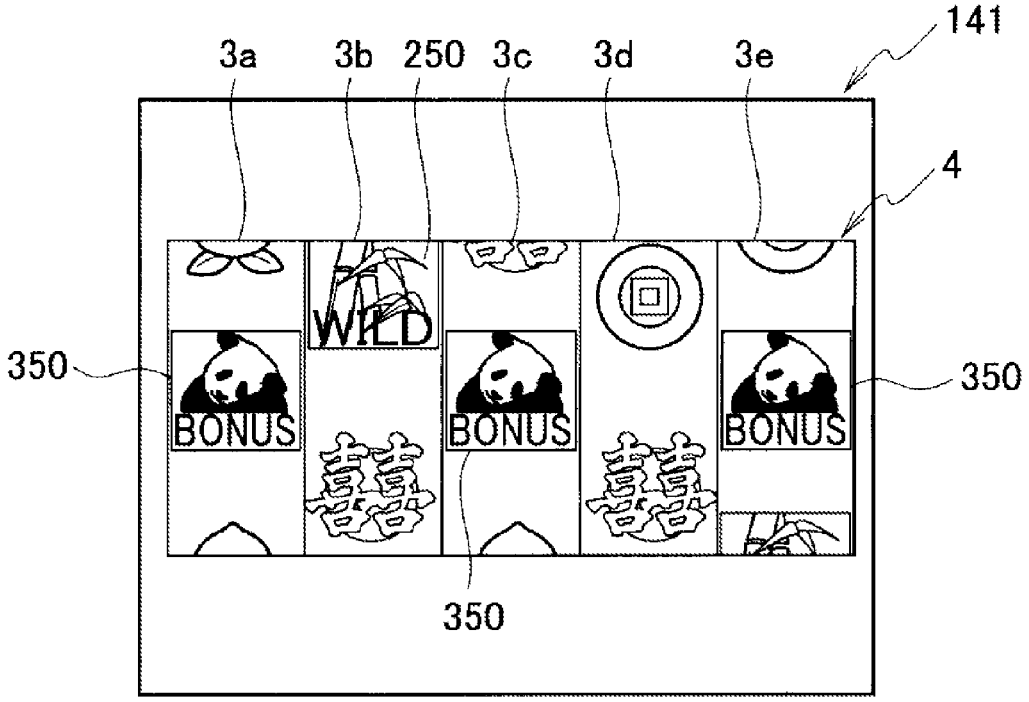
FIG. 31 is a view illustrating an exemplary display of the gaming machine according to the third embodiment of the present invention.

Herein, the pattern of specific symbols denotes a pattern of symbols serving as a trigger for the symbols that are displayed in the symbol display area 4 to migrate from a basic game to a second game (for example, a pattern in which three panda symbols 350 to be described later with reference to FIG. 31 are displayed in the symbol display area 4).

Next, in a case where the main CPU 71 determines that a pattern of specific symbols have been displayed in the symbol display area 4, based on a result of the judgment in step S403, the main CPU 71 causes the routine to migrate from the basic game to the second game and then causes the upper image display panel 131 to display a piece to which a panda animation character is assigned and a dice game board (step S404).

On the dice board that is displayed on the upper image display panel 131, a plurality of squares to which prizes are assigned, respectively, are arranged to be continuous in the chain shape from the start point to the goal point, and then, the piece to which the panda animation character is assigned moves on the plurality of squares (refer to FIGS. 31, 32A and 32B, 33A and 33B, and 34 to be described later).

Next, the main CPU 71 executes a second game in which symbols are stop-displayed in the symbol display area 4 by stopping the spinning reels 3 (3*a* to 3*e*) after the symbols have been scroll-displayed in the symbol display area 4 by spinning the spinning reels 3 (3*a* to 3*e*) (step S405, step S406).

Next, the main CPU 71 determines whether or not specific symbols (for example, panda animation character symbols 350 to be described later with reference to FIG. 31) have been displayed in the symbol display area 4 in step S406 (step S407).

Next, in a case where the main CPU 71 determines that the specific symbols have been displayed in the symbol display area 4, based on a result of the judgment in step S407, the main CPU 71 moves the piece by the number of squares that corresponds to the number of specific symbols that are stop-displayed in the symbol display area 4 on the dice game board that is displayed on the upper image display panel 131 (step S408).

With respect to movement of the above piece, the piece is moved in a direction from the start point to the goal points of the plurality of squares on the dice game board, by the number of squares that corresponds to the number of specific symbols that are displayed in the symbol display area 4.

Next, the main CPU 71 cumulatively adds a payment that corresponds to a square to which the piece has moved, and then, subtracts 1 from a predetermined number of second games (step S409, step S410).

With respect to a payment, a prize which is assigned to a square as a movement destination to which the piece has moved is determined as a payment relative to a second game, and then, the determined payment is cumulatively added.

Next, the main CPU 71 determines whether or not the number of second games is set to 0 (step S411). In a case where the main CPU 71 determines that the number of second games is set to 0, based on a result of the judgment in step S411, the CPU 71 pays out the payment that has been cumulatively added in step S409 (step S412).

On the other hand, in a case where the main CPU 71 determines that the pattern of specific symbols has not been displayed in the symbol display area 4 in step S403, the main CPU 71 determines that the symbols that are displayed in the symbol display area 4 form a predetermined combination, and then, pays out a payment that corresponds to the combination of the symbols, based on a result of the judgment (step S411, step S412).

As described above, the prize that is assigned to the square as the movement destination to which the piece has moved is determined as a payment relative to the second game, by the number of squares that corresponds to the number of specific symbols that are displayed in the symbol display window 4. Thus, the number of payments to be given can be recognized by visually recognizing the symbols that are displayed in the symbol display area 4.

Namely, in a state in which a payment is made different from another one, depending on the number of specific symbols that are displayed in the symbol display window 4, the number of moves can be determined for the piece of dice in one specific symbol, thus making it possible to increase kinds of symbols which are displayed in the symbol display area 4 without increasing the number of symbols which have been arranged on the peripheral faces of the spinning reels 3 (3*a* to 3*e*).

Therefore, there can be provided a gaming machine which is capable of diversifying the display mode of symbols by means of the spinning reels 3 (3*a* to 3*e*).

The game processing according to the present the third embodiment has been described above. Next, with reference to FIG. 31 to FIG. 34, a description will be given with respect to display examples of the upper image display pane 131 and the lower image display panel 141 in the gaming machine 1 according to the third embodiment of the present invention.

FIG. 31 shows a display example of a case in which symbols have been displayed on the lower image display panel 141 while a basic game is executed.

Figure 32A:
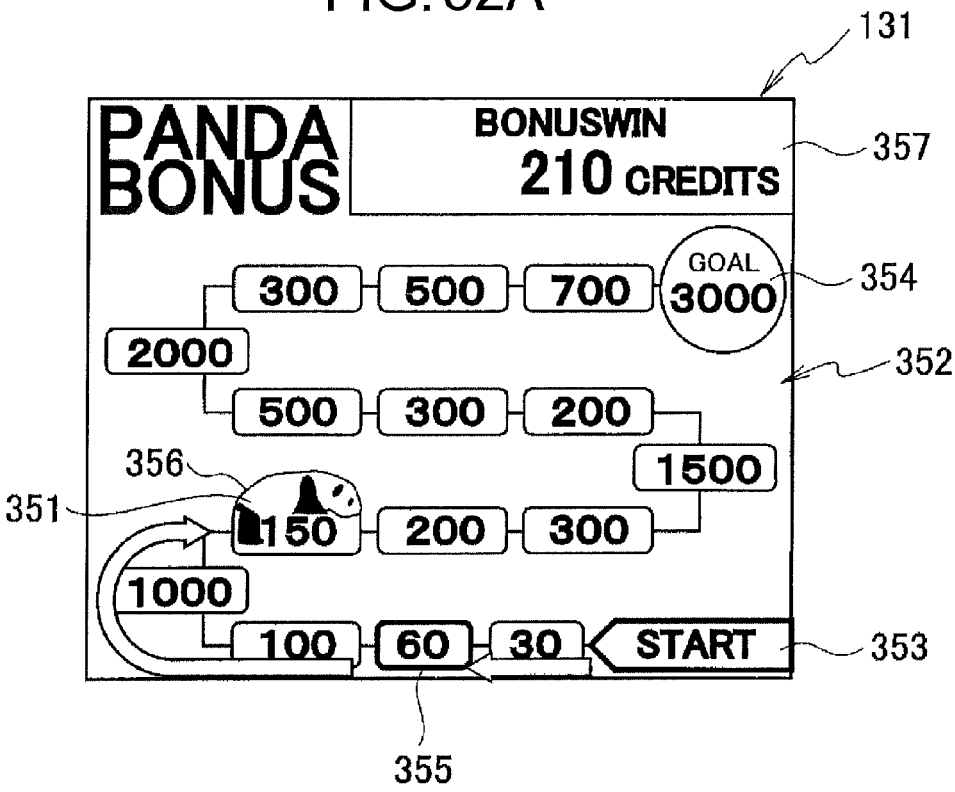
FIGS. 32A and 32B are views illustrating an exemplary display of the gaming machine according to the third embodiment of the present invention.
Figure 32B:
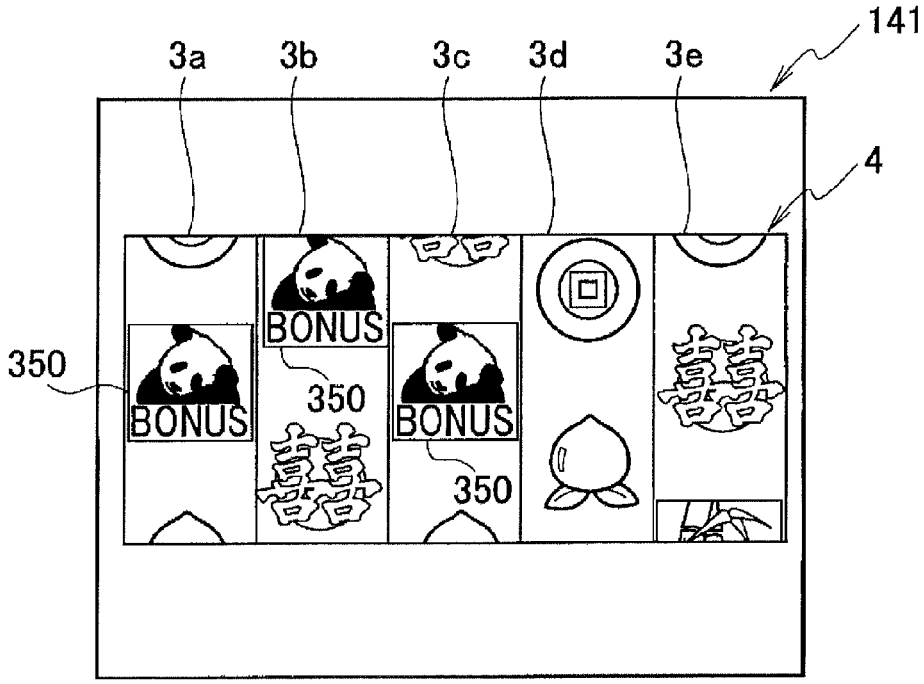

In addition, FIG. 32A shows a display example of a case in which an effect image has been displayed on the upper image display panel 131 while a second game is executed. FIG. 32B shows a display example of a case in which symbols have been displayed on the lower image display panel 141 while a second game is executed.

Figure 33A:
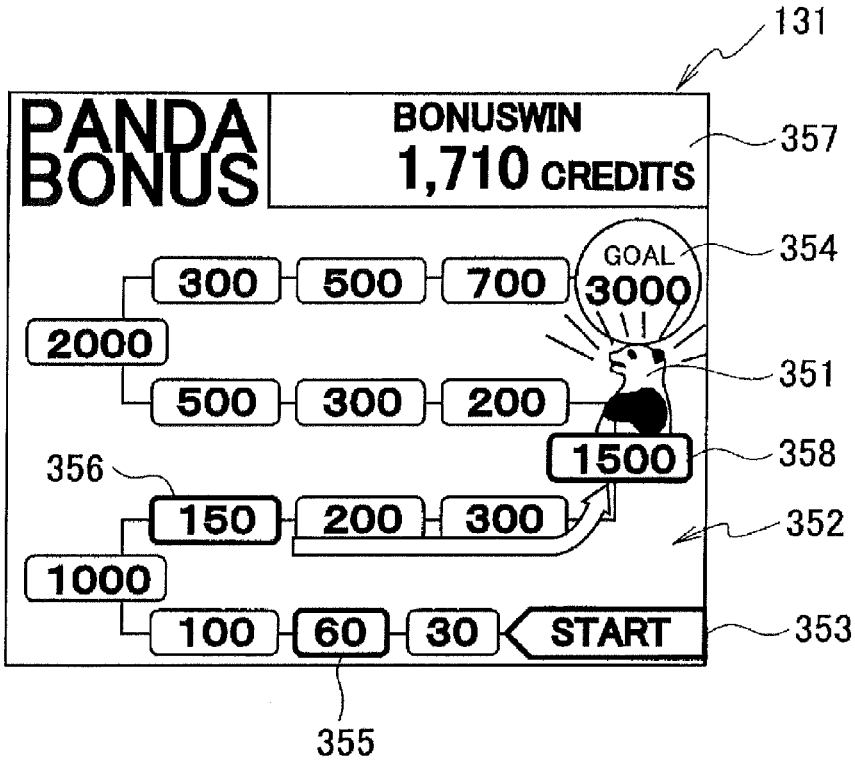
FIGS. 33A and 33B are views illustrating an exemplary display of the gaming machine according to the third embodiment of the present invention.
Figure 33B:
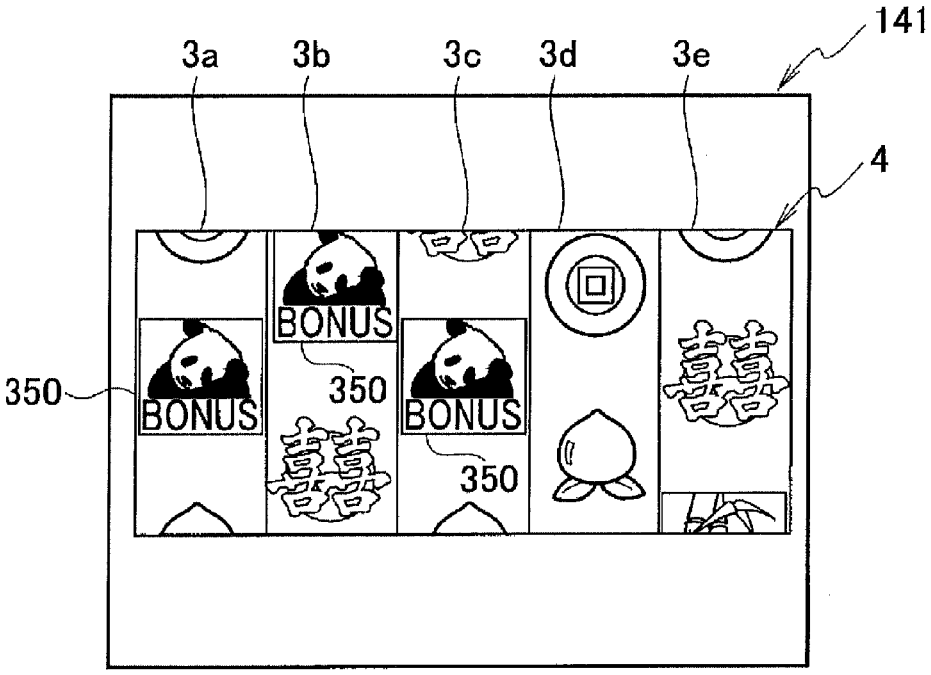

Further, FIG. 33A shows a display example of a case in which an effect image has been displayed on the upper image display panel 131 while a second game is executed. FIG. 33B shows a display example of a case in which symbols have been displayed on the lower image display panel 141 while a second game is executed.

Figure 34:
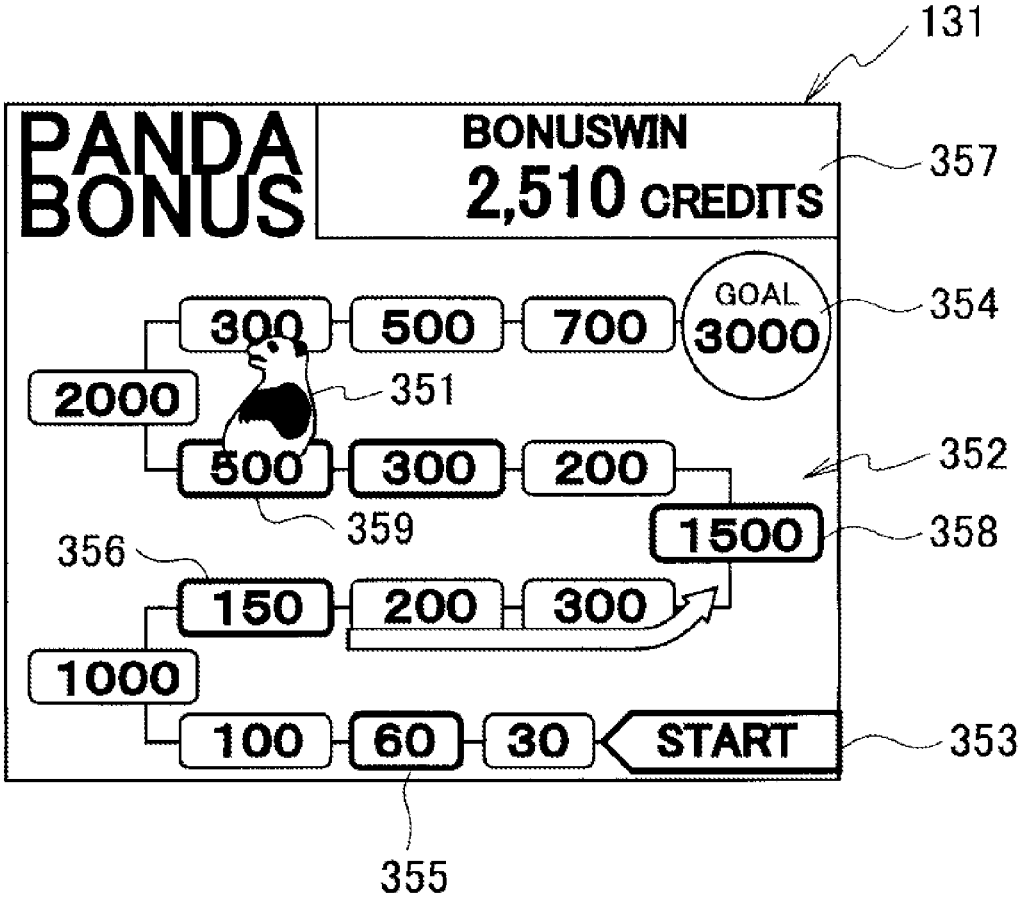
FIG. 34 is a view illustrating an exemplary display of the gaming machine according to the third embodiment of the present invention.

Moreover, FIG. 34 shows a display example of a case in which an effect image has been displayed on the upper image display panel 131 when a second game is completed.

As shown in FIG. 31, when a basic game is started, symbols are scroll-displayed in the symbol display area 4 of the lower image display panel 141 by spinning the spinning reels 3 (3*a* to 3*e*), and after a predetermined period of time has elapsed, the spinning symbols are stop-displayed in the symbol display area 4 by stopping the spinning reels 3 (3*a* to 3*e*).

Then, in a case where the symbols that are displayed in the symbol display area 4 form a predetermined combination (in a case where three or more symbols of same kind have been displayed), a payment that corresponds to the combination of the symbols is paid out.

In the display example of FIG. 31, three specific symbols 350 are displayed in the symbol display area 4 of the lower image display panel 141 while in a basic game (e.g., a pattern of panda animation character symbols 350 has been displayed), the routine is caused to migrate from the basic game to a second game. Herein, the figure shows the display example of the case in which the panda animation character symbols 350 arranged on the peripheral faces of the spinning reels 3 (3*a* to 3*e*) have been stop-displayed in the symbol display area 4.

As shown in FIG. 32A, when the second game is started, the upper image display panel 131 displays a piece 351 to which a panda animation character is assigned and a dice game board 352. On the dice game board 352 that is displayed on the upper image display panel 131, a plurality of squares to which prizes are assigned, respectively, are arranged to be continuously in a chain shape from a start point 353 to a goal point 354, and the piece 351 to which the panda animation character is assigned moves on the plurality of squares.

In addition, with respect to movement of the above piece, the piece 351 is moved in a direction from the start point 353 to the goal points 354 of the plurality of squares on the dice game board, by the number of squares that corresponds to the number of specific symbols that are displayed in the symbol display area 4.

Herein, the figure shows a display example of an effect image that is displayed on the upper image display panel 131, of a case in which, in a first one of the second games, two panda animation character symbols 350 are displayed in the symbol display area 4, the piece 351 moves to a square 355; and in a second one of the second games, three panda animation character symbols 350 are displayed in the symbol display area 4, the piece 351 moves to a square 356.

In addition, in the first one of the second games, the piece 351 moves to the square 355, and in the second one of the second games, the piece 351 moves to the square 356, and thus, a total of prizes assigned to the square 355 and the square 356 is displayed in a payment image 357. Herein, the upper image display panel 131 displays the payment image 357 of 210 CREDITS that are obtained by summing 60 assigned to the square 355 and 150 assigned to the square 356.

As shown in FIG. 3B, in a case where the panda animation character symbols 350 have been displayed in the symbol display area 4, the piece 351 is moved by the number of squares that corresponds to the number of panda animation character symbols that are displayed in the symbol display area 4 on the dice game board 352 that is displayed on the upper image display panel 131.

As shown in FIG. 33A, in the second one of the second games, the piece 351 has stopped at the square 356 (refer to FIG. 32A), and thus, the piece 351 moves by the number of squares (three squares) that corresponds to the number of panda animation character symbols 350 (three symbols) that are displayed in the symbol display area 4 in FIG. 3B.

As shown in FIG. 33A, the piece 351 moves from the square 356 by three squares, and then, stops after the piece has moved to a square 358. Then, the upper image display panel 131 displays a payment image 357 of 1710 CREDITS that are obtained by further adding 1500 assigned to the square 358 (by adding 1500 to 210 CREDITS in FIG. 32A).

Further, as shown in FIG. 33B, in a case where the panda animation character symbols 350 have been displayed in the symbol display area 4, the piece 351 is moved by the number of squares that corresponds to the number of panda animation character symbols that are displayed in the symbol display area 4 on the dice game board 352 that is displayed on the upper image display panel 131.

As shown in FIG. 34, in a third one of the second games, the piece 351 has stopped at the square 358 (refer to FIG. 33A), and thus, the piece 351 moves by the number of squares (three squares) that corresponds to the number of panda animation character symbols 350 (three symbols) that are displayed in the symbol display area 4 in FIG. 34.

As shown in the figure, the piece 351 moves from the square 358 by three squares, and then, stops after the piece has moved to the square 359. Then, the upper image display panel 131 displays a payment image 357 of 2510 CREDITS that are obtained by further adding 500 assigned to the square 359 (by adding 500 to 1710 CREDITS in FIG. 33A).

The description of the display examples of the upper image display panel 131 and the lower image display panel 141 has now been completed.

The processing operations that are conducted by the main CPU 71 of the gaming machine 1 according to the third embodiment described above are almost identical to those which are conducted by the main CPU 71 of the gaming machine 1 according to the first embodiment. In addition, in the gaming machine 1 according to the third embodiment, the trigger for the second game is changed to a predetermined number of panda animation character symbols 350 displayed.

In addition, the main CPU 71 of the gaming machine 1 according to the third embodiment conducts processing of which contents are different from those of the flowchart shown in FIG. 23 in the second game processing of step S20 in FIG. 15.

Next, with reference to FIG. 35, a description will be given with respect to the second game processing to be conducted by the main CPU 71 in the gaming machine 1 according to the second embodiment of the present invention.

Figure 35:
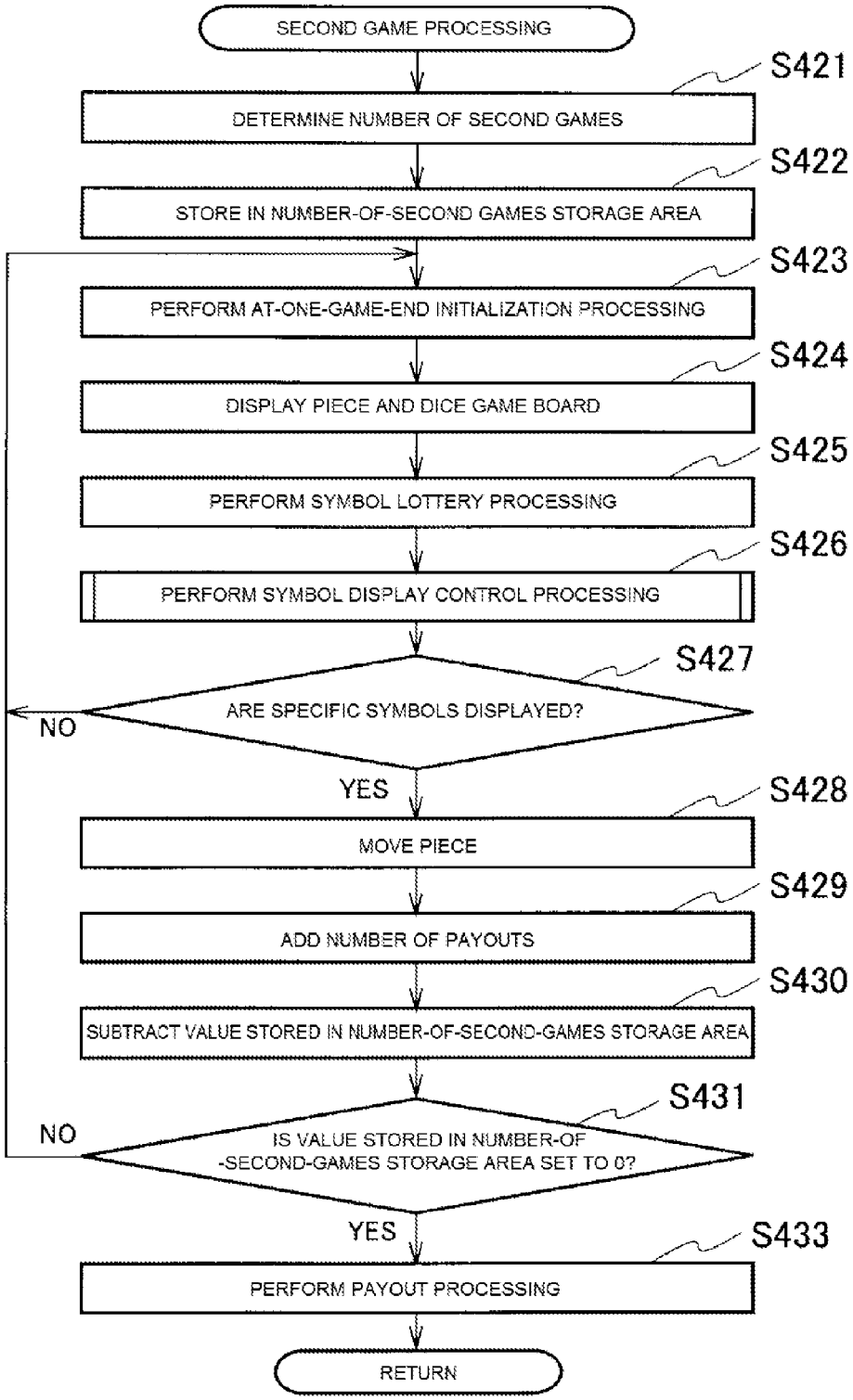
FIG. 35 is a view illustrating a flowchart of a second game processing for the gaming machine according to the third embodiment of the present invention.

FIG. 35 is a view showing a flowchart of the second game processing in the gaming machine 1 according to the embodiment of the present invention.

First, the main CPU 71 determines the number of second games (step S421). A predetermined number of times The number of second games may be determined as the number of second games. In addition, random number values for determining the number of second games are extracted, and then, any of plural numbers of second games such as "5", "7", and "10", for example, may be determined by means of lottery.

Further, the number of second games may be determined depending on a kind of symbols that have stopped in the symbol display region 4. For example, in a case where three panda animation character symbols 350 have been displayed in the symbol display region 4, the number of second games may be determined to be "7", or alternatively, in a case where three wild symbols 250 (refer to FIG. 31) have been displayed, it may be determined to be "10".

Next, the main CPU 71 stores the determined number of second games into a number-of-second-games storage area provided in the RAM 73 (step S422).

The main CPU 71 then conducts at-one-game-end initialization processing in the same way as the processing of step S12 described with reference to FIG. 15 (step S423).

Next, the main CPU 71 causes the upper image display panel 131 to display: the piece 351 to which the panda animation character is assigned; and the dice game board 352 (step S424).

On the dice game board that is displayed on the upper image display panel 131, a plurality of squares to which prizes are assigned, respectively, are arranged to be continuous in a chain shape from a start point to a goal point. Then, in the dice game, the piece 351 to which the panda animation character is assigned moves on the plurality of squares (refer to FIGS. 31, 32A and 32B, 33A and 33B, and 34).

Next, the main CPU 71 conducts symbol lottery processing (step S425). In the symbol lottery processing, to-be-stopped symbols may be determined based on the random number values for determining symbols for the second game, by employing a table in which random numbers are specified so that a possibility that panda animation character symbols (specific symbols) 350 are displayed in the symbol display area 4 (i.e., a possibility that the panda animation character symbols 350 form a winning combination) becomes relatively higher than that in a basic game.

Next, the main CPU 71 conducts the symbol display control processing described with reference to FIG. 20 (step S426).

Next, the main CPU 71 determines whether or not specific symbols have been displayed in the symbol display area 4 (step S427). The specific symbols denote symbols (panda animation character symbols 350) serving as a trigger for the piece 351 displayed on the upper image display panel 131 to move in a basic game in which the specific symbols are displayed in the symbol display area 4 (refer to FIG. 32B and FIG. 33B).

When the main CPU 71 determines that the specific symbols have not been displayed (step S427: NO), the routine reverts to step S423. In a case where a winning pattern of symbols (a combination of symbols of same kind) has been displayed in the symbol display area 4 in a basic game, a payment that corresponds to the pattern of symbols may be paid out.

On the other hand, when the main CPU 71 determines that the specific symbols have been displayed (step S427: YES), the main CPU 71 moves the piece 351 by the number of squares that corresponds to the number of specific symbols that have been stop-displayed in the symbol display area 4 on the dice game board 352 that is displayed on the upper image display panel 131 (step S428).

With respect to movement of the piece 351, the piece 351 is moved in a direction from the start point to the goal points of the plurality of squares on the dice game board 352 by the number of squares that corresponds to the number of specific symbols (panda animation character symbols 350) that are displayed in the symbol display area 4 (refer to FIG. 32A, FIG. 33A, and FIG. 34).

Next, the main CPU 71 cumulatively adds the number of payouts (payment) that corresponds to a square to which the piece 351 has moved (step S429). As a payment, a prize which is assigned to a square as a movement destination to which the piece 351 has moved is determined as a payment (the number of payments) relative to a second game, and then, the determined payment is cumulatively added (refer to FIG. 32A, FIG. 33A, and FIG. 34).

Next, the main CPU 71 subtracts one from the value stored in the number-of-second-games storage area (step S430).

The main CPU 71 then determines whether or not the value stored in the number-of-second-games storage area is at its "0" (step S203). When the main CPU 71 determines that the value stored in the number-of-second-games storage area is not 0 (step S431: NO), the main CPU 71 shifts the processing to step S423.

On the other hand, when determining that the value stored in the number-of-second-games storage area is set to 0 (step S431: YES), the main CPU 71 conducts payout processing of paying out a payment that has been cumulatively added in the payout storage area in step S429 (the payment obtained by adding the prize that is assigned to the square as the movement destination to which the piece 351 has moved) (step S433). After the process has been conducted, the second game process is completed. When the second game processing has been completed, the processing is shifted to the processing of step S21 described with reference to FIG. 15.

In this way, the prize that is assigned to the square as the movement destination to which the piece has moved by the number of squares that corresponds to the number of specific symbols (panda animation character symbols 350) that are displayed in the symbol display window 4, is determined as a payment relative to the second game. Thus, the number of payments to be given can be recognized by visually recognizing the symbols that are displayed in the symbol display area 4.

In this manner, the gaming machine 1 according to the third embodiment of the present invention comprises:

a plurality of spinning reels 3 (3*a* to 3*e*) having symbols arranged on peripheral faces thereof;

a lower image display panel (symbol display window) 141 having a symbol display area 4 in which symbols are scroll-displayed by spinning of the spinning reels 3 (3*a* to 3*e*) and then the symbols are stop-displayed by stoppage of the spinning reels 3 (3*a* to 3*e*);

an upper image display panel 131 (display) which is arranged at an upper part of the lower image display panel 141, for displaying a video image; and a main CPU (controller) 71 causing a basic game to migrate to a second game in a case where a pattern of specific symbols are displayed in a symbol display area 4 (in a case where a pattern of three panda animation character symbols 350 are displayed in the symbol display area 4), the main CPU 71 executing the processing operations of:

(a) arranging a plurality of squares to which prizes are assigned, respectively, to be continuously in a chain shape at a start point 353 and then displaying the plurality of squares on the upper image display panel 131 (processing of step S424 in FIG. 35);

(b) executing a second game in which the spinning reels 3 (3*a* to 3*e*) are spun and stopped (processing operations of step S425 and step S426 in FIG. 35);

(c) determining, as a payment relative to the second game, a prize assigned to a square as a movement destination to which a piece has moved in a direction from the start point 353 to a plurality of goal points 354, by the number of pieces that corresponds to the number of specific symbols (panda animation character symbols 350) that are displayed in a symbol display window 4 in the second game (step S423 to step S431 in FIG. 35);

(d) executing the processing (c) a predetermined number of times (step S423 to step S431 in FIG. 35); and (e) executing payout of the payment determined in the processing (c) (step S433 in FIG. 35).

Furthermore a method of controlling a gaming machine 1 according to the third embodiment of the present invention, comprising a main CPU (controller) 71:

the main CPU 71 control method comprising the steps of:

starting a second game in a case where a pattern of specific symbols (pattern of displays the three symbols of panda 350 in the symbol display area 4) is displayed in the symbol display area 4 in which symbols are scroll-displayed by stopping Of a plurality of spinning reels 3 (3*a* to 3*e*) having symbols arranged on peripheral faces thereof, the pattern of specific symbols are trigger for shifting for from the base game to the second game, wherein (a) displays on the upper image display panel (display) 131, a plurality of squares to which prizes are assigned, respectively, are arranged to be continuous in the chain shape at the start point 353 (processing of step S424 in FIG. 35), (b) executes the second game which is spinning and stopping the spinning reels 3 (3*a* to 3*e*) (processing of step S425, step S426 in FIG. 35), (c) determining as a payment relative to the second game, the prize that is assigned to the square as the movement destination moved in a direction from start point 353 to the goal points 354 of the plurality of squares by the number of squares that corresponds to the number of specific symbols (symbol of panda 350) that are displayed in the symbol display window 4 in the second game (step S423 to step S431 in FIG. 35), (d) executing the number of times decided on the (c) processing (step S423 to S431 in FIG. 35), and (e) executing a payout of the payment determined in the (c) processing (step S433 of FIG. 35).

In addition, with the gaming machine 1 according to the third embodiment of the present invention, while a payment is made different from another one, depending on the number of specific symbols that are displayed in the symbol display window 4, one specific symbol (a panda animation character symbol 350) can be caused to function as dice in a dice game. This makes it possible to increase kinds of symbols which are displayed in the symbol display area 4 without increasing the number of symbols that are arranged on the peripheral faces of the spinning reels 3 (3*a* to 3*e*).

Therefore, there can be provided a gaming machine which is capable of diversifying the display mode of symbols by means of the spinning reels 3 (3*a* to 3*e*).

In addition, in the gaming machine 1 according to the third embodiment of the present invention, the multiple color light emitting backlight 5 has a respective one of the shading portions 6 (6*a* to 6*d*) that are provided for a respective one of the plurality of spinning reels 3 (3*a* to 3*e*) (refer to FIG. 6), and a respective one of the shading portions 6 (6*a* to 6*d*) may be configured so as to shade light in a respective one of the partition areas 7 that are partitioned in order to emit the light from the back side individually for a respective one of the symbols that are displayed in the symbol display area 4, in such a manner that all of the symbols that are displayed in the symbol display area 4 are allowed to be individually displayed by means of the multiple color light emitting backlight 5 while the color is changed (refer to FIG. 6).

With such a configuration, in a case where the panda animation character symbols 350 are displayed in the symbol display area 4 while in a second game, light is emitted in a predetermined color by means of the multiple color light emitting backlight 5, and then, the panda animation character symbols 350 that are displayed in the symbol display area 4 are illuminated from the back side, whereby the color of the panda animation character symbols 350 is allowed to be displayed in a highlighted manner in a color which is different from that of another symbol. In this manner, the state of a game currently executed (a dice game) can be notified, so that the contents of the game can be clarified.

As in a first modification example according to the third embodiment of the present invention, at the time of symbol lottery processing while in a second game which is played in step S425 of FIG. 35, to-be-stopped symbols may be determined by employing a table in which random numbers are specified so that only the panda animation character symbols (specific symbols) 350 form a winning combination.

In that case, in the table to be referred to in the symbol lottery processing while in the second game (refer to step S426 in FIG. 35), the random numbers are specified so that only the panda animation symbols (specific symbols) 350 form a winning combination, and while in the second game, there is to be employed a table in which the random numbers are specified so that other symbols do not form a winning combination.

In such a first modification example, at least one panda animation character symbol (specific symbol) 350 is included in the symbols that are displayed in the symbol display area 4 by stopping the spinning reels 3 (3*a* to 3*e*) (refer to step S426 in FIG. 35) while in the second game. Thus, a pattern of other symbols determined to be a winning combination in a basic game (a combination of symbols of same kind) is not displayed in the symbol display area 4.

In the case of the first modification example, in the symbol lottery processing while in the second game (refer to step S426 in FIG. 35), to-be-stopped symbols may be determined based on the random number values for determining symbols for the second game, by employing a table in which random numbers or random number ranges are specified by the number of panda animation character symbols (specific symbols) 350 that are displayed in the symbol display area 4.

As in a second modification example according to the third embodiment of the present invention, at the time of symbol lottery processing while in a second game that is played in step S426 of FIG. 35, the routine may be configured so as not to pay out a payment, in a case where a pattern of symbols determined to be a winning combination has been displayed in the symbol display area 4 in a basic game, in place of employing a table which is identical to that employed in the third embodiment.

Figure 36:
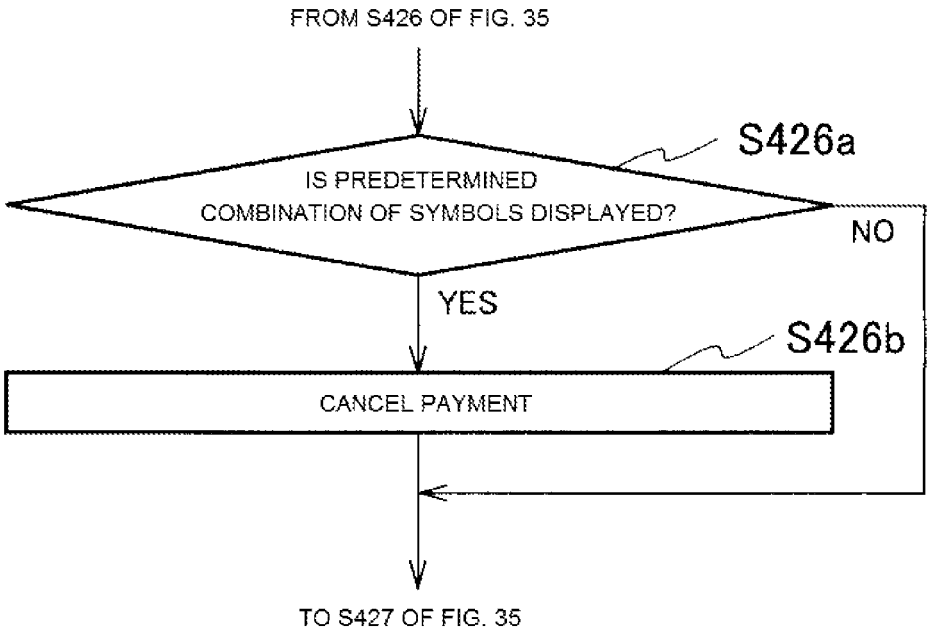
FIG. 36 is a view illustrating a flowchart of a second game processing for the gaming machine according to an exemplary variation of the third embodiment of the present invention.

In this case, as shown in FIG. 36, the main CPU 71 determines whether or not a predetermined combination of symbols has been displayed subsequent to step S426 in FIG. 35 (step S426*a*), and in a case where the main CPU 71 determines that the predetermined combination of symbols has been displayed (step S426*a*: YES), the main CPU 71 cancels a payment that corresponds to the combination of symbols (step S426*b*).

On the other hand, in a case where the main CPU 71 determines that the predetermined combination of symbols has not been displayed (step S426*a*: NO), the main CPU 71 conducts the processing in step S426*b* and then the routine migrates to step S427 in FIG. 35.

Therefore, in the second modification example, a pattern of other symbols (a combination of symbols of same kind) which are determined to be a winning combination in a basic game, other than panda animation character symbols (one or more specific symbols) 50, is included in the symbols that are displayed in the symbol display area 4 by stopping the spinning reels 3 (3*a* to 3*e*) while in a second game (refer to step S426 in FIG. 35). However, a payment is not paid out even in a case where a pattern of symbols determined to be a winning combination in the symbol display area 4 in the basic game has been displayed.

In the case of the second modification example, to-be-stopped symbols may be determined based on the random number values for determining symbols for the second game, by employing a table in which random numbers are specified so that a possibility that panda animation character symbols (specific symbols) 350 are displayed in the symbol display area 4 (i.e., a possibility that the panda animation character symbols 350 form a winning combination) becomes relatively higher than that in a basic game.

Hereinafter, a gaming machine 1 according to a fourth embodiment of the present invention will be described with reference to drawings. In conventional gaming machines, there has been a problem that it is difficult to give variety to the game if mechanical spinning reels or video spinning reels, which are changeless, are used for the display of symbols. Then, a gaming machine 1 in the fourth embodiment of the present invention has been made to solve such a conventional problem and an object thereof is to provide a gaming machine which is capable of not reducing the entertainment characteristic.

Note that, since the gaming machine 1 in the fourth embodiment has substantially similar configuration or the like to those of the gaming machine 1 in the second embodiment (and the first embodiment which the second embodiment cites) of the present invention, description of the similar configurations will sometimes be omitted. The components similar to those of the gaming machine 1 in the second embodiment (and the first embodiment which the second embodiment cites) are denoted by the same reference numerals.

Figure 38:
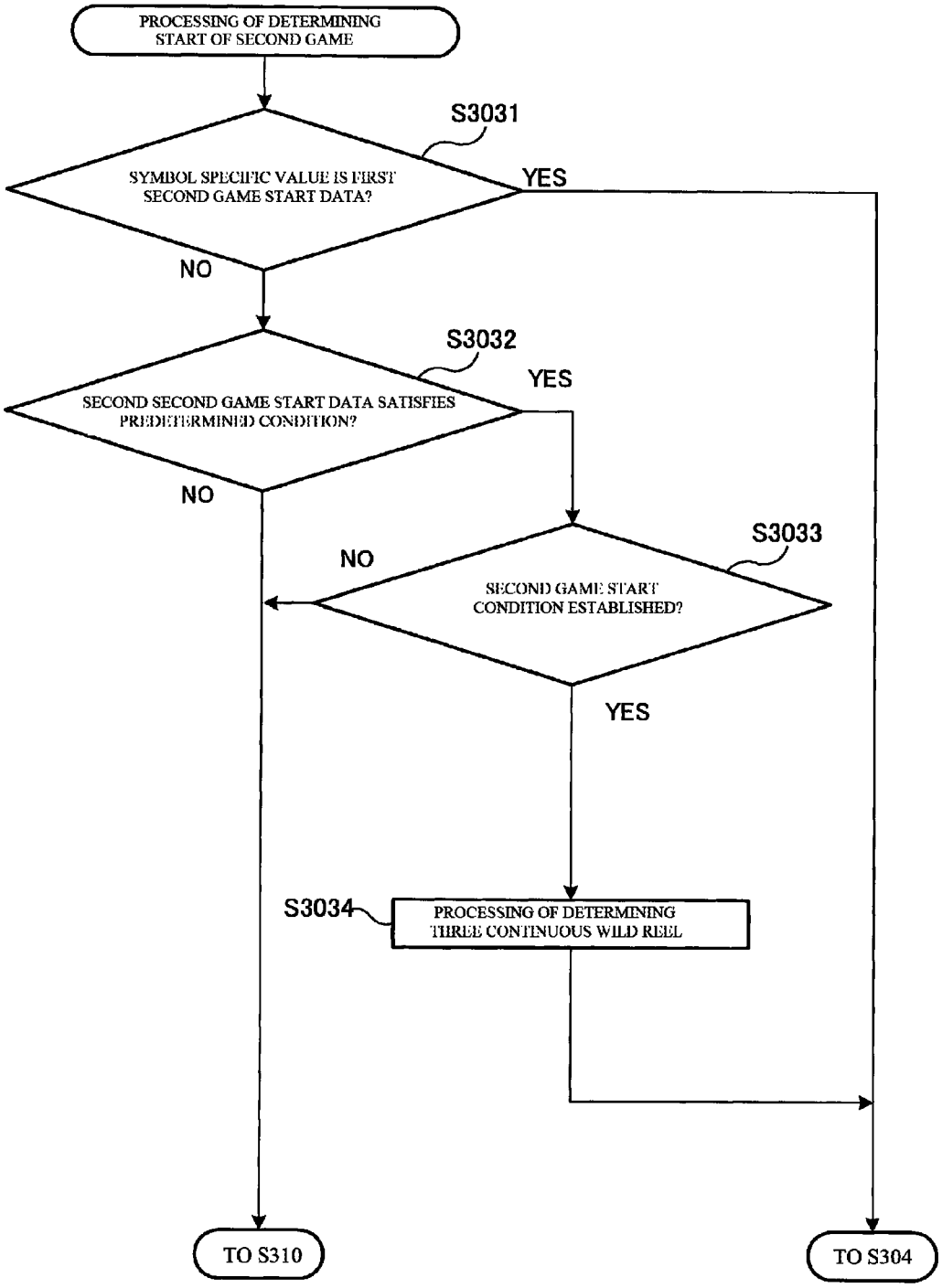
FIG. 38 is a view illustrating a flowchart of a process for determination of starting a second game of a gaming machine in the fourth embodiment of the present invention.

First, an outline of the gaming machine 1 in the fourth embodiment of the present invention will be described. As illustrated in FIG. 38, this gaming machine 1 provides a gaming machine which is capable of not reducing an entertainment characteristic. This gaming machine 1 is provided with spinning reels 3 or the like on which a plurality of symbols are rearranged, ROM 72, RAM 73 or the like in which a plurality of kinds of data including second game start data is stored, and a main CPU 71 programmed to execute the following processing (a1) to (a5):

(a1) processing of rearranging symbols on the spinning reels 3 or the like and running a base game which is capable of establishing a winning prize based on the rearranged symbols;

(a2) processing of randomly selecting data stored in ROM 72, RAM 73 or the like;

(a3) processing of rearranging the symbols in a display mode based on the data selected in processing (a2);

(a4) processing of running the second game after the run of the base game when the data selected in processing (a2) is the second game start data; and (a5) processing, when the data selected in processing (a2) is not the second game start data, of randomly selecting whether the second game start condition is established and, when the second game start condition is established, to run the second game after the run of the base game.

In more detail, the gaming machine 1 in the fourth embodiment is provided with spinning reels 3 (3*a* to 3*e*) as symbol display units on which a plurality of symbol are rearranged, the ROM 72, the RAM 73 or the like as the storage units in which a plurality of kinds of data including second game start data to be described later is stored, and a main CPU 71 as a controller.

Main CPU 71 executes:

(a1) processing of controlling the spinning reels 3 so as to rearrange the symbols in symbol display areas 4, and running the base game which is capable of establishing a winning prize based on the rearranged symbols;

(a2) processing of randomly selecting data stored in the ROM 72, the RAM 73 or the like;

(a3) processing of rearranging the symbols in a display mode based on the data selected in processing (a2), (a4) processing of running the second game after the run of the base game when the data selected in processing (a2) is the second game start data; and (a5) processing, when the data selected in processing (a2) is not the second game start data, of randomly selecting whether the second game start condition is established and, when the second game start condition is established, to run the second game after the run of the base game.

That is, the main CPU 71 executes:

(a1) processing of controlling the spinning reels 3 so as to rearrange the symbols in symbol display areas 4, and running the base game which is capable of establishing a winning prize based on the rearranged symbols;

(a2) processing of randomly determining a game result of the base game; and (a3) processing of running the second game when game result data based on the game result satisfies a condition under which the second game is started in accordance with first or second second game start data which is a second game start condition stored in the storage unit.

Here, "rearrangement" means to establish arrangement again after the arrangement of the symbols is collapsed. "Arrangement" means that symbols are in a state to be visually recognizable to an external player.

The base game is a game which runs on condition that a game value is bet, and pays a game value depending on an amount of the rearranged symbols 501. In other words, the base game is a game which starts on the premise that a game value is consumed. The second game is synonymous with a bonus game and a feature game. The second game in the present embodiment is, as in the second embodiment, a game in which the free game, in which all the symbols displayed on the symbol display areas 4 become wild symbols in at least one of the spinning reels 3, is repeated predetermined times (for example, twice). The free game is a game not on the premise that the game value is consumed.

As described above, in the fourth embodiment, a plurality of conditions for the migration to the second game exist at least in the sense of internal processing. Thus, the method of migration to the second game is diversified for the player and the second game sometimes begins without player recognition. Therefore, the entertainment characteristic can be improved.

The second game in the present embodiment is, as in the second embodiment, a free game in which all the symbols displayed on the symbol display areas 4 become the wild symbols in at least one of the spinning reels 3 (hereafter, also called a "three continuous wild second game"). In the second embodiment, the second game is started on condition that, in the base game, all the symbols become the wild symbols 250 in any of the spinning reels 3 (see FIG. 26A); a further different condition is added to the condition described above in the present embodiment.

First, about the symbol lottery processing which has been described with reference to FIG. 19, a difference from the first embodiment will be described. In the following description, the spinning reels 3*a* to 3*e* are also referred to as first to fifth reels.

The symbols are determined with equal probability in step S112 in FIG. 19; but in the present embodiment, random number values are extracted and, at the same time, the symbols to be rearranged are determined with reference to a symbol table for the base game illustrated in FIG. 37. As illustrated in FIG. 37, any of code numbers of 00 to 21 is given to symbols which constitute each sequence of symbols of the first to fifth reels. Twenty-two specific ranges divided from a predetermined random number range (for example, 0 to 58) are correlated with each code number.

For example, suppose that a randomly selected random number value in the second reel is the range of numerical value of the code of "01" (i.e., the random number value is 2). In this case, the gaming machine 1 controls the second reel such that a symbol corresponding to the code number of "01" is rearranged in the central region. That is, symbols corresponding to the codes of "00," "01" and "02" are rearranged on the symbol display areas 4 of the second reel.

The code numbers are correlated with weights. The weights indicate the size of the specific ranges. Thus, the symbol with the weight of 0 is not rearranged. In FIG. 37, the specific ranges with the weight of 0 are indicated by hyphens. Note that the symbols are controlled not to be rearranged by setting the size of the specific range to 0 no matter what random number value is extracted, but the control is not limited thereto. For example, it is possible to determine the symbols not to be rearranged previously and to repeat the processing of extracting the random number value may be performed when the random number value in the specific ranges of the symbols is extracted. The symbol table for the base game is not limited to a single kind, but a plurality of symbol tables may exist to be changeable depending on the setting of the gaming machine 1.

As described above, the symbol table for the base game is stored in the storage unit of the gaming machine 1 as one of the plurality of kinds of data ("symbol specific value data"). In particular, the specific range of the symbol table for the base game is determined depending on the extracted random number value and then the code number of the symbol to be rearranged is determined. That is, the code number and/or the specific range are the symbol specific values with which the symbol is specified.

Next, a three continuous wild second game start condition will be described. In the second embodiment, as described in step S303 in FIG. 25, the three continuous wild second game is started when the pattern of the wild symbols is displayed; but in the present embodiment, processing of determining start of the second game illustrated in FIG. 38 is executed instead of the processing of step S303 in FIG. 25.

As illustrated in FIG. 38, in the processing of determining start of the second game, the main CPU 71 determines whether any of the symbol specific values of the first to fifth reels is first second game start data (S3031).

Here, the first second game start data indicates data which satisfies a condition under which the second game is started only with the symbol specific value data. That is, it is meant that the result of the base game indicates the second game start condition. In the case of the present embodiment, the first second game start data is the symbol specific value data which indicates that all the symbols become the wild symbols 250 on any of the spinning reels 3 among all the symbol specific value data (hereafter, this mode will be referred to as "three continuous wild"). In particular, the first second game start data is the data indicating the code number of the central wild symbol among the three continuous wild symbols and/or indicating the specific range, and is stored in the storage unit.

As described above, in step S3031, the determination is made by comparing the first second game start data stored in the storage unit with the randomly selected symbol specific value data. If the symbol specific value is the first second game start data (S3031: YES), the processing proceeds to step S304 in FIG. 25.

If, on the other hand, the symbol specific value is not the first second game start data (S3031: NO), it is determined whether the second second game start data satisfies the predetermined condition (S3032).

Here, the second second game start data is the data acquired randomly based on the randomly selected symbol specific value. In the present embodiment, the second second game start data is the data of the rearranged symbols determined to be rearranged on all the symbol display areas 4 on the first to fifth reels.

In particular, in the determination of step S3032, if the second second game start data, i.e., the rearranged symbols determined to be rearranged indicate that they do not establish a predetermined winning prize, it is determined that the second second game start data satisfies the predetermined condition. In the present embodiment, the predetermined winning prize indicates the winning prize serving as a trigger of the second game; for example, the triggers of the tree climbing competition described with reference to FIGS. 13A, 13B, and 13C or the like in the first embodiment, the three continuous wild second game described with reference to FIGS. 26A and 26B or the like in the second embodiment, and the sugoroku game described with reference to FIGS. 32A and 32B or the like in the third embodiment. That is, it is determined whether the second second game start data satisfies the predetermined condition based on whether it is the mode which migrates to the second game. Note that the predetermined winning prize is not limited thereto and a part or all of the winning prizes for which payment is paid out may be included in the predetermined winning prize. If the second second game start data does not satisfy the predetermined condition (S3032: NO), the processing proceeds to step S310.

If, on the other hand, the second second game start data satisfies the predetermined condition, it is determined whether the second game start condition is established based on the second game start condition data which specifies the second game start condition (S3033).

Here, the second game start condition data is one of a plurality of kinds of data stored in the storage unit, and is the data used when randomly selecting whether the second game start condition is established. In the present embodiment, the second game start condition data indicates a table of conditions under which the second game starts illustrated in FIG. 39 stored in the storage unit. As illustrated in FIG. 39, two random number ranges divided from a random number extraction range (for example, 0 to 74) are correlated to the occurrence of the second game and to the losing of the second game.

For example, if the randomly selected random number value is "1," the random number value is included in the random number range of "occurrence," then the second game start condition is established. If the randomly selected random number value is "10," the random number value is included in the random number range of "losing," then the second game start condition is not established. Each of the random number range is correlated with a weight. The weights indicate the size of the random number ranges.

As described above, in step S3033, it is determined, through the random number value extraction, whether the second game start condition is established with reference to the table of conditions under which the second game starts. If the second game start condition is not established (S3033: NO), the processing proceeds to step S310.

If, on the other hand, the second game start condition is established (S3033: YES), processing of determining the three continuous wild reel is executed (S3034). In particular, the spinning reel 3 on which all the symbols become the wild symbols 250 is determined by the extraction of the random number values with reference to the three continuous wild reel determination table.

As illustrated in FIG. 40, the random number ranges are determined on the three continuous wild reel determination table for each mode of the three continuous wild reels (i.e., the pattern of which of the spinning reels 3 becomes the three continuous wild), and the three continuous wild reels are determined in the mode of the random number ranges corresponding to the random number value by extracting the random number values. For example, if the random number value is 90, the random number value is included in the random number range of "only the second reel is the three continuous wild." Therefore, the second reel is determined to be the reel serving as the three continuous wild. After the three continuous wild reels are determined, the processing proceeds to step S304.

As described above, in the present embodiment, the main CPU 71 executes the processing of determining start of the second game instead of step S303 in the second embodiment. If the spinning reels serving as the three continuous wild reels are determined in step S3034, control is made that three wild symbols 250 are displayed on the symbol display areas 4 on the spinning reel 3 in step S306. If there is a spinning reel 3 which newly becomes in the mode of the three continuous wild in the three continuous wild second game, control is made to keep the state of the three continuous wild also in the spinning reel 3 in the subsequent three continuous wild second games. The symbol table used for the determination of the rearranged symbol except the three continuous wild reels in the three continuous wild second games is not limited; for example, a symbol table for the second game and a symbol table for the base game may be used.

Hereinafter, a gaming machine 1 according to a fifth embodiment of the present invention will be described with reference to drawings.

Note that, since the gaming machine 1 in the fifth embodiment has substantially similar configuration or the like to those of the gaming machine 1 in the third embodiment (and the first embodiment which the third embodiment cites) of the present invention, description of the similar configurations will sometimes be omitted. The components similar to those of the gaming machine 1 in the third embodiment (and the first embodiment which the third embodiment cites) are denoted by the same reference numerals. Description of some of the processing will be omitted and the fourth embodiment will be cited.

First, an outline of the gaming machine 1 in the fifth embodiment of the present invention will be described. A gaming machine 1 in the fifth embodiment is provided with: spinning reels 3 (3*a* to 3*e*) or the like as symbol display units on which a plurality of symbols are rearranged; an upper image display panel 131 as a second game display unit on which the second game is displayed; ROM 72, RAM 73 or the like as storage units in which a plurality of kinds of data containing symbol specific value data used as symbol specific values each of which is correlated with each if a plurality of symbols is stored; and a main CPU 71 as a controller.

The main CPU 71 executes the following processing:

(a1) processing of controlling the spinning reels 3 so as to rearrange the symbols on the symbol display areas 4 by randomly selecting the symbol specific values;

(a2) processing of rearranging symbols by the processing (a1) and running a base game which establishes a winning prize based on the rearranged symbols;

(a3) processing of running the second game on the second game display unit using the result rearrangement of the symbols when a winning prize under a predetermined condition is established in the base game; and (a4) processing of rearranging the symbols, by randomly selecting symbol specific values, such that the result of the rearrangement of the symbols during the running of the second game does not establish a winning prize.

Here, "rearrangement" means to establish arrangement again after the arrangement of the symbols is collapsed. "Arrangement" means that symbols are in a state to be visually recognizable to an external player.

The base game is a game which runs on condition that a game value is bet, and pays a game value depending on an amount of the rearranged symbols 501. In other words, the base game is a game which starts on the premise that a game value is consumed. The second game is synonymous with a bonus game and a feature game. The second game in the present embodiment is a sugoroku game in which a piece is moved on a sugoroku board with a plurality of grids based on the number of symbols 350 of a panda animation character rearranged by the spinning reels 3 on the upper image display panel 131.

As described above, since the symbols are not rearranged in the mode corresponding to the establishment of the winning prize during the running of the second game, the player can concentrate on playing the second game. Therefore, the entertainment characteristic can be maintained.

First, about the second game processing which has been described with reference to FIG. 35, a difference from the third embodiment will be described. In the third embodiment, in step S427 if a pattern of symbols (i.e., the predetermined or larger number of same symbols) which is considered as a winning prize in the base game is rearranged, the payment corresponding to the pattern of symbols may be paid out. That is, although the sugoroku game is runnable with a symbol table which is the same as the symbol table for the base game, the present embodiment is configured that the result of rearrangement of the symbols does not establish a winning prize even if the symbol specific values which specify the symbols to be rearranged are selected randomly by using a symbol table for the second game (i.e., symbol specific value data for the second game, see FIG. 41) which is different from the symbol table for the base game (i.e., the symbol specific value data for the base game).

That is, in the present embodiment, the random number values are extracted an, at the same time, symbols to be rearranged are determined with reference to the symbol table for the second game illustrated in FIG. 41 in symbol lottery processing in step S425. As illustrated in FIG. 41, in the symbol table for the second game, any of code numbers of 00 to 21 is given to the symbols which constitute each sequence of symbols of the first to fifth reels. Twenty-two specific ranges divided from a predetermined random number range (for example, 0 to 71) are correlated with each code number.

Suppose that, for example, the randomly selected random number value on the second reel is in a range of numerical value of the code of "08" of "Trigger_A" which corresponds to symbols 350 of a panda animation character (for example, the random number value is 22). In this case, the gaming machine 1 controls the second reel such that the symbols 350 of the panda animation character corresponding to the code number of "08" are rearranged in the central region. That is, symbols corresponding to the codes of "07," "08" and "09" are rearranged on the symbol display areas 4 of the second reel.

The code numbers are correlated with weights. The weights indicate the size of the specific ranges. Thus, the symbol with the weight of 0 is not rearranged. In FIG. 41, the specific ranges with the weight of 0 are indicated by hyphens. Note that the symbols are controlled not to be rearranged by setting the size of the specific range to 0 no matter what random number value is extracted, but the control is not limited thereto. For example, it is possible to determine the symbols not to be rearranged previously and to repeat the processing of extracting the random number value may be performed when the random number value in the specific ranges of the symbols is extracted. The symbol table for the second game is not limited to a single kind, but a plurality of symbol tables may exist to be changeable depending on the setting of the gaming machine 1.

In the second reel, as illustrated in FIG. 41, "1BAR," "2BAR" and "3BAR" have the possibility to be rearranged. However, setting of the symbol arrangement in the sequence of symbols and setting of the weights (i.e., the specific ranges) are made also in other reels so as not to establish of a winning prize which causes a payout. That is, the symbol specific values can be randomly selected such that the predetermined or larger numbers of these symbols are not rearranged.

Although not illustrated, the weight (i.e., the size of the specific range) may be 0 about all the symbols of which result of rearrangement causes establishment of a winning prize.

Next, processing of ending of the second game processing of the present embodiment will be described. Unlike the third embodiment, the second game processing in the present embodiment is ended under an end condition that the numbers of second games are completed (which corresponds to the determination of step S431) or the piece has been moved to reach a goal point.

In other words, the gaming machine in the present embodiment is provided with spinning reels 3 (3*a* to 3*e*) or the like as symbol display units on which a plurality of symbols are rearranged, and a main CPU 71 as a controller. The main CPU 71 executes:

(a1) processing of rearranging the symbols on the symbol display units and running the base game which is capable of establishing a winning prize based on the rearranged symbols;

(a2) processing of running a second game (i.e., a sugoroku game) with a plurality of end conditions when a winning prize under a predetermined condition is established in a base game; and (a3) processing of ending this second game when any of the end conditions in the second game is satisfied.

In particular, the second game includes a symbol rearrangement game in which the symbols are rearranged, and a progress game in which payment is made during the progress of a position of an end point based on the game result of the symbol rearrangement game. The time at which the symbol rearrangement game is repeated predetermined times and the time at which the second game reaches the position of the end point are considered as a plurality of end conditions.

With reference to the flowchart of the second game processing in FIG. 42, a difference from the second game processing in the third embodiment will be described.

Figure 42:
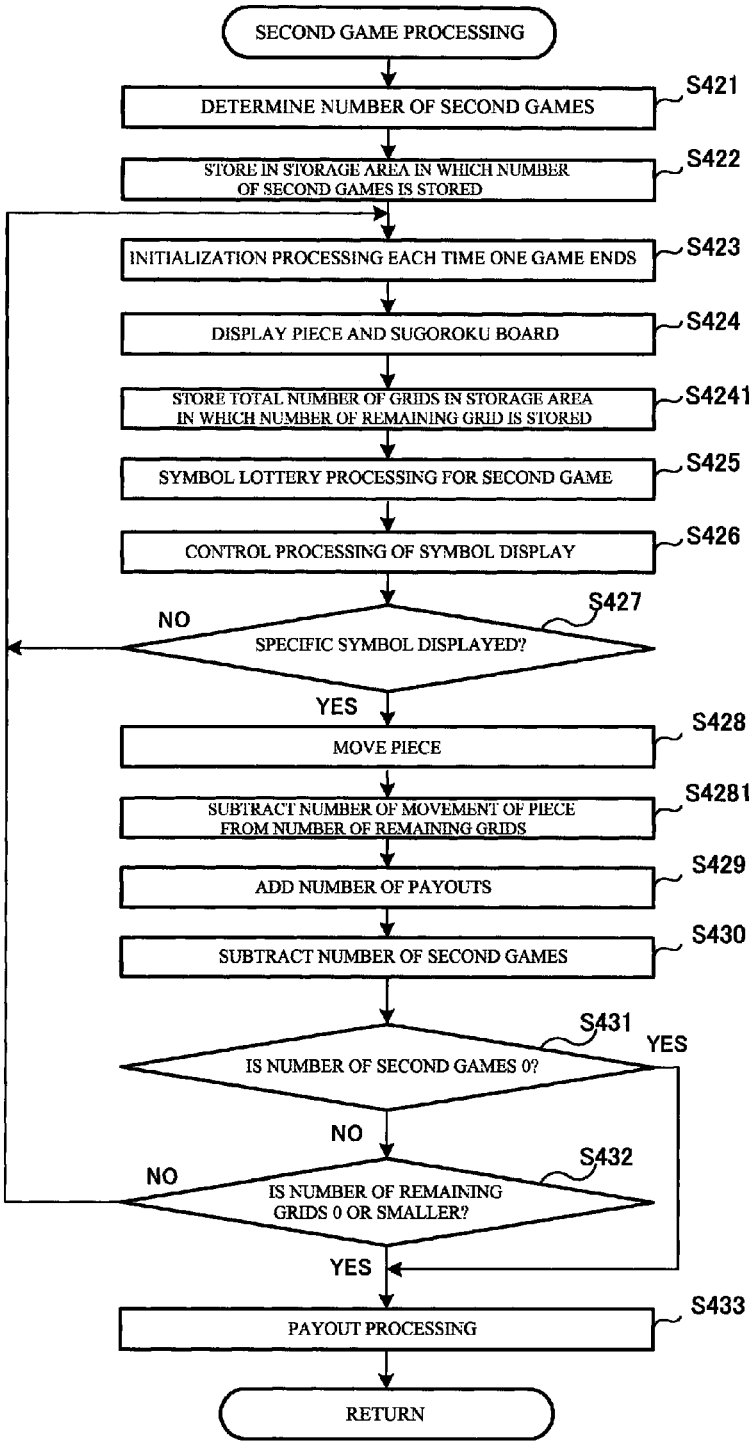
FIG. 42 is a view illustrating a flowchart of process for a second game of a gaming machine in the fifth embodiment of the present invention.

First, as illustrated in FIG. 42, the main CPU 71 executes the same processing as that in the third embodiment in step S421 to step S424. Then, the main CPU 71 executes processing of storing the total number of grids in a storage area in which the number of remaining grid is stored (S4241). In particular, the total number of grids which the goal position but does not include the start position is stored in the storage area as the number of the remaining grids. Then, the same processing as that in the third embodiment is executed in step S425 to step S428. The number of movement of the piece is subtracted from the remaining number of grids, and the calculation result is stored in the storage area in which the number of remaining grid is stored. Then, the same processing as that in the third embodiment is executed in step S429 to step S431.

If the number of the second game becomes 0 (S431: YES) in step S431, the processing proceeds to step S433 and the processing which is the same as that in the third embodiment is executed. If, on the other hand, the number of second game is not 0 (S431: NO), it is determined whether the number of the remaining grids stored in the storage area in which the number of remaining grid is stored is 0 or smaller (S432). That is, if the number of the remaining grids is 0 or smaller, it is determined that the piece 351 has reached the goal point 354 in this game. Therefore, if the number of the remaining grids is 0 or smaller (S432: YES), the processing proceeds to step S433 and the same processing as that in the third embodiment is executed. If, on the other hand, the number of the remaining grids is not 0 or smaller (S432: NO), it is determined that the piece 351 has not reached the goal point 354 and then the processing returns to step S423.

In conventional gaming machines, there has been a problem that it is difficult to give variety to the game if mechanical spinning reels or video spinning reels, which are changeless, are used for the display of symbols. Therefore, a gaming machine 1 which is capable of not reducing the entertainment characteristic is provided in another embodiment of the present invention. This gaming machine 1 is provided with: spinning reels 3 or the like on which a plurality of symbols are rearranged; an upper image display panel 131 on which the second game is displayed; ROM 72, RAM 73 or the like in which a plurality of kinds of data containing symbol specific value data used as symbol specific values each of which is correlated with each of a plurality of symbols is stored; and a main CPU 71 programmed to execute the following processing (a1) to processing (a4) in which:

(a1) processing of rearranging the symbols on the symbol display units by randomly selecting the symbol specific values;

(a2) processing of rearranging symbols by the processing (a1) and running a base game which establishes a winning prize based on the rearranged symbols;

(a3) processing of running the second game on the second game display unit using the result rearrangement of the symbols when a winning prize under a predetermined condition is established in the base game; and (a4) processing of rearranging the symbols, by randomly selecting symbol specific values, such that the result of the rearrangement of the symbols during the running of the second game does not establish a winning prize.

While the gaming machine and a control method of the gaming machine in figures of the embodiments of the present invention have been described heretofore, they are merely provided as specific examples and are not intended to limit the present invention in particular. Design modification is possible, if required, for a specific configuration such as means for solving the problem(s). Moreover, the effects described in the embodiment of the present invention are only the most preferable effects generated from the present invention and the effects to be caused by described in the embodiment of the present invention is not limitative thereto.

For example, while the foregoing embodiments described a case in which the specific symbols are symbols 150 or panda animation character symbols 350 and the symbols that are allowed to be substituted by other symbols are wild symbols 250, the present invention is not limited thereto.

In addition, if a basic game has been continuously played a predetermined number of times without a second game being played, in a case where a cumulative value of the jackpot amount is large, a random number range may be set so that a probability that specific symbols, i.e., the symbols that are allowed to be substituted by other symbols are displayed in the symbol display area 4 becomes high in a basic game, or alternatively, in a case where the cumulative value of the jackpot amount is small, the random number range may be set so that the probability that specific symbols, e.g., the symbols that are allowed to be substituted by other symbols are displayed in the symbol display area 4 becomes low.

Further, in a case where a cumulative value of the jackpot amount is large, where a basic game has been continuously played a predetermined number of times without a second game being played a random number range may be set so that the number of times of base game played becomes relatively large. In this case, the random number range can be set in order to save a player from a situation that the second game has not been played for a long period of time.

Furthermore, in a case where insurance is set to be effective, a random number range may be set so that a probability that specific symbols, e.g., the symbols that are allowed to be substituted by other symbols are displayed in the symbol display area 4 becomes high in a basic game. In this case, the random number range can be set in order for a player to actively set insurance to be effective.

Still furthermore, in a case where insurance is set to be effective, a random number range may be set so that the number of times of base game played is relatively large. In this case, the random number range can be set in order for a player to actively set insurance to be effective.

Yet furthermore, while the foregoing embodiments described a case in which the shading portion 6 is formed in a rectangular shape, the shading portion is formed in a circular shape so as to thereby emit light to a symbol in a circular shape.

Moreover, while the foregoing embodiments described a case in which the partition areas 7 are formed by means of the respective shading portions 6 (6*a* to 6*d*) into partitions, a respective one of which corresponds to one symbol, a plurality of partition areas may be configured so as to emit light to a plurality of symbols while they are provided so as to correspond to a plurality of symbols.

Further, while the foregoing embodiments described a case in which a second game according to the first to third embodiments are individually executed, the present invention may be applied in such a manner that: a second game is determined randomly (determined by means of random number lottery), in a case where a pattern of specific symbols 150 serving as a trigger for causing the routine to migrate from a basic game to the second game has been displayed in the symbol display area 4; and then the determined second game is executed. That is, the gaming machine may be configured to be capable of running any of the second games in the embodiments described above and the mode of the trigger of each second game is not restrictive.

Although the symbol display units are mechanical spinning reels 3 in the present embodiment, the symbol display units are not limited thereto. For example, the symbol display units of a video display system on which the symbols are rearranged in a pseudo (i.e., virtual) manner on a display unit, such as a display, may be used.

INDUSTRIAL APPLICABILITY

The present invention is very effective in providing a gaming machine and a control method of the gaming machine which is capable of diversifying the display mode of symbols by means of spinning reels.

The present invention is highly useful in providing a gaming machine which is capable of running a second game.

What is claimed is:

1. A method of controlling a wagering machine having 1) a first display area at which a plurality of symbols are displayed on a plurality of reels or in a plurality of columns and are rearranged; 2) a controller; 3) a value-addition mechanism by which a player is able to add to the wagering machine value to be bet; and 4) a pay-out mechanism by which currency or other gaming value can be paid out to the player or credited to an available-betting-amount account in accordance with a final outcome of a game once it has been played, the method being executed by the controller and comprising:

as a result of value having been bet and during a first, base game, rearranging the symbols according to weights or probabilities in a first symbol determination table and, upon switching from the base game to a second, bonus game, switching operation of the wagering machine from being in accordance with the first symbol determination table to being in accordance with weights or probabilities in a second symbol determination table;

during the second, bonus game, controlling rearrangement of the symbols in accordance with the second symbol determination table such that winning combinations of symbols other than a predetermined symbol do not occur; and awarding currency or other gaming value in accordance with the final outcome of the game once it has been played.

2. The method of claim 1, wherein the second, bonus game is executed upon the occurrence of a predetermined, prize-winning condition in the first, base game.

3. The method of claim 1, wherein execution of the second, bonus game is displayed at a second display area.

4. A wagering machine, comprising:

a value-addition mechanism by which a player is able to add to the wagering machine value to be bet;

a pay-out mechanism by which currency or other gaming value can be paid out to the player or credited to an available-betting-amount account in accordance with a final outcome of a game once it has been played;

a display area at which a plurality of symbols are displayed on a plurality of reels or in a plurality of columns and are rearranged; and a controller, the controller executing the steps of as a result of value having been bet, rearranging and displaying the symbols during a first, base game;

awarding a payout prize if a winning combination of symbols occurs during execution of the first, base game;

executing a second, bonus game upon the occurrence of a predetermined, prize-winning condition in the first, base game;

controlling rearrangement of the symbols during the second, bonus game such that winning combinations of symbols other than a predetermined symbol do not occur.

5. The wagering machine of claim 4, further comprising a data storage unit in which first and second symbol determination tables are stored for use in connection with the first, base game and the second, bonus game, respectively, with each symbol determination table including numerical values associated with each symbol that could be displayed on each reel or in each column after rearrangement of the symbols;

wherein the numerical values in the symbol determination tables comprise, for each symbol that could be displayed on each reel or in each column after rearrangement of the symbols, an associated range of numerical values;

wherein rearranging the symbols comprises, for each reel or column, generating a random number and displaying the particular symbol with which is associated the range of numerical values within which the generated random number falls; and wherein winning combinations of symbols other than the predetermined symbol are precluded from occurring in the second, bonus game by virtue of there being in the second symbol determination table, for each reel or column, no range of numerical values associated with at least some of said symbols other than the predetermined symbol.

* * * * *